US006648456B1

(12) United States Patent
Asano

(10) Patent No.: US 6,648,456 B1
(45) Date of Patent: Nov. 18, 2003

(54) PRINTING APPARATUS

(75) Inventor: Shinya Asano, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/654,709

(22) Filed: Sep. 1, 2000

(30) Foreign Application Priority Data

Sep. 3, 1999 (JP) ..... 11-250882

(51) Int. Cl.[7] ..... B41J 2/17; B41J 2/01
(52) U.S. Cl. ..... 347/84; 347/49
(58) Field of Search ..... 347/84, 85, 86, 347/87, 49, 50, 39, 37

(56) References Cited

U.S. PATENT DOCUMENTS 6,250,750 B1 * 6/2001 Miyazawa et al. ..... 347/87
6,481,829 B1 * 11/2002 Bailey et al. ..... 347/49
6,540,343 B1 * 4/2003 Umeyama et al. ..... 347/93
6,554,394 B1 * 4/2003 Yamaguchi et al. ..... 347/37
6,554,411 B1 * 4/2003 Hatasa et al. ..... 347/86

FOREIGN PATENT DOCUMENTS

JP 5-270001 * 10/1993

* cited by examiner

*Primary Examiner*—Michael Nghiem
(74) *Attorney, Agent, or Firm*—Fitzpatrick, Cella, Harper & Scinto

(57) ABSTRACT

To provide a printing apparatus enabling its ink supplying member connected to a liquid jet head unit to be prevented from breaking when removing the liquid jet head unit mounted on a head mounting member. When removing a liquid jet head unit mounted on a head mounting member, the liquid jet head unit held by a head holding mechanism is released after an ink supplying member connected to the liquid jet head unit is separated therefrom by a pipe-installing and removing mechanism. In other words, the ink supplying member is separated from the liquid jet head unit by the pipe-installing and removing mechanism while the liquid jet head unit being held in the head mounting member by the head holding mechanism. This means that the ink supplying member is not separated from the liquid jet head unit in the improper direction and leads to preventing the ink supplying member from breaking when removing the liquid jet head unit.

10 Claims, 59 Drawing Sheets

PREDISCHARGE PROCESS FLOW

WIPING PROCESS FLOW

PRINTING APPARATUS

BACKGROUND OF THE INVENTION

1. Field of the Invention

The present invention relates to a printing apparatus for printing images by discharging ink droplets onto printing medium, in particular, to a printing apparatus of which liquid jet head unit is removably attached thereto.

2. Related Background Art

In image printing apparatus functioning as a printer, a copying machine, a facsimile or the like, or image printing apparatus used as an output unit of combined electronic equipment including a computer, a word processor and etc. as well as an output unit of a workstation, they print images on printing medium, such as printing paper and plastic sheets, in response to print signals.

Ink jet printing apparatus, for example, are constructed in such a manner that they print images on printing medium by allowing their liquid jet head unit to discharge ink in response to print signals. In such a configuration, the liquid jet head unit is commonly replaceable.

These type printing apparatus contain at least a liquid jet head unit, an ink tank, a head mounting member and a relatively moving mechanism. The head mounting member, which is referred to as carriage, is mounted removably with the liquid jet head unit.

The ink tank is connected with a pipe to the liquid jet head unit mounted on the head mounting member to supply ink to the same. The relatively moving mechanism consists, for example, of a head move mechanism for moving the head mounting member in the main scan direction and a paper conveying mechanism for moving printing medium in the sub-scan direction, and the relative movement is carried out in such a manner that the printing medium are arranged in the position opposite to the liquid jet head unit mounted on the head mounting member.

In printing apparatus having such a configuration as described above, the liquid jet head unit generally contains an ink holding portion, an input terminal and an ink discharging means, and the head mounting member generally contains a mounting member body, an output terminal, a head holding mechanism and an ink supplying member.

The ink holding portion of the liquid jet head unit contains fine liquid discharging ports (orifices) and liquid paths and temporarily holds ink supplied from an external ink tank. The input terminal of the liquid jet head unit is formed in such a manner as to be connected to the output terminal of the head mounting member, so that external print signals are input therein.

The ink discharging means of the liquid jet head unit consists, for example, of an electromechanical converting element, such as piezo element, and an electrothermal converting element, such as heating element, and allows the ink temporarily held in the ink holding portion to be discharged by the mechanical operation and heating operation corresponding to the input print signals.

The mounting member body of the head mounting member is a portion on which the liquid jet head unit is mounted, the output terminal of the same is disconnectably connected to the input terminal of the liquid jet head unit to transmit print signals, and the ink supplying member of the same supplies the ink in the ink tank to the ink holding portion of the liquid jet head unit.

The output terminal and the ink supplying member as described above are fixed to a head member body, and when mounting the liquid jet head unit on the mounting member body of the head mounting member as described above, the output terminal is connected to the input terminal by this operation, and at the same time, the ink supplying member is connected to the ink holding portion.

Although the ink supplying member may have various configurations, one example of the configurations is a hollow needle having a point in the vicinity of which is opened. In this case, the liquid jet head unit is sealed with an elastic member at least at part of its ink holding portion and has small holes previously formed therein which are closable due to their elasticity.

When the liquid jet head unit is mounted on the mounting member body of the head mounting member, the hollow needles described above are pressed into the small holes of the elastic member and allowed to pass through it by this operation. The head holding mechanism consists, for example, of a lever held in a rotatable manner and holds the liquid jet head unit mounted on the mounting member body.

In the printing apparatus described above, when the liquid jet head unit is intended to be removed from the head mounting member, first the head mounting member is released from the head holding mechanism, then the liquid jet head unit is removed from the head mounting member. The liquid jet head unit thus released from the head holding mechanism is, however, removable in any direction, accordingly, it may be removed in an inappropriate direction, so as to break the ink supplying member consisting, for example, of hollow needles.

In the configurations where hollow needles in particular, as an ink supplying member, are press fitted into small holes of the elastic member of the liquid jet head unit, the ink supplying member may easily break if the liquid jet head unit is displaced in an inappropriate direction, since the ink supplying member, which is not very strong, is held by the elastic member from the all-around direction.

In the configurations where the output terminal of the head mounting member and the input terminal of the liquid jet head unit are connected to each other by mounting the liquid jet head unit on the head mounting member, as described above, when the liquid jet head unit is intended to be removed from the head mounting member, first the output terminal and the input terminal are separated from each other, then the ink supplying member is separated from the liquid jet head unit.

This means that, an ink leak from the liquid jet head unit to the outside caused when the ink supplying member is separated from the liquid jet head unit cannot be prevented by inputting signals, since control signals cannot be externally input in the input terminal at the time of removing the ink supplying member from the liquid jet head unit.

SUMMARY OF THE INVENTION

The present invention has been made in light of the difficulties as described above. Accordingly, the object of the present invention is to provide a printing apparatus which enables removing a liquid jet head unit mounted on a head mounting member and held by a head holding mechanism easily without breaking an ink supplying member, in addition, preventing an ink leak caused when removing the liquid jet head unit mounted on a head mounting.

DETAILED DESCRIPTION OF THE PREFERRED EMBODIMENTS

Figure 1:
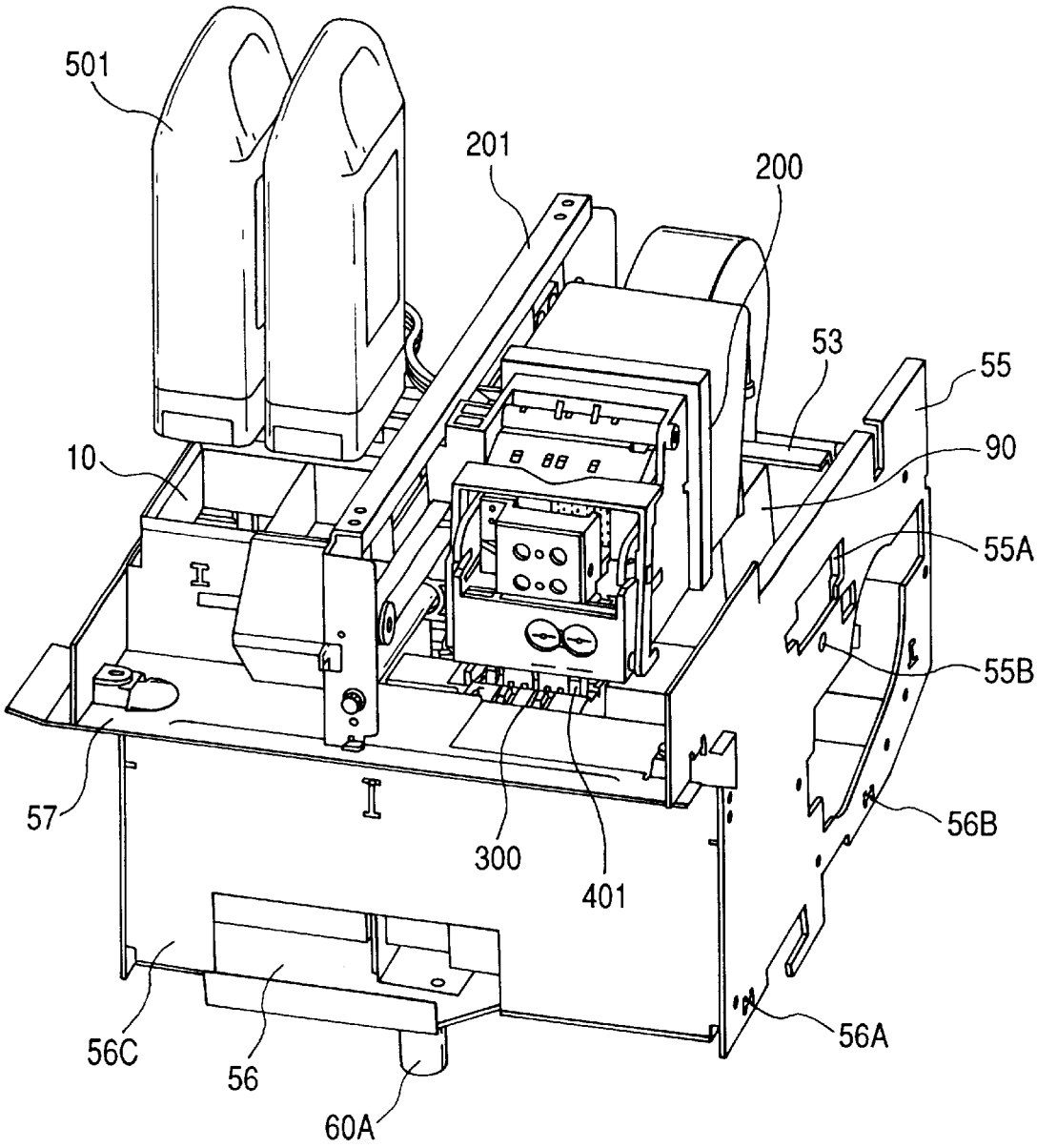
FIG. 1 is a perspective view of a main portion of a printing apparatus in accordance with the present invention.

The embodiments of the present invention will be described with reference to the accompanied drawings.

[Entire Configuration]

First, a printing apparatus will be described which adopts a configuration of the present invention. This printing apparatus has multiple print positions which are provided in a fixed manner so that the apparatus is applicable to two kinds of printing medium, such as envelopes and continuous paper capable of timely cut, and performs continuous printing of prescribed print patterns, and is removably mounted on a printing machine body.

The printing apparatus includes the following units: a liquid jet head unit 401 for discharging ink to do printing, a carriage unit for moving the liquid jet head unit 401 to the print positions and a stand-by position, an ink supplying system unit 10 for supplying ink to the liquid jet head unit 401 and a main tank 501 removably attached thereto, a recovery system unit 300 for recovering wrong conditions such as the discharge defect of the liquid jet head unit 401, a frame unit 70 for housing the above units, a control substrate 80 for electrically controlling printing and a power supply unit 90.

The configuration of this printing apparatus will be described in further detail in terms of each unit described above.

[Frame Unit]

First, the frame unit 70 will be described with reference to FIGS. 1 and 2.

A bottom plate 56 is a sheet metal bent almost L-shaped which has several parallel abuttment portions for keeping distance constant (not shown in the figures) on the left and right of its bottom portion and positioning projects 56A, 56B and multiple threaded portions on both edges of the same. On each of a left side plate 54 and a right side plate 55, there are provided positioning holes into which positioning projects 56A and 56B are inserted. The left side and right side plates 54 and 55 are assembled in parallel with each other to the bottom plate 56, as a central stay, by screwing the threaded portions of the bottom plate 56 into the corresponding threaded holes to a depth of the abuttment portions while keeping the positioning projections 56A, 56B inserted into the respective positioning holes. An upwardly opened box-shaped outer shell of the printing apparatus is formed by screwing down a front portion 56C, which rises in such a manner as to give the bottom plate 56 an almost L-shaped form, and a rear plate 53 located on the side opposite to the front portion 56C.

The bottom portion of the bottom plate 56 has three cylindrical legs attached thereto with caulking; one is on the front side (on the left side of the drawing) and the other two are on the rear side. Fitting these legs on the projections of screw portions (not shown in the figure) allows the bottom plate 56 to be screwed to the printing machine body. The bottom portion also has a slotted hole (not shown in the figure) which is used, in combination with the front side leg 60A, for positioning the frame unit 70 with respective to the printing machine body.

This printing apparatus has spaces for conveying two kinds of printing medium. The one conveying space is constructed as follows. A resist plate 57 of L angle is screwed onto the upper side of the front portion (rising portion of the bottom plate) 56C in such a manner as to extend across the left and right side plates 54 and 55. Envelopes, as a printing medium of this printing machine, are trapped between the upper surface of the envelope-conveying belt of the printing machine body and the lower surface of the resist plate 57, so as to be conveyed from the left side to the right side of FIG. 1 along the inside bent portion of the resist plate 57.

The other space is constructed as follows. In FIG. 2, the position linking a recess 54A in the central portion of the left side plate 54 and a square window 55A in the right side plate 55 is where a gutter is installed which forms the space for conveying continuous paper. Although not shown in the figure, the gutter is installed in a housing container for continuous paper and at the tip of a continuous-paper conveying unit mounted with a conveyance driving system. The positions of this printing apparatus and the continuous-paper conveying unit are determined by inserting a positioning joggle formed at the tip of the gutter into a positioning hole 55B of the right side plate 55, and the printing apparatus is integrated with the continuous-paper conveying unit by screwing the gutter to the left side plate 54.

(CR Frame and Carriage Unit)

In the vicinity of the midway between the left side and right side plates 54 and 55, a CR frame 201 is fixed perpendicularly to the bottom portion of the bottom plate 56. At the abuttment portions for assembling the left side and right side plates 54 and 55 in parallel with each other, insertion holes for inserting the CR frame 201 are equally spaced, and in the upper portion of the almost L-shaped front portion (rising portion) 56C of the bottom plate 56 and in the top portion of the rear plate 53, grooves 53B are formed for regulating the CR frame vertically. This grooves 53B allow the CR frame 201 to rise perpendicularly from the bottom portion of the bottom plate 56. The part name with the prefix "CR" herein indicates that the part is a member related to a carriage.

A carriage 200 mounted with the liquid jet head unit 401 for performing printing is equipped on the right side with respective to the CR frame 201 and on the downstream side of the direction in which printing medium are conveyed and is movable between the two systems of conveying space described above.

(Ink Supplying System Unit)

Figure 2:
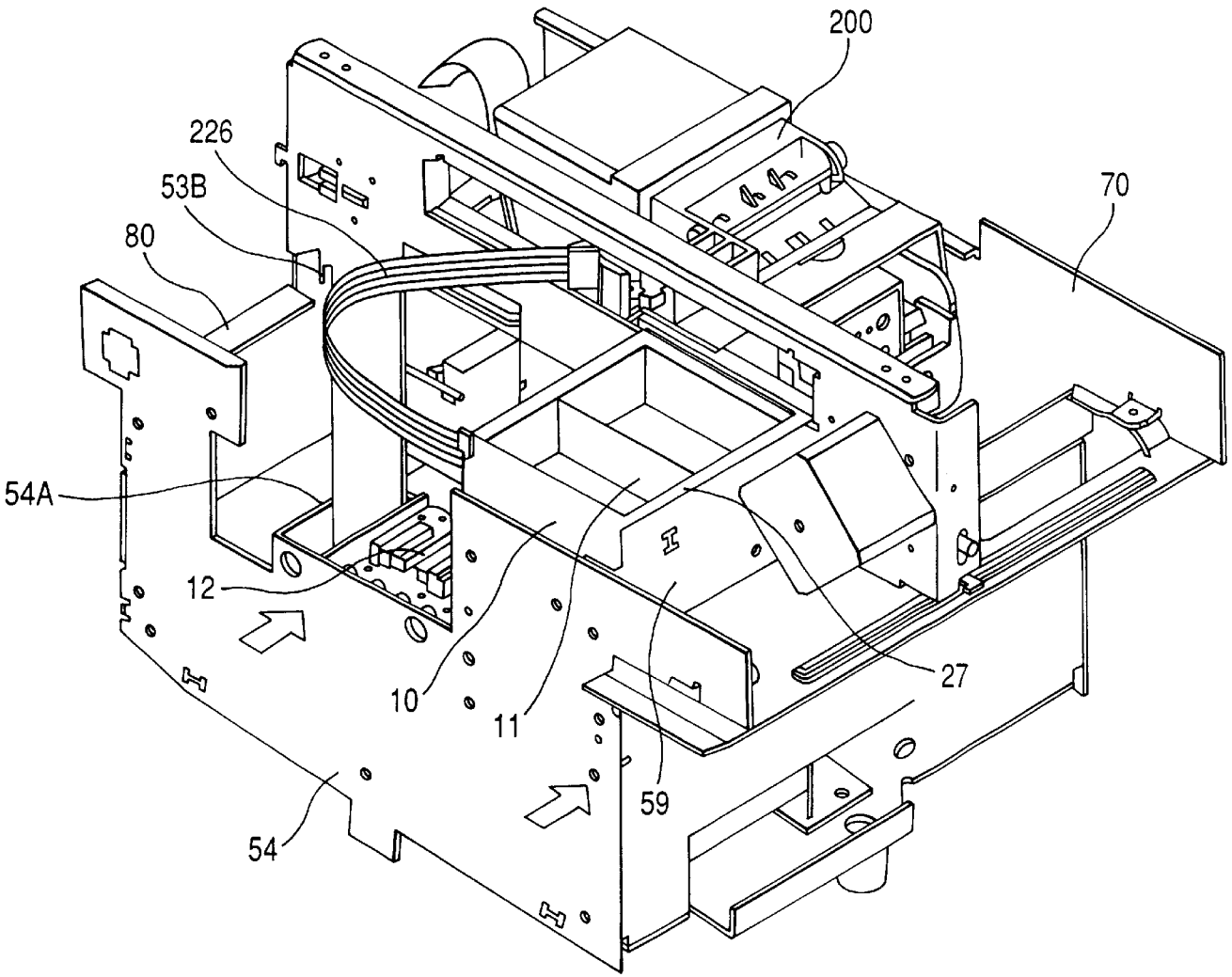
FIG. 2 is a perspective view of the main portion of the printing apparatus of FIG. 1, as seen from a different direction.

As shown in FIG. 1, there is provided an ink supplying system unit 10, which houses multiple main tanks 501 of large capacity, for supplying ink to the liquid jet head unit 401 for discharging ink on the left side with respective to the CR frame 201 and on the upstream side of the direction in which printing medium are conveyed. This ink supplying system unit 10 consists of a tank housing portion 11 which houses multiple main tanks 501 and has a function of drawing out ink from the main tanks 501 and a subtank unit 12 for supplying the ink drawn out to the liquid jet head unit 401. The details of the configuration will be described later.

(Recovery System Unit)

As shown in FIG. 1, there is installed a recovery system unit 300 for recovering the wrong discharging conditions of the liquid jet head unit 401 on the right side with respective to the CR frame 201, on the downstream side of the direction in which printing medium are conveyed and between the two systems of conveying space described above. This recovery system unit 300 forcibly discharges ink from the liquid jet head unit 401 to recover the wrong discharging conditions, and the ink wasted at this time is discharged into a waste-ink reservoir within the printing machine body through a hole in the base portion of the recovery system unit 300 which opens onto the bottom plate 56.

(Control Substrate and Power Supply Unit)

A control substrate 80 for controlling the printing operation and the system of this printing apparatus is fixed to the back face of the rear plate 53 outside the box-shaped frame unit 70. Although not shown in the figures, this control substrate 80 is covered with its connector for receiving signals from the printing machine body exposed from the frame unit. The cover has a cable for sending control signals of the control substrate 80 to the liquid jet head unit 401 within the carriage 200 and an opening for connecting the cable to the carriage 200 and the control substrate 80.

A power supply unit 90 is fixed to the rear plate 53 on the opposite side of the control substrate 80 and inside the frame unit 70. A power supply receptacle for receiving power supply from the outside is equipped at a square hole made in the left side plate 54 and connected to the power supply unit 90 from the outside of the frame unit. The power supply unit 90 is connected to the control substrate 80 and the substrate on the carriage 200 to supply power thereto.

[Tank-Housing Portion]

Figure 3:
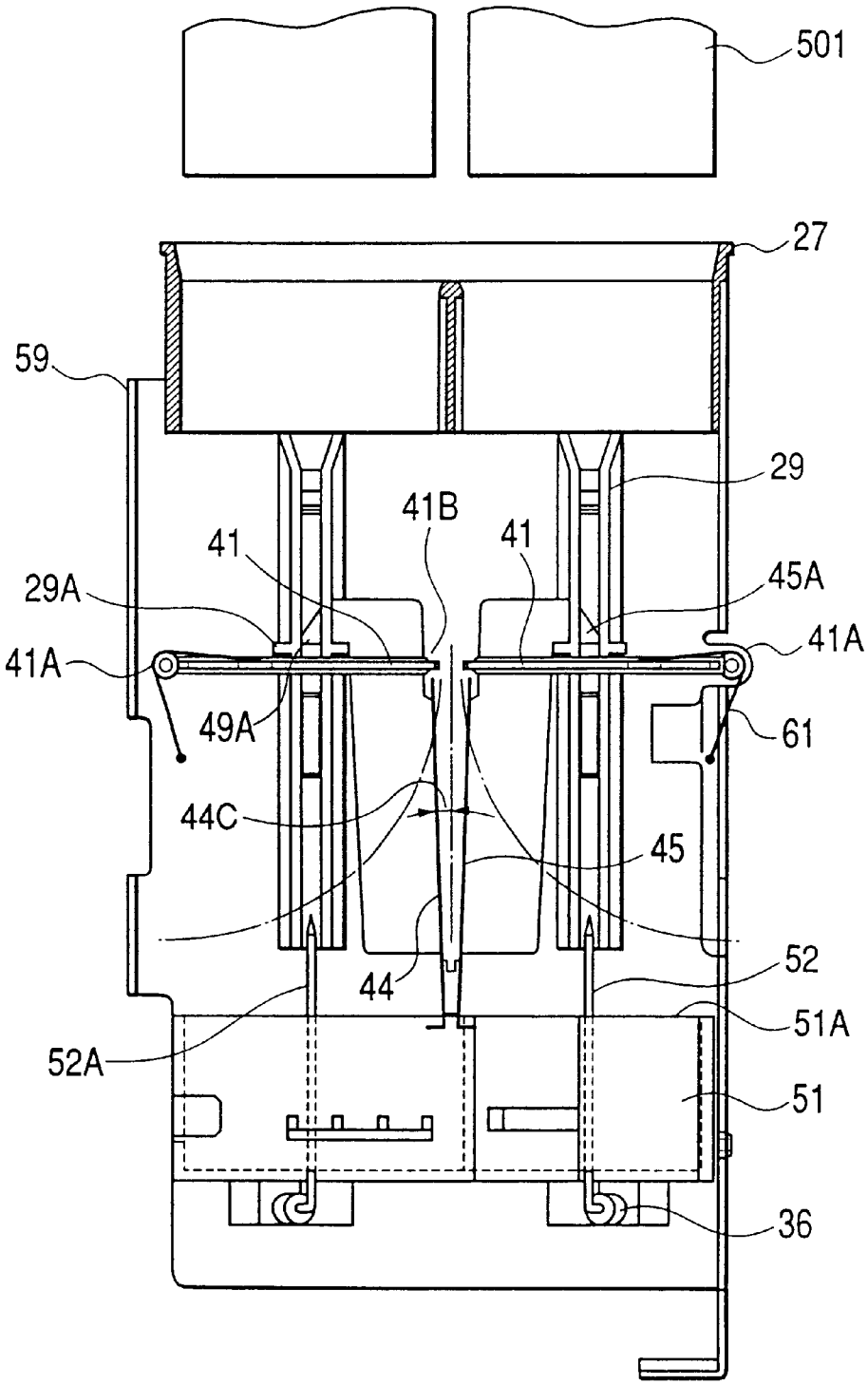
FIG. 3 is a sectional view of a tank-housing portion with no main tank housed therein.
Figure 4:
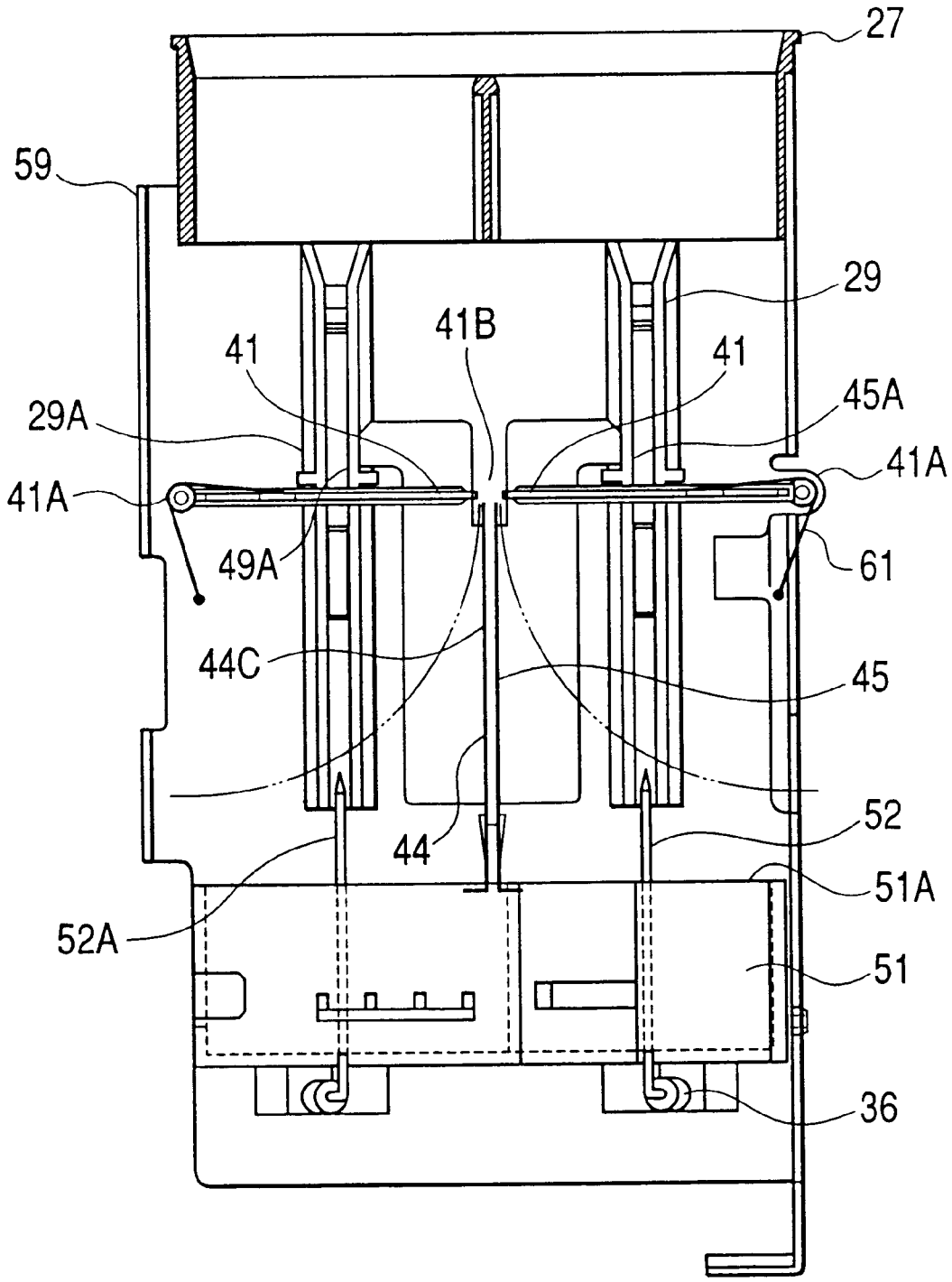
FIG. 4 is a sectional view of the tank-housing portion of FIG. 3 in state where it can house a main tank.

A tank-housing portion 11 will be described with reference to FIGS. 3 to 5. A tank holder 59 is a frame for housing and holding the main tank 501 and its portion which functions as insertion opening for the main tank 501 is opened upwardly The tank-housing portion 11 has a U-shape and it is screwed and fixed to the left side plate 54 at one of its plane side with one edge of its base portion in contact with the bottom plate 56. A tank slot 27 is put in the upward opening portion of the tank holder 59 of which opening area is largest at the insertion opening for the main tanks 501, is getting smaller as they get closer to the housing portion, and finally becomes almost the same as the cross section of the main tanks 501. In the base portion of the tank slots 27, positioning rails 29 for positioning the main tanks 501 and tank guides (not shown in the figures) are provided so as to hold multiple main tanks 501 between the tank slots while keeping them facing each other. One side of the main tank 501 is positioned by fitting a rib 524, which is provided on one shorter side in the insertion cross section of the main tank 501 and extends along the insertion direction (refer to FIG. 5), in a groove of the positioning rail 29. The other sides of the main tank 501 are positioned in such a manner as to hold the shorter sides between them, and thus the insertion position of the main tank 501 is determined.

A needle base 51 forms a housing bottom 51A for the main tank 501 to which a hollow needle 52, which is to be a port for drawing out ink from the main tank 501, is fixed vertically upwardly. The hollow needle 52 is a metal pipe having a sharp point and a side with holes, and it is fixed to the housing bottom 51A with an ink detection plate (not shown in the figures) with nearly half of its straight-line portion buried in the needle base 51. Two hollow needles 52 are prepared for each main tank 501.

As described later, there are provided communication ports on the bottom portion of the main tank 501 at the position where they can face the hollow needles 52, and each of them is stopped up with a rubber stopper 513. In equipping the main tank 501, once the bottom portion of the main tank 51 reaches the housing bottom 51A, the hollow needles 52 pass through the respective rubber stoppers 513 stopping up the communication ports of the main tank 51, which allows the ink in the main tank 501 to be drawn outside (in an ink supplying system unit described later) via one of the hollow needle 52. In this case, one communication port and one hollow needle 52 function as a port for drawing out ink, and the other communication port and the other hollow needle 52 function as a path for sending air back to the main tank 501; thus, the hollow needles 52 and the communication ports serve to smoothly proceed gas-liquid replacement in the main tank 501. One end of the ink detection plate described above is electrically connected to the control substrate 80 with a lead wire. The presence of any ink in the main tank 501 can be detected by measuring the electric current value, via the ink detection plate, between the two hollow needles 52 whose points are exposed in the main tank 501.

In the vicinity of the middle of the tank-housing portion 11, accident prevention doors 41 of the same number as the main tanks 501 are installed so that operators should not be hurt by the tips of the hollow needles 52.

Now, with reference to FIG. 3, the tank-housing portion 11 will be described in terms of the state where it is not equipped with any main tanks 501.

Each of the accident prevention doors 41 has the center of its rotation center 41A on the sidewall portion of the tank-housing portion 11 and is biased by a twisted coil spring 61 toward the tank insertion opening. And the rotation by this biased force is stopped at the projective portion 29A of the positioning rail 29. Therefore one end of the rotation range of the accident prevention door 41 is regulated where it is in a nearly horizontal position. Below the respective free ends 41B of the accident prevention doors 41 there are provided stopper 44, 45 for restricting the opening and closing of the accident prevention doors 41. The stoppers 44 and 45 are symmetric and are provided in a rotatable manner. And when the tank-housing portion 11 is equipped with two main tanks 501, the center of the rotation is located just below the clearance portion between the tow main tanks 501. The stoppers 44, 45 are fixed in such a manner as to insert their support arms into two side walls of the tank holder 59 and provided in a direction at a slight angle of 44C to a vertical axis so that each upper end of them is in such a position so as to engage with the free ends within the rotating-radius of the accident prevention doors 41.

In state where the tank-housing portion 11 is not equipped with main tanks 501, the end portions 44A and 45A, which are on the positioning rail side, of the stoppers 44 and 45 enter the respective groove portions of the positioning rails, so that their positions are maintained. If the accident prevention doors 41 are pushed downwardly at this point, since the free ends of the accident prevention doors are hindered from rotating above the stoppers 44 an 45, the accident prevention doors 41 are not allowed to open.

When the main tanks 501 begins to be inserted into the tank-housing portion 11, the ribs of the main tank 501 displace the end portions 44A and 45A of the stoppers 44 and 45 which have already entered the positioning rails. As shown in FIG. 4, the stoppers 44 and 45 come to rise nearly perpendicularly due to the above displacement and are extruded out of the rotating-radius range of the free ends of the accident prevention doors 41, which allows the accident prevention doors to rotate downwardly. Thus the main tanks 501 can be inserted further toward the housing bottom without being hindered by the accident prevention doors 41.

[Subtank Unit]

(Rough Description of Ink Supplying System Flow Path)

Now the flow path for supplying ink from the main tanks 501 to the liquid jet head unit 401 and the configuration thereof will be described with reference to FIGS. 51 to 54.

Figure 51:
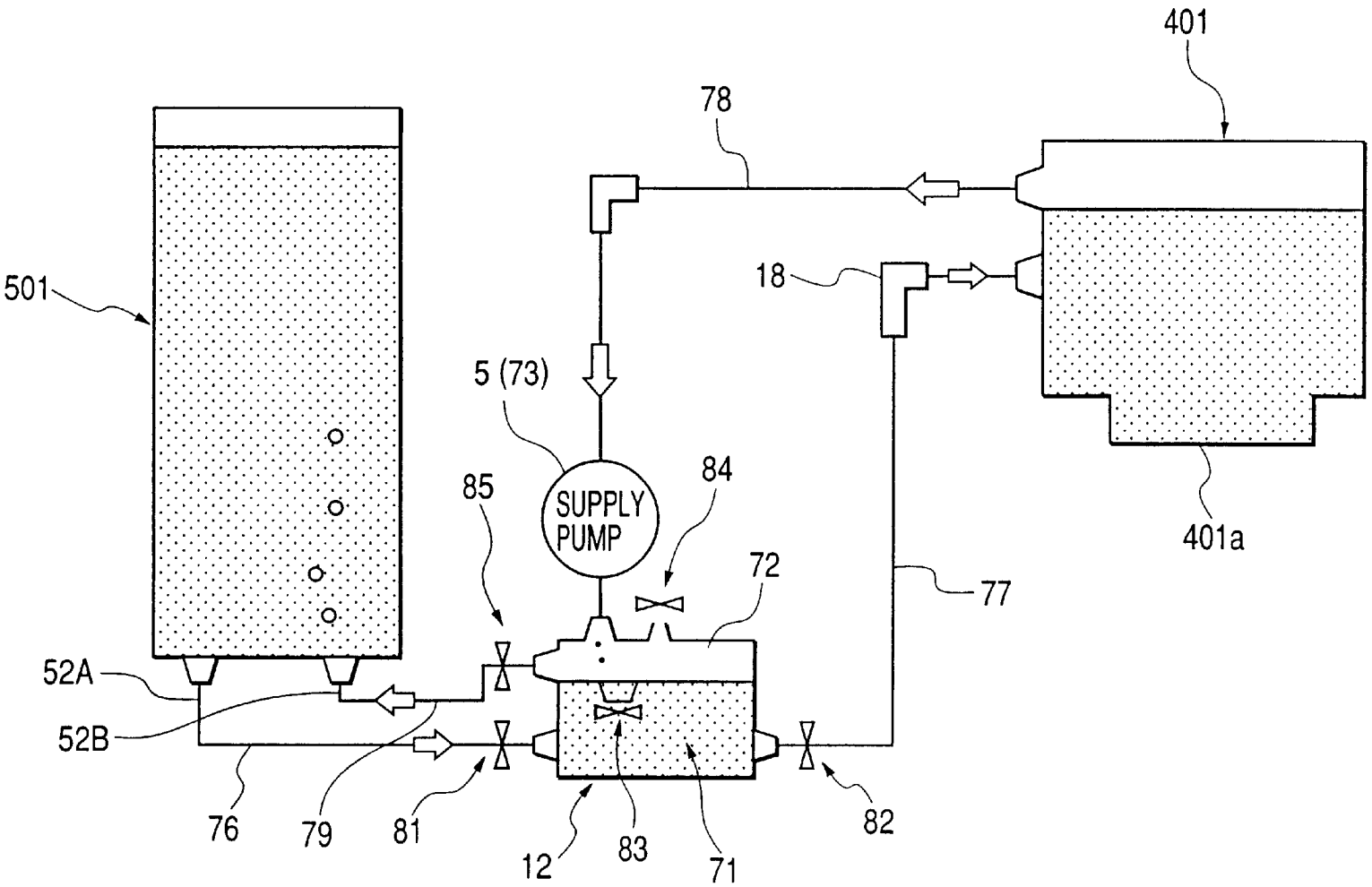
FIG. 51 is a block diagram of a flow path of an ink supplying system used in an printing apparatus embodying the present invention.

In order to apply a negative pressure due to the head difference to the ink in the liquid jet head unit 401 so that the meniscus of a nozzle surface 401*a* of the liquid jet head unit 401 should not be destructed by pressure, a subtank unit 12 is installed in the midway of the flow path between the main tank 501 and the liquid jet head unit 401 in the position lower than the nozzle surface 401*a* of the liquid jet head unit 401 (refer to FIG. 51). And a pressure generating means 5 (73) is connected to the liquid jet head unit 401 for allowing a negative pressure to exist in a common liquid chamber of the liquid jet head unit 401. The subtank unit 12 and the liquid jet head unit 401, and the liquid jet head unit 401 and the pressure generating means 5 are connected with a rubber joint and a tube, respectively.

Figure 52:
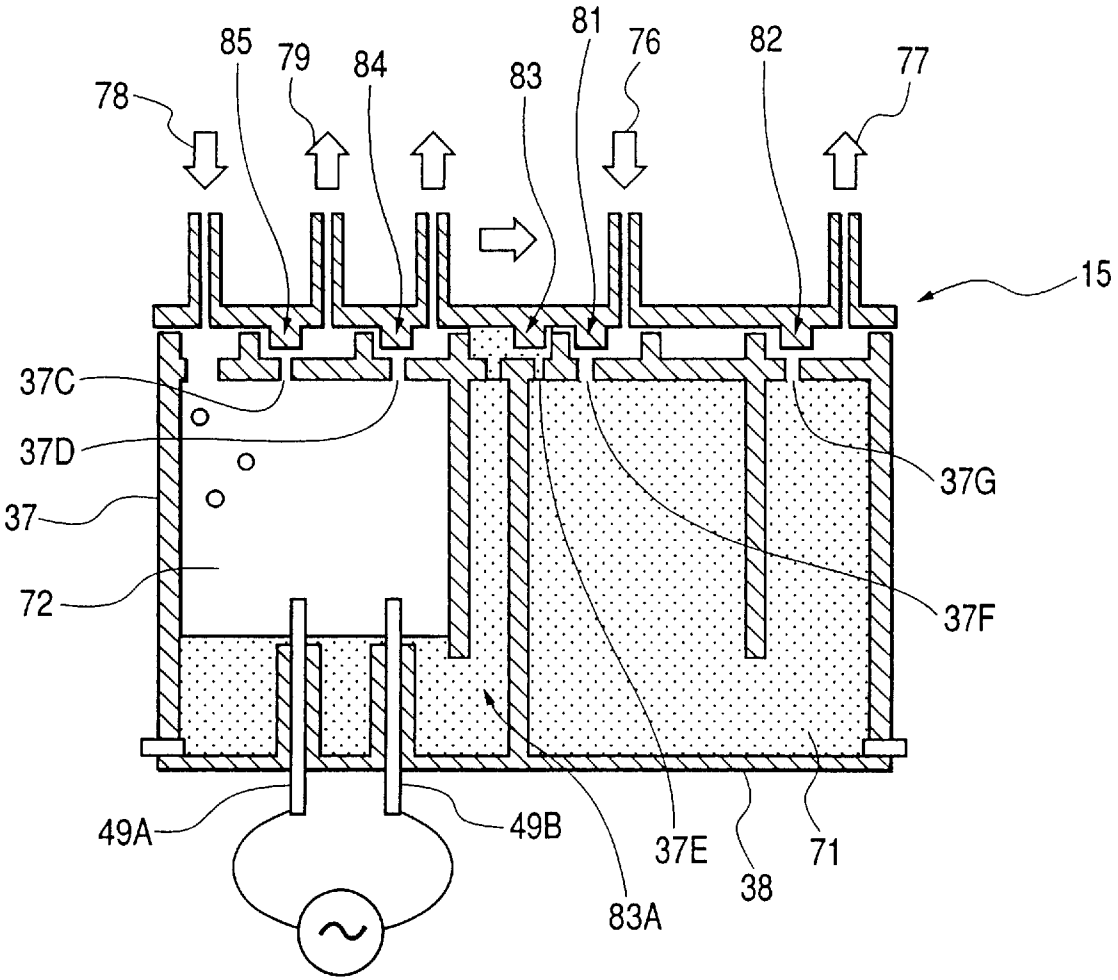
FIG. 52 is a block diagram of a valve opening and closing mechanism in an ink supplying system used in a printing apparatus embodying the present invention.

The subtank unit 12 contains a subtank base 37 which forms multiple small chamber and a subtank cover 38, as shown in FIG. 52. The subtank unit 12 roughly consists of a first small chamber 71 for generating a head difference (hereinafter referred to as "head difference generating chamber"), a second small chamber 72 provided with electrodes for detecting the liquid jet head unit 401 being filled up with ink (hereinafter referred to as "fill-up detecting chamber"), a pressure generating means 73 for generating a suction negative pressure, and 5 types of valves capable of being opened and closed which are provided at each ink port of each chamber. Various types of modes related to ink supply are realized by changing the flow path through making various combinations of opened and closed valves.

The ink drawn out from the main tank 501 by one hollow needle 52A is sent to the head difference generating chamber 71 via a supplying valve 81 through a needle joint 36 connected to the needle (refer to FIG. 3) and a first supplying tube 76 and is temporarily stored in the same chamber. At the ink drawing port of the head difference generating chamber 71 a print valve is provided, and the ink stored the same chamber is sent vertically upwardly via a print tube 77. Once reaching a joint portion (not shown in the figures) where multiple rubber joints L18 each having a L-shaped flow path at almost the same height as the carriage 200 are arranged, the ink is sent in the direction in which the carriage travels and supplied to the liquid jet head unit 401 via a tube extending from the carriage 200 (the ink circulation in carriage 200 and the liquid jet head unit 401 will be described later).

A tube connected to the upper portion of the liquid jet head unit 401 for removing a puddle of bubbles in the common liquid chamber is returned again to the joint portion (not shown in the figures) and connected, via rubber joints L, to the pressure generating means 73 through a suction tube 78.

The pressure generating means 73 generates a negative pressure by driving a pump and let the negative pressure remain in the common liquid chamber of the liquid jet head unit 401, so that ink is drawn out from the main tank 501 on the most upstream side of the ink flow path and supplied to the liquid jet head unit 401. The configuration of the pressure generating means 73 will be described later.

The rear side (the discharging side) of the ink flow path of the pressure generating means 73 is connected to the fill-up detecting chamber 72. If the above connecting port is regarded as a ink-entering port of the fill-up detecting chamber 72, there are three portions which can be regarded as ink-draining ports. One is a first ink-draining port connected to the head difference generating chamber 71 via a communication valve 83 and second one is an atmosphere valve 84, and a head difference between the nozzle surface of the liquid jet head unit 401 and the liquid surface of the subtak unit 12 is generated by opening the communication valve 83 and the atmosphere valve 84. A third ink-draining port is a gas-liquid replacement valve 85, and ink reaches the main tank 501 through the reflux tube 79 extending from the third ink-draining port, via a second hollow needle 52B. The second hollow needle 52B mostly functions as a flow path of air, and is used for gas-liquid replacement in the main tank 501.

Multiple subtank units are provided independently for each of multiple main tanks 501 from which ink is supplied to multiple liquid jet head units 401.

(Pressure Generating Portion)

Figure 53:
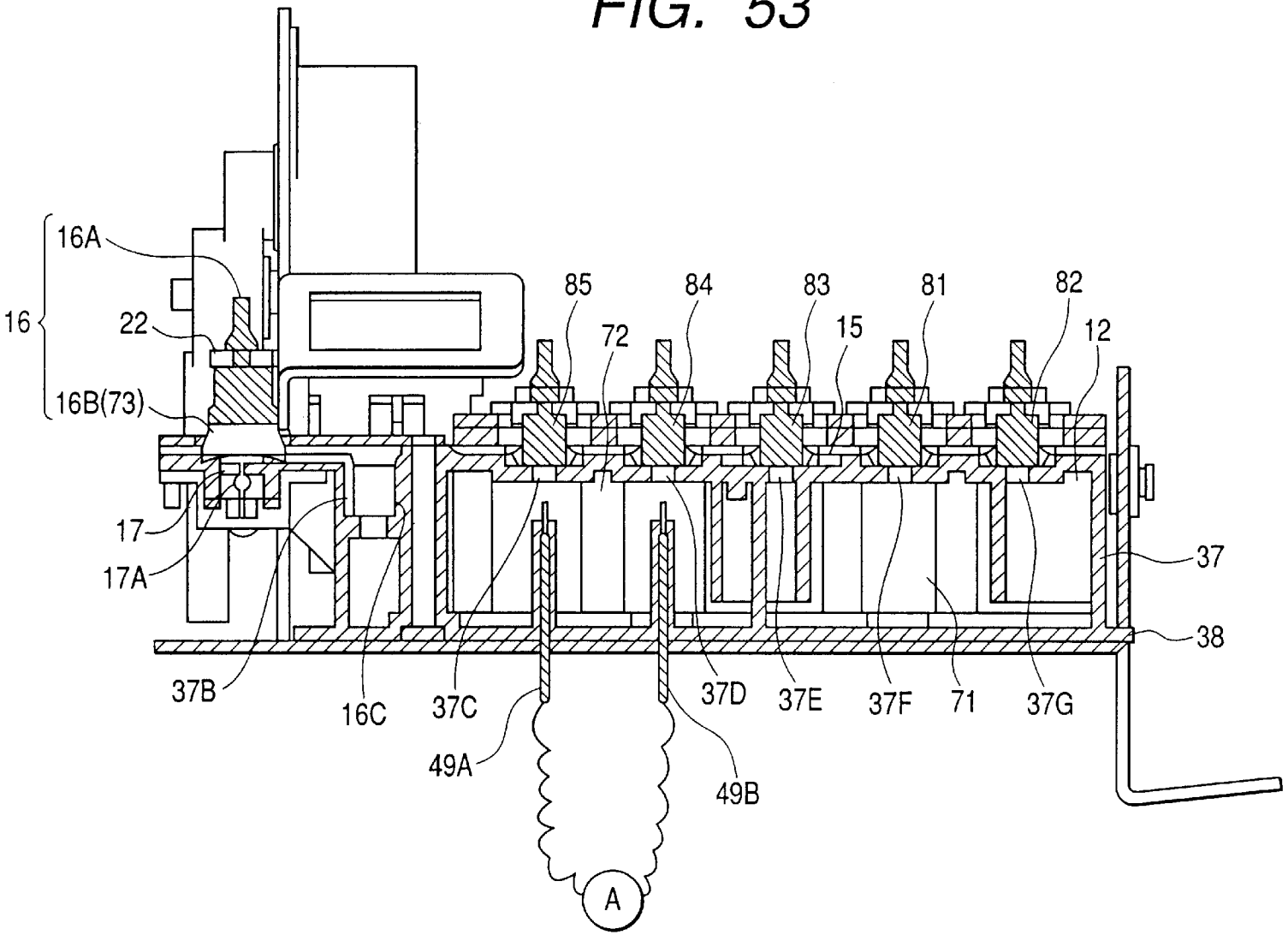
FIG. 53 is a sectional view of a configuration of a subtank in an ink supplying system used in a printing apparatus embodying the present invention.
Figure 54:
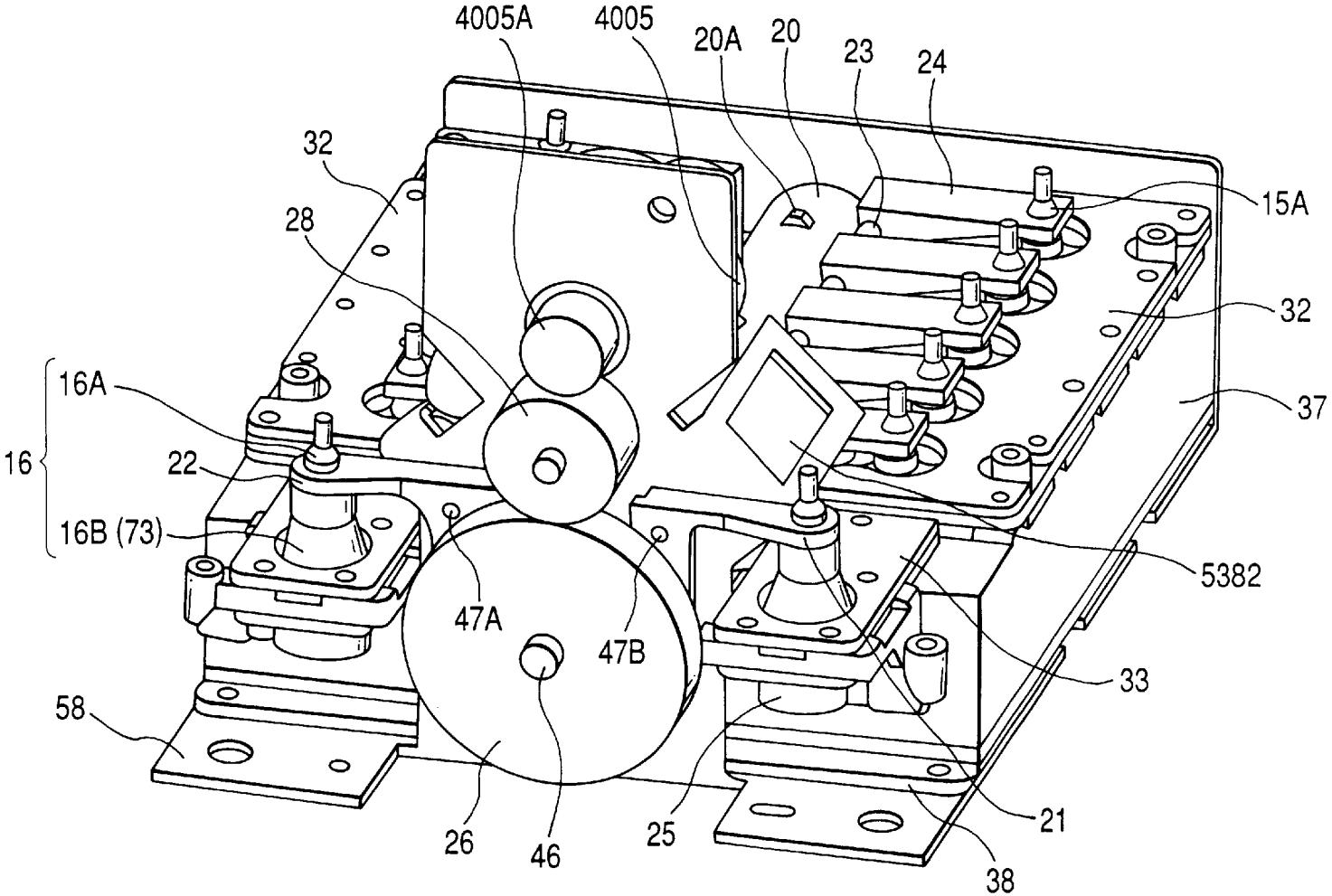
FIG. 54 is a sectional view of a configuration of a subtank in an ink supplying system used in a printing apparatus embodying the present invention.

The aforementioned pressure generating means will be described with reference to FIGS. 53 and 54.

Reference numeral 4005 designates a supplying motor screwed to a subtank holder 58, and its forward rotation allows an eccentrically grooved cam in a pump cam 26 to rotate while being slowed down by a pinion gear 4005A, an idler gear 28 and a periphery gear of the pump cam 26 all of which constitute gear trains.

A pump lever L 22 and a pump lever R 21 are arranged symmetrically with respect to the column of gears described above, and both the pump levers 21 and 22 are rotationally movable around pump lever shafts 47A and 47B fixed by caulking to the subtank holder 58 through rotational holes formed in the middle of the pump levers. One end of each of the pump levers L and R can slide into an eccentrically grooved cam via a roller (not shown in the figures), and a single rotation of the pump cam 26 is converted to a reciprocating motion of the other end of each of the pump levers L and R.

The other end of each of the pump levers L and R grips a round knot 16A of a pump rubber 16 with its grooves tapered off at the end. The pump rubber 16 consists of the round knot 16A arranged in the middle thereof, a bowl-shaped thin cylinder portion 16B and a thin cylindrical portion with a bottom 16C. The bowl-shaped cylinder portion 16B forms a pressure generating chamber with round spot facing (not shown in the figures) of the subtank base 37. In the center hole of the round spot facing, a bevel valve 17 having a bevel on the pressure generating chamber side is fixed with a stopper 17A for preventing the bevel valve from coming off. The ink path is timely opened to the position within the inner diameter of the bevel of the round spot facing. In the opening side described above (opposite to the bevel side) a small chamber is formed with an L joint 25, and a suction tube 78 extending from the liquid jet head unit 401 is connected to the chamber.

The round spot facing also has a groove 37B connecting to the fill-up detecting chamber 72, and the thin cylindrical portion with a bottom 16C of the pump rubber 16 seals its surrounding at the cylindrical ink-entering port of the subtank base 37 and also stops up the tip of the groove 37B. Since the pump rubber 16 is sandwiched between a pump plate 33 and the subtank base 37 and the L joint 25, the bowl-shaped cylinder portion 16B is fixed in the sealed state by screwing the pump plate 33, the subtank base 37 and the L joint 25.

Now, suppose that the pump cam 26 is turned one half turn by driving the supplying motor 4005 and the pump levers L and R move in such a direction as to fill up the inside of the bowl-shaped cylinder 16B (forward motion) via the round knot 16A. Since the pressure increased inside the bowl-shaped cylinder is applied to the bevel valve 17, the opening under the bevel does not communicate with atmosphere, and the pressure needs its escape. Since the cylindrical portion with a bottom 16C, which stops up the tip of the groove 37B, is thin, the rubber falls down inside the cylindrical portion due to higher pressure outside and lower pressure inside; thus the gas under pressure inside the bowl-shaped cylinder 16B is exhausted into the fill-up detection chamber 72.

Then, suppose that the pump cam 26 is turned another one half turn and the pump levers L and R move in such a direction as to enlarge the bowl-shaped cylinder 16B (backward motion). Under such conditions, the inside of the cylinder is under negative pressure. The inside of the cylindrical portion with a bottom 16C of pump rubber is under atmospheric pressure, the outside groove 37B being under negative pressure and the tip of the groove 37B being in the sealed state. Since the inside the small chamber of the L joint 25 is under atmospheric pressure, the negative pressure inside the cylinder leads to the bevel valve 17 being in the open state. Consequently, the negative pressure inside the cylinder allows the common liquid chamber of the liquid jet head unit 401 to be under suction.

Thus, the continuous rotation of the pump cam 26 increases negative pressure inside the liquid jet head unit 401.

(Change in Flow Path)

In this embodiment, the flow path of the ink supplying system is changed through use of 5 types of valves, and thereby various functions are realized.

The upper portion of the subtank base 37 contains five grooves forming a flow path and openable/closable holes 37C, 37D, 37E, 37F and 37G open to the above respective grooves. The grooves have portions for covering the above openings so as to form a flow path and a multi-valve rubber 15, which is a single rubber member superior in sealing property and elastic force, having both joggles for stopping up the five openable/closable holes and a diaphragm portion movable up and down. And the opening and closing of multiple valves can be realized by such portions and multi-valve rubber as the grooves have.

For the multi-valve rubber 15 suitably used is chlorinated butyl rubber having low permeability to gases and good resistance to ink.

In the outside of the flow path of the diaphragm, which has joggles for stopping up the openable/closable holes formed in the middle thereof, arranged are projections 15A becoming thicker to the end. Each of the projections is gripped by one end of a rotatable valve lever 24 in such a manner that the association of the valve lever is possible. There exist valve levers 24 as many as the openable/closable holes, and they are arranged in such a manner as to rotate in the direction in which the openable/closable holes of the subtank base 37 are arranged. The supporting point of each of the valve levers 24 is formed of a lever arm 23, and they are fixed integrally with the subtank cover 38, the subtank base 37, the multi-valve rubber 15, the lever arm 23 and a lever spring (not shown in the figures) by screwing them together to the subtank plate 32 with a continuous thread. Each joggle of the multi-valve rubber 15 is shaped so as to stop up each openable/closable hole while maintaining its natural shape. Further, the multi-valve rubber 15 is biased by the lever spring (not shown in the figures) screwed together therewith in such a direction that each joggle stops up each openable/closable hole.

The valve levers 24 are arranged symmetrically on each inside of the two subtanks arranged. The valve levers 24 are uniformly downwardly bent L-shaped at the respective rotation supporting points, and the other end of each valve lever 24 has a slide force point (not shown in the figure). The center of the pump cam described above is located at the center of the two lines of the slide force points. A valve shaft 46 having a sequential motion with the pump cam of which center hole is cut D-shaped is supported parallel to the line of subtank units 12 in a rotatable manner by a subtank holder 58. A timing drum 20 with one way clutch is mounted on the valve shaft 46 in a coaxially rotatable manner. The timing drum 20 has projections 20A, which push the respective slide force points of the valve levers 24, formed thereon in accordance with the rotation angles required. When the projections 20A push the slide force points of the respective valve levers 24, the other end of each valve lever 24 acts to open the openable/closable hole of the subtank base 37. Without the projections, the openable/closable holes are kept sealed.

The rotation of the timing drum 20 is caused by the backward rotation of the supplying motor 4005. The supplying motor 4005 is a pulse motor and can be stopped at rotation angles required. In other words, when the motor rotating in a backward way, since the one way clutch built in the timing drum 20 is allowed to rotate together, the pump operates in the operation of opening and closing the valves, but on the other hand, when the angle of the timing drum 20 is determined and the state of valves is fixed, if the motor is forwardly rotated according to the need, the pump operates to generate a negative pressure while the flow path is kept the same state.

The timing drum 20 has a shield plate, which indicates the standard position (angle), projecting therefrom (not shown in the figures). The standard position is confirmed with a photosensor 5382, and the rotation angle of the timing drum 20 is operated adopting an appropriate number of steps in accordance with the angle from the standard position required, so as to realize various flow path conditions. (Flow Path Conditions and Function thereof)

Now, the flow path conditions realized by varying the combination of opening or closing valves and the functions thereof will be described. The functions are divided into five categories: "Supply 1", "Supply 2", "Printing", "Circulation" and "Replacement".

The function produced by the combination of the left side, as seen from the envelope conveying side, is regarded as "Supply 1". And let each part be denoted as follows: main tank 501 (L), subtank unit 12 (L) (pressure generating portion inside the unit 73 (L)) and liquid jet head unit 401 (L), and let a row of valves be denoted by 81 (L) to 85 (L). The function produced by the combination of the right side is regarded as "Supply 2". And let each part be denoted as follows: main tank 501 (R), subtank unit 12 (R) (pressure generating portion inside the unit 73 (R)) and liquid jet head unit 401 (R), and let a row of valves be denoted by 81 (R) to 85 (R).

In a first combination "Supply 1", the valves opened are 81 (L), 82 (L), 85 (L) and 85 (R) and the valves stopped up are 83 (L), 84 (L), 81(R), 82(R), 83(R) and 84(R). The negative pressure generated in the pressure generating portion 73L extends to the common liquid chamber of the upstream side liquid jet head unit 401 (L), head difference generating chamber 71 (L) and the main tank 501 (L) in this order, and ink is sucked from the above chambers and tank in backward order. It goes without saying that the nozzle surface of the liquid jet head unit 401 (L) needs to be closed tightly with a cap so as to prevent the meniscus of the nozzle surface from breaking. Once the ink in the main tank 501 (L) reaches the pressure generating portion 73 (L), it is fed to the fill-up detecting chamber 72 (L) provided with a fill-up detecting means by the discharging force of the cylinder.

The fill-up detecting means detects the fill-up detecting chamber 72 (L) having been filled up with ink by applying electric current between two electrodes 49A and 49B projecting from the subtank cover and measuring the resistance. Two ink-draining valves of the fill-up detecting chamber, the atmosphere valve 84 (L) and the gas-liquid replacement valve 85 (L), are openable/closable holes located above the electrodes 49A and 49B, and once fill-up detecting means detects the fill-up detecting chamber 72 (L) having been filled up with ink, the rotation of motor is stopped, so as no more ink to be sucked. The remaining ink-draining valve, the communication valve 83 (L), is a flow path connected to the head difference generating chamber 71 (L), and its entrance 83A is located below the portions to which the above electrodes are exposed.

It is clear that no ink is supplied to the liquid jet head unit 401 (R) side in this mode, since the valve 81 (R) is stopped up.

In "Supply 2", the valves opened are 85 (L), 81 (R), 82 (R) and 85 (R) and the valves stopped up are 81 (L), 82 (L), 83(L), 84(L), 83(R) and 84(R). As described in "Supply 1", in this mode ink is supplied to the liquid jet head unit 401 (R) and no ink is supplied to the liquid jet head unit 401 (L).

In "Printing", the valves 82 (L), 83 (L), 84 (L), 82 (R), 83 (R) and 84 (R) are open and the valves 81 (L), 85 (L), 81(R) and 85(R) are closed. This is an ink supplying system which realizes the printing conditions of both the liquid jet head units 401. The ink supply from the main tank to the subtank is shut off. The atmosphere valves 84 (L) and 84 (R) are opened to allow the atmosphere to be released. The ink in the head difference generating chamber and the ink is filled up in the fill-up detecting chamber are in communication with each other, and when the fill-up detecting chamber is filled up with ink, the head difference is determined based on the liquid surface of the ink in the fill-up detecting chamber.

In "Circulation", the valves 82 (L), 83 (L), 82 (R) and 83 (R) are open and the valves 81 (L), 84 (L), 85 (L), 81(R), 84(R) and 85(R) are closed. Ink circulation between the common liquid chamber of the liquid jet head unit 401 and the subtank unit is carried out for each liquid jet head unit 401 independently. In this case, too, the nozzle surface is tightly closed with a cap so as to prevent the meniscus to break.

In "Exchange", the valves are not opened, and all of them are shut. In exchange of the ink tanks, all the valves are shut, thereby preventing ink dropping due to the head difference in each tube.

[Carriage]

The configuration of a carriage 200 will be described in detail.

(Carriage Holding Frame)

Figure 6:
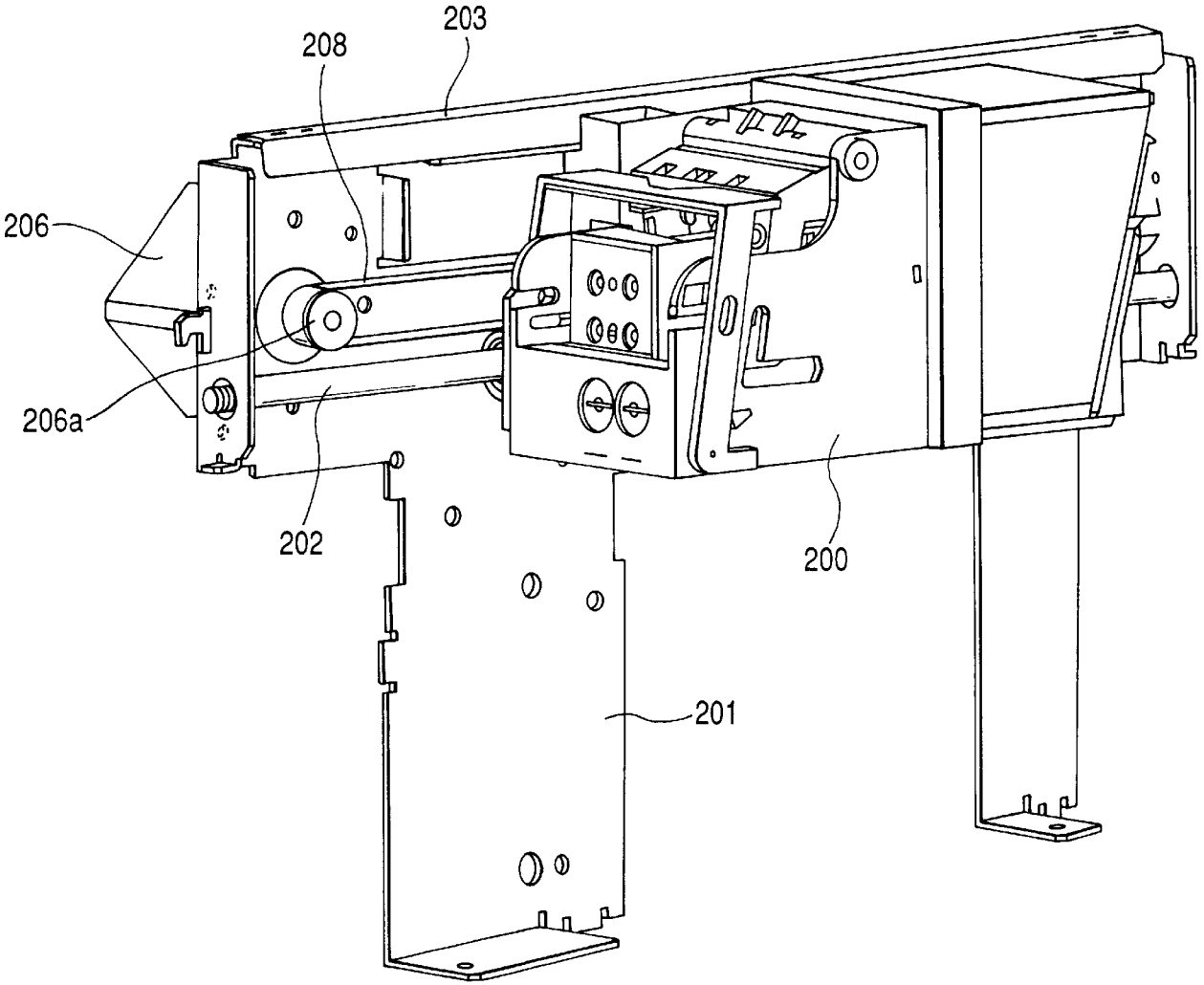
FIG. 6 is a perspective view of a carriage unit.
Figure 7:
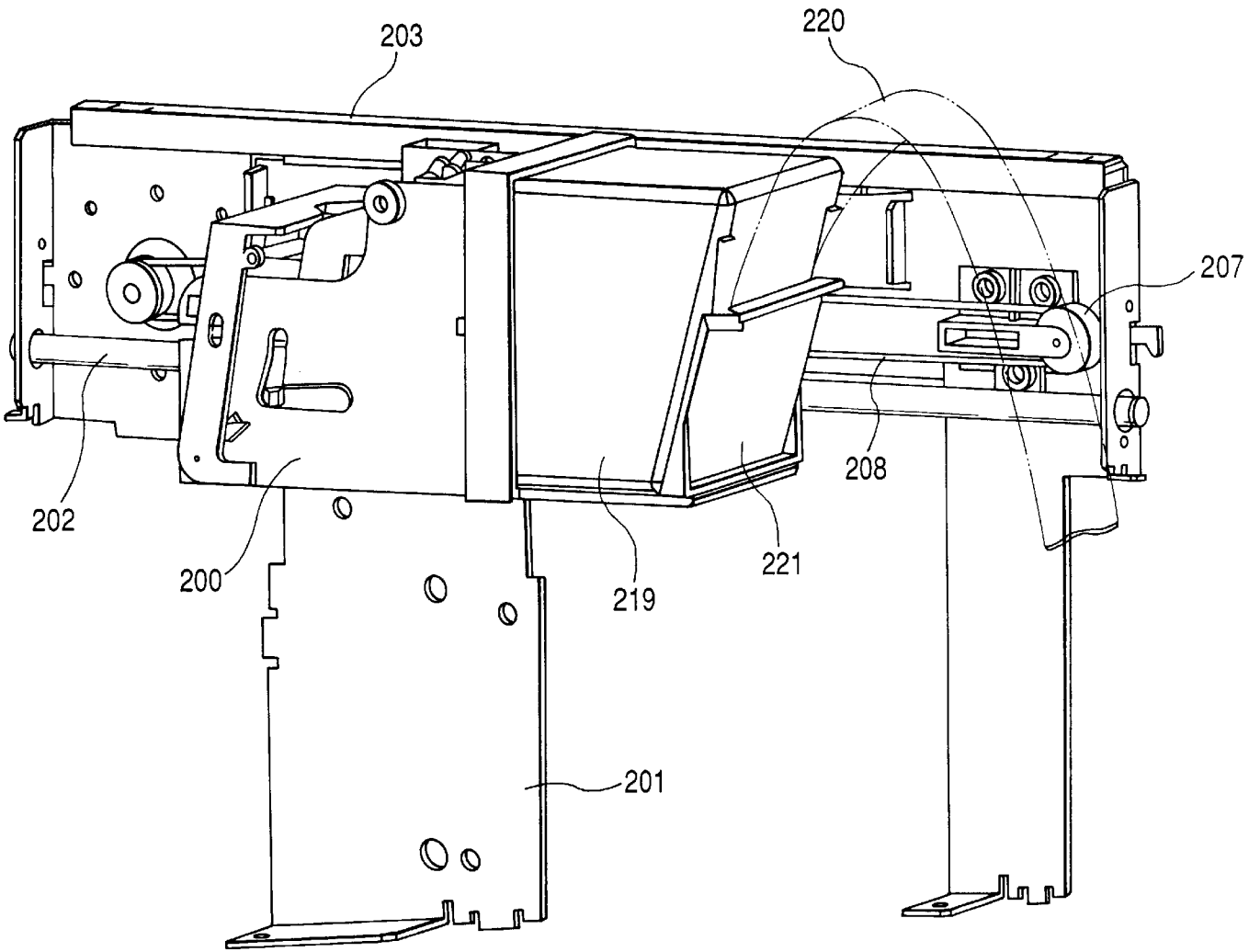
FIG. 7 is a perspective view of the carriage unit of FIG. 6, as seen from a different direction.

This printing apparatus contains a carriage 200 for removably holding a liquid jet head unit 401. As shown in FIGS. 6 and 7, the carriage 200 is supported by a CR shaft 202 and a guide rail 203 both fixed to a CR frame 201 at their both ends and arranged in parallel with each other in such a manner that it can slide in the direction perpendicular to the envelope or continuous paper conveying direction and parallel to the row of nozzles of a liquid jet head unit 401 mounted on the carriage 200. Further, the carriage 200 is supported in such a position that, while the liquid jet head unit 401 is mounted on it, the nozzle surface 401*a* of the liquid jet head unit 401 is substantially in parallel with the print surface of the printing medium (envelopes and continuous paper).

Figure 8:
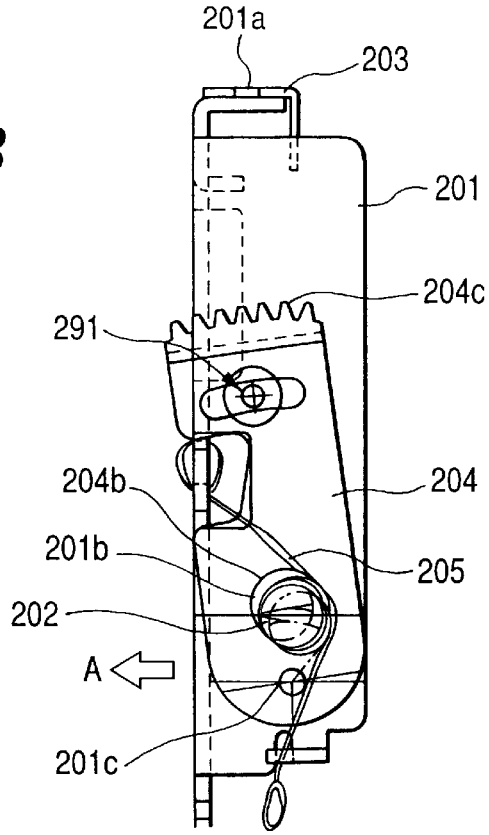
FIG. 8 is a front view of a CR frame, a CR gap plate and etc. in a connected state.

As shown in FIG. 8, the guide rail 203 is a thin sheet metal bent L-shaped which is fixed on the upper bent portion of the CR frame 201, positioned by the two embossed portions 201*a* of the CR frame 201 and two holes of the guide rail 203, and fixed with two screws.

Figure 9:
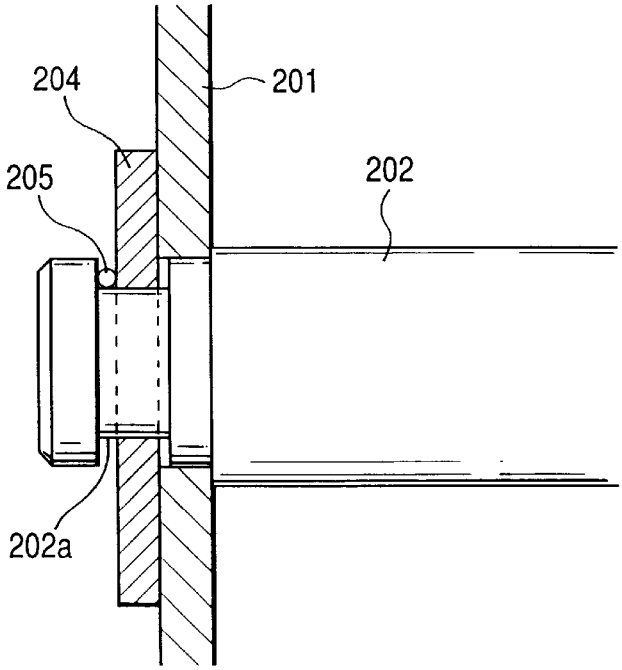
FIG. 9 is an enlarged side view showing a CR frame, a CR gap plate and etc. in a connected state.

The CR frame 201 has its front portion and rear portion bent and has a slotted hole 201*b* cut therein for fixing the CR shaft 202. In addition, as shown in FIGS. 8 and 9, it has CR gap plates 204 attached in its front and back which are made up of sheet metal and used for adjusting the vertical position of the CR shaft 202 (paper spacing). Each of the CR gap plates 204 has a hole fitting on the embossed portion 201*c* provided on the CR frame 201 and can rotate on the fitting portion. The upper portion of each CR gap plate 204 is fixed to the CR frame 201 with the screw 291. In the vicinity of the middle of each CR gap plate 204 there is provided a slotted hole 204*b*, Since passing through the slotted hole 204*b* and the slotted hole 201*b* of the CR frame, the CR shaft 202 inserted into both of the slotted holes 204*b* and 201*b* moves up and down when the CR gap plate 204 is rotated. In the upper portion of the CR gap plate 204 there are provided teeth 204*c* of a gear. When these teeth 204*c* are meshed with the teeth of a jig not shown in the figures and the jig is operated, the CR gap plate 204 starts to rotate, and thereby the CR shaft 202 moves up and down. Such a configuration as described above enables the adjustment of the vertical position of the CR shaft 202 (paper spacing).

The front and rear portions of the CR frame 201 are raised and bent L-shaped, and on each of the portions hung is a bar-shaped CR shaft rock spring 205. The CR shaft 202 is located in the middle of the CR shaft rock spring 205 and constantly biased thereby in one direction (in the direction shown by an arrow A). Thus the CR shaft 202 is fixed to the CR frame 201 in a steady manner.

Further, as shown in FIG. 9, since a groove 202*a* is cut in one end portion of the CR shaft 202 and the CR shaft rock spring 205 is fitted into the groove 202*a*, CR shaft 202 will not come off in the thrust direction (in the axial direction).

As shown in FIGS. 6 and 7, a carriage 200 is bonded to part of a CR belt 208 with which a CR drive pulley 206*a* rotationally driven by a CR motor 206 fixed to the CR frame 201 and a rotatable idler pulley 207 fixed to the CR frame 201 with two screws in such a manner as to be slidable in the direction parallel to the CR shaft 202 are belted. Thus, once the CR motor 206 is driven, the CR belt 208 is rotated, which allows the carriage 200 to move back and forth in the direction along the CR shaft 202 and the guide rail 203.

As described later in the section of recovery system unit, the CR frame 201 has a recovery system unit 300 attached thereto, and they are constructed in such a manner that variation in distance between the liquid jet head unit 401 mounted on the carriage 200 and the recovery system unit 300 becomes as small as possible.

(Carriage Stop Position)

Figure 10:
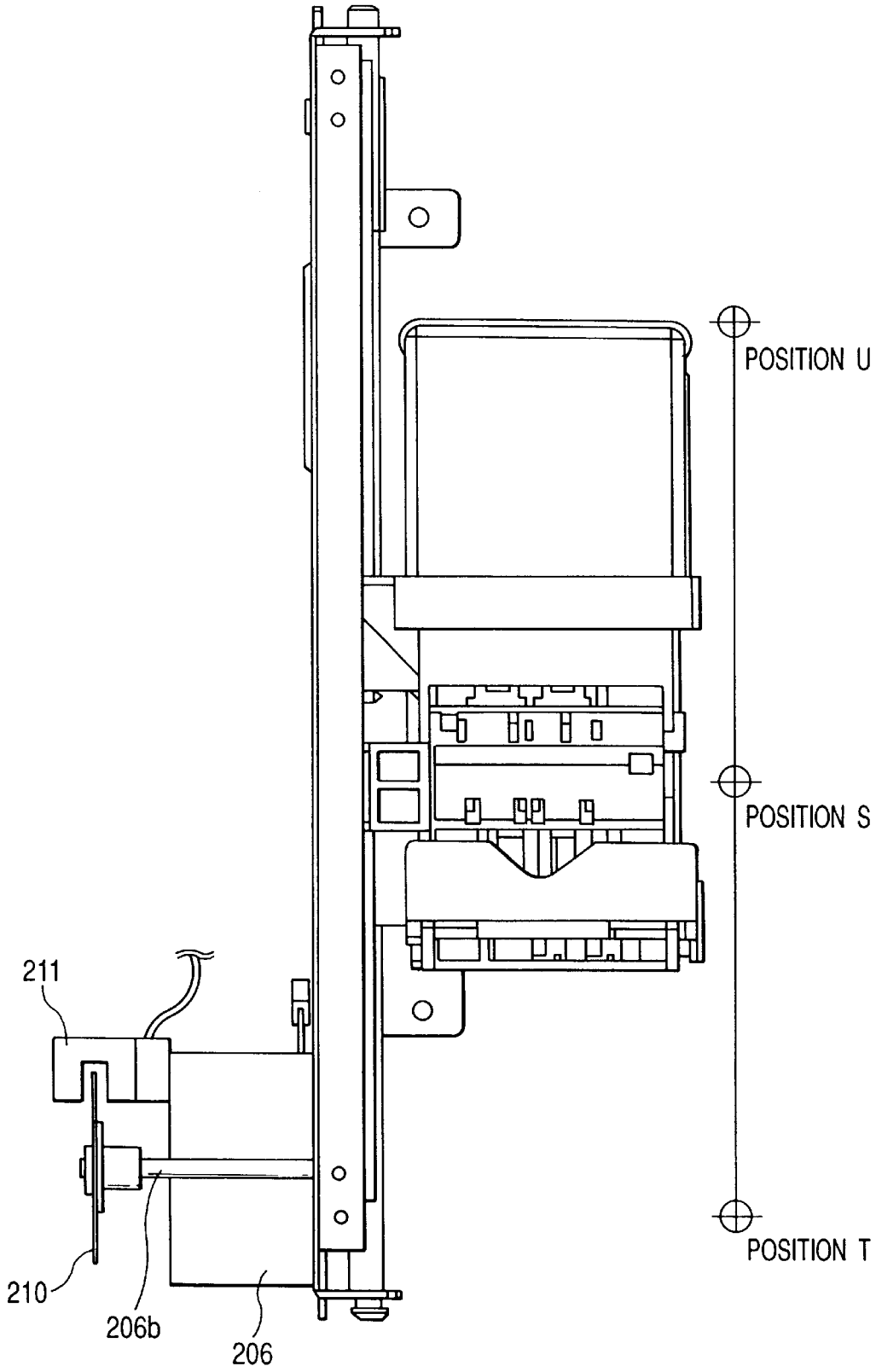
FIG. 10 is a plan view showing a movable range of a carriage.

This printing apparatus has three carriage 200 stop positions provided, as shown in FIG. 10. And it has a home position S provided nearly in the middle thereof where a cap of the recovery system unit, as described later, moves up and down so as to cover the nozzle portion of the liquid jet head unit 401 mounted on the carriage 200. There are provided print positions in the front and the back with respect to the home position S: the front side print position is an envelope print position T, and the backside one is a continuous paper print position U.

(Carriage Control)

There is provided a home position sensor of photonic sensor type (hereinafter referred to as HP sensor), not shown in the figures, on the CR frame 201. This HP sensor is provided in the home position S, and it can detect a shield plate 200*a* provided on the carriage 200 (refer to FIGS. 11 and 13) passing to find the position of the carriage.

As shown in FIG. 10, a shaft 206*b* extends to the opposite side from the CR drive pulley 206*a* of the CR motor 206, and a disk-shaped encoder slit 210 is attached thereto. This encoder slit 210 rotates synchronously with the operation of the CR motor 206. The encoder slit 210 has the same number of slits as the number of steps of the CR motor 206 per rotation cut therein. In this embodiment, the number of steps of the CR motor 206 per rotation is 200, accordingly, the encoder slit 210 has 200 slits cut therein. And there is attached a photonic sensor 211 to the CR motor 206 in such a manner that the photonic sensor holds the encoder slit 210 therein. Since the encoder slit 210 rotates with the operation of the CR motor 206, the rotational momentum of the CR motor 206 in the signal form is sent to the substrate from the photonic sensor 211. Since one slit of the encoder slit 210 corresponds to one step of the CR motor 206, as described above, when the CR motor 206 performs one step of rotation (in this case, the CR motor completes one round of rotation with 200 steps, one step means a 1.8-degree angle), the photonic sensor 211 detects one slit passing its position and sends a signal to the substrate. In other words, the rotation of the CR motor 206, namely, the moving distance of the carriage 200 can be obtained accurately and fed back by knowing the number of slits passing the sensing position of the photonic sensor 211.

Figure 14:
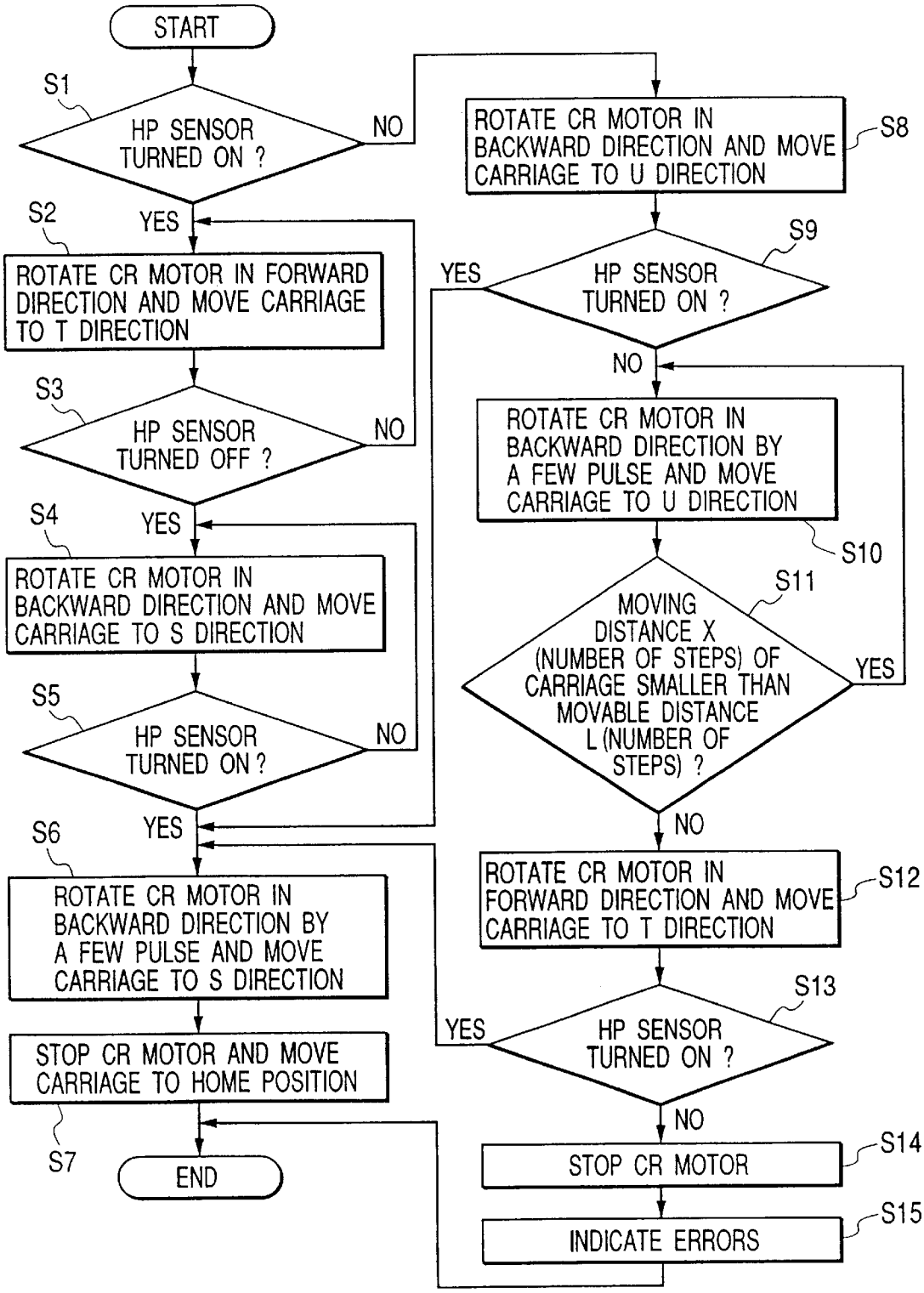
FIG. 14 is a flow chart showing a moving operation of a carriage.

Now the moving operation of the carriage 200 will be described in detail with reference to the flow chart of FIG. 14. As described above, the CR motor 206 is controlled by the combination of the HP sensor, the encoder slit 210 and the photonic sensor 211.

When the HP sensor located in the home position S detects the carriage 200 (ON state) in the initial state (step S1), the CR motor 206 is allowed to rotate in the forward direction, so as to move the carriage 200 toward the envelop print position T (step S2). At the time when the HP sensor does not detect the carriage 200 (OFF state) (step S3), the CR motor 206 is allowed to rotate in the backward direction, so as to move the carriage 200 toward the home position S (step S4). When the HP sensor is again in the ON state (step S5), in other words, the carriage 200 moves to the position where the edge portion of the shield plate 200*a* of the carriage 200 shields the HP sensor, a prescribed number of drive pulses are given to the CR motor 206 (step S6), so as to locate the carriage 200 in the home position S, and the CR motor 206 is stopped (step S7). The initial operation of the carriage 200 is completed at this point. In this case, the number of pulses supplied to the CR motor 206 in step S6 is determined based on the distance between the edge portion of the shield plate 200*a* and the middle portion of the carriage 200 and the relative position between the HP sensor and the home position S.

On the other hand, when the HP sensor does not detect the carriage 200 (OFF state) in the initial state (step S1), the CR motor 206 is allowed to rotate in the backward direction, so as to move the carriage 200 (step S8). At the time when the HP sensor detects the carriage 200 (ON state) (step S9), the steps S6 to S7 described above are carried out.

In cases where, even though the carriage 200 is moved in step S8, the HP sensor does not detect the carriage 200 (step S9), and the moving operation of the carriage 200 is continued (step S10) and pulses are supplied to the CR motor 206 in such an amount that the moving distance X of the carriage 200 is judged to be equal to or longer than the movable distance L of the carriage 200 (step S11), the CR motor 206 is allowed to rotate in the forward direction (step S12). Then, when the HP sensor detects the carriage 200 (step S13), the steps S6 to S7 described above are carried out. In this case, when the HP sensor does not detect the carriage 200 in step S13, the CR motor 206 is stopped (step S14) and an error indication is caused (step S15).

Then the moving operation of the carriage 200 from the home position S to the print positions (the envelope print position T and the continuous paper print position U) will be described.

First, the CR motor 206 is driven so as to move the carriage 200 from the home position S toward the intended print position, and the number of pulses supplied to the CR motor 206 starts to be counted at the time when the shield plate 200*a* of the carriage 200 does not shield the HP sensor (when the HP sensor is in the OFF state and does not detect the carriage 200) with the encoder slit 210 and the photonic sensor 211. When the prescribed number (corresponding to the distance to the envelop print position or the continuous paper position) of pulses has been counted up, the CR motor 206 is stopped. This control allows the carriage 200 to reach the intended print position without fail.

If the CR motor 206 be out of step, or if the carriage 200 be caught somewhere on the way and not move, the counted number becomes smaller than the prescribed one, a warning message of error is issued to the users.

In cases where the carriage 200 is to be moved from the print position (the envelope print position T or the tape print position U) to the home position S, first the CR motor 206 is driven in such a manner as to move the carriage 200 toward the home position S, then, when the carriage 200 reaches the position where the edge of the shield plate 200*a* of the carriage 200 shields the HP sensor, the CR motor 206 is supplied with just the prescribed number of pulses and further driven, finally when the carriage 200 is located in the home position S, the CR motor is stopped.

(Carriage Configuration: Bearing Portion)

Figure 11:
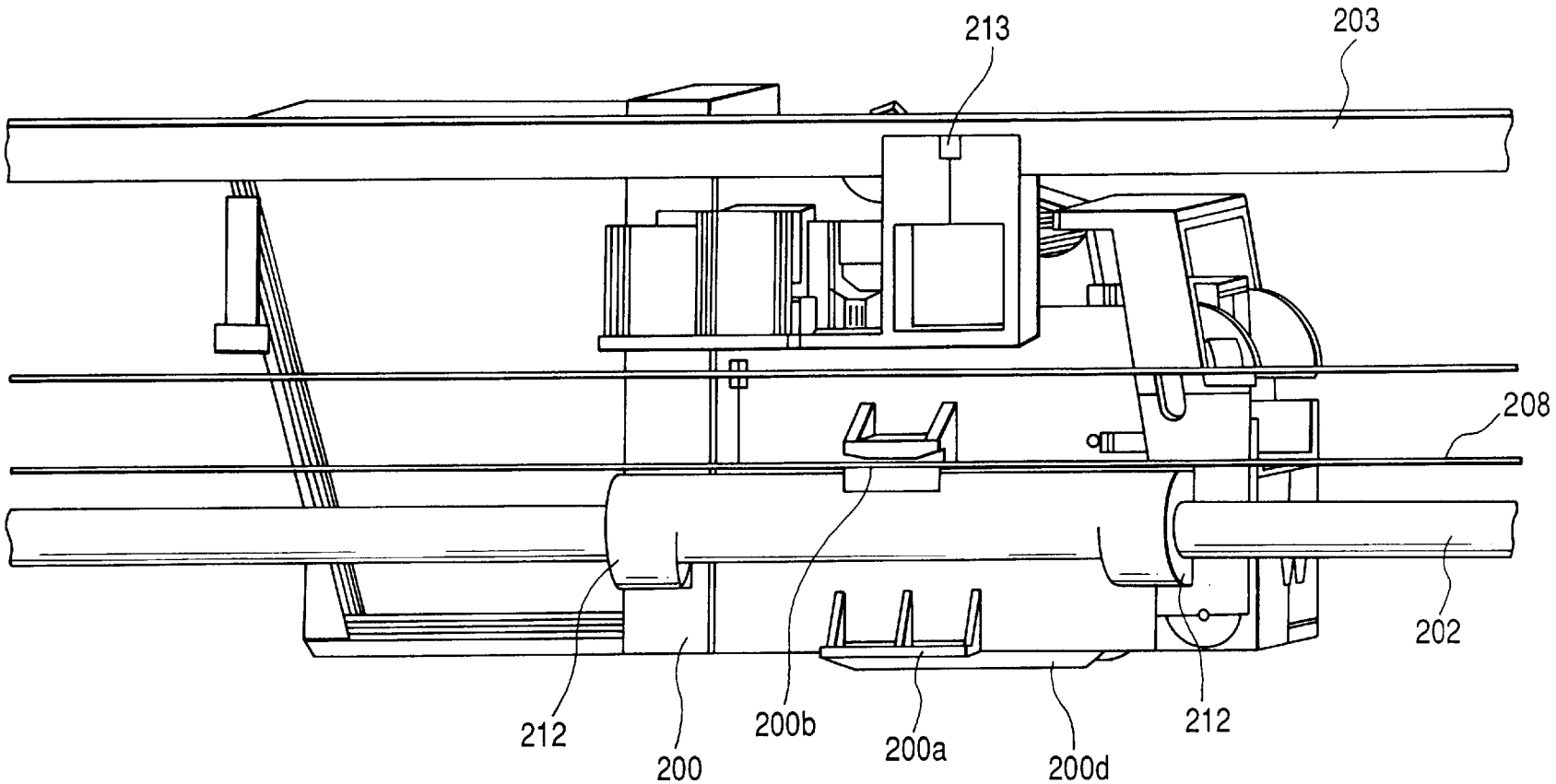
FIG. 11 is a side view showing a moving mechanism of a carriage.

The carriage 200 is provided with two CR bearings 212 into which the CR shaft 202 is fitted, since it slides along the direction perpendicular to the envelope-and continuous-paper-conveying direction and parallel to the row of nozzles of the liquid jet head unit 401 mounted on the carriage 200, as shown FIG. 11. The CR bearings 202 are fixed in the front and rear portions of the left side of the carriage 200.

The CR bearings 212 are made up of the material requiring no grease, which prevents paper dust and ink mist from sticking to the CR shaft 202 and CR bearings 212. On the upper portion of the middle of the two CR bearings 212, a CR slider 213 superior in sliding property is fixed in such a manner as to hold the guide rail 203 therein.

Thus, the carriage 200 is supported with three supports: two CR bearings 212 located on the lower portion of the carriage and one CR slider 213 located on the upper portion of the same.

(Carriage Configuration: HP Sensor Shielding Plate)

Figure 13:
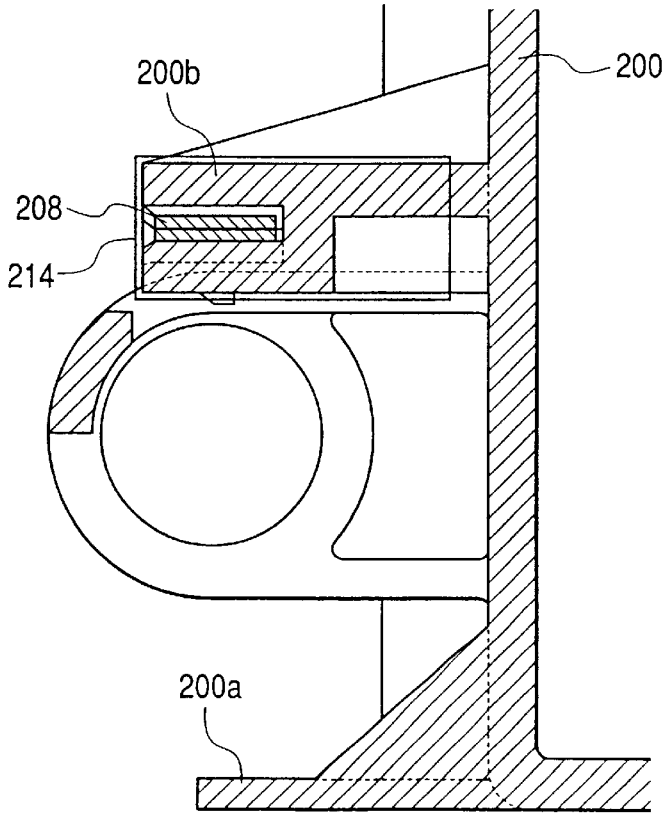
FIG. 13 is an enlarged front view showing a carriage and a CR belt in a fixed state.

A HP sensor shield plate 200*a* is attached nearly in the middle of the left side of the carriage 200 on the lower portion of the nearly middle position of the two portions for fixing the CR bearings 212, as shown in FIGS. 11 and 13.

(Carriage Configuration: CR Belt Fixing Portion)

Figure 12:
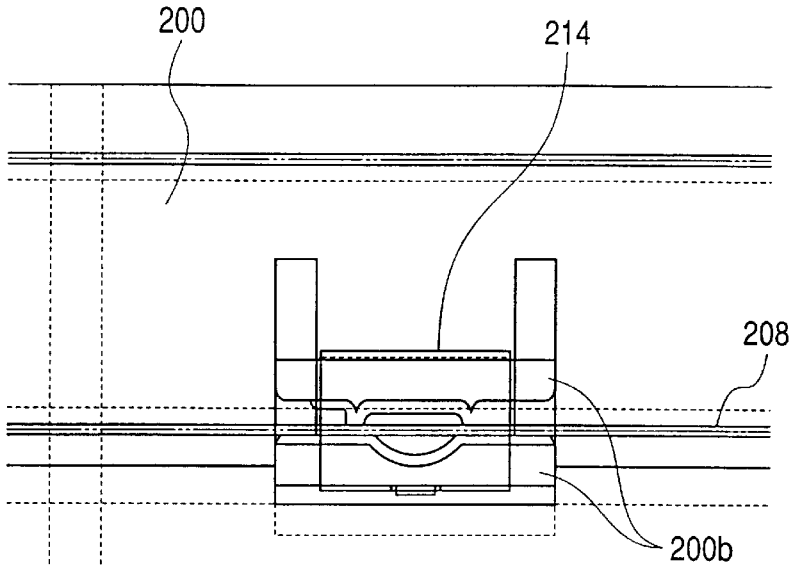
FIG. 12 is an enlarged side view showing a carriage and a CR belt in a fixed state.

A portion 200*b* for fixing the CR belt 208 is provided nearly in the middle of the left side of the carriage 200 on the upper portion of the nearly middle position of the two portions for fixing the CR bearings 212, as shown in FIGS. 12 and 13. The CR belt fixing portion 200*b* is constructed in such a manner as to hold the CR belt 208 in it. Since the space made for the CR belt 208 is a little narrow compared with the thickness of the belt, the belt is press fitted in it, which allows the belt to be fixed to the carriage 200 in a steady manner. Due to the CR belt 208 fixed in such a steady manner, the carriage 200 is allowed to move by driving the CR motor 206.

Further a CR belt stopper 214, as a stopper for preventing the CR belt 208 from coming off, made of sheet metal in the form of square whose one side is open is attached on the CR belt fixing portion 200*b* of the carriage 200. The CR belt stopper 214 is fixed to the carriage 200 by fitting the projected portion of the carriage 200 in the recessed portion of the CR belt stopper.

(Carriage Configuration: Substrate Holding Portion)

Figure 15:
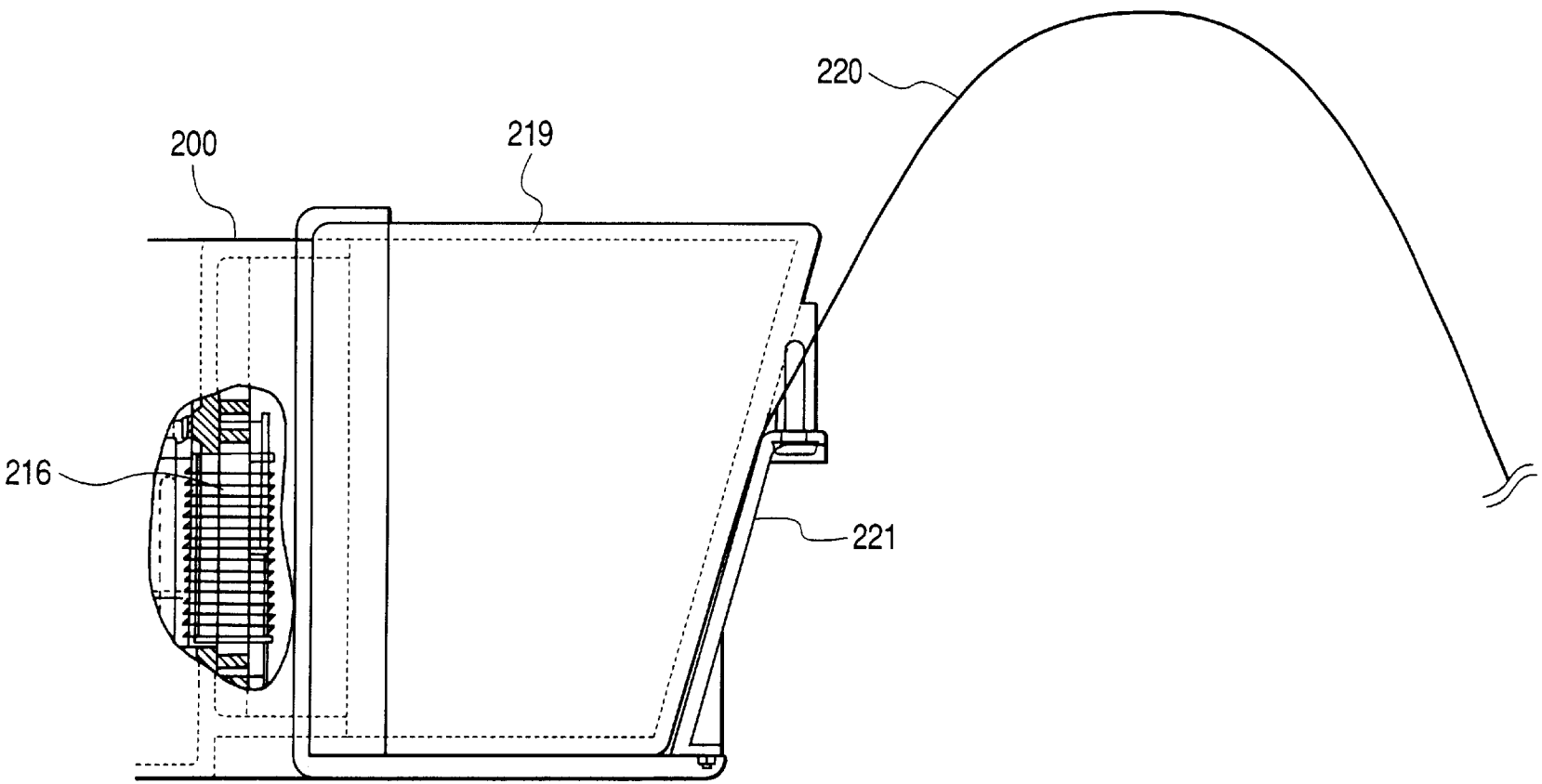
FIG. 15 is a front view showing a carriage, a CR connector and etc. in a connected state.
Figure 16:
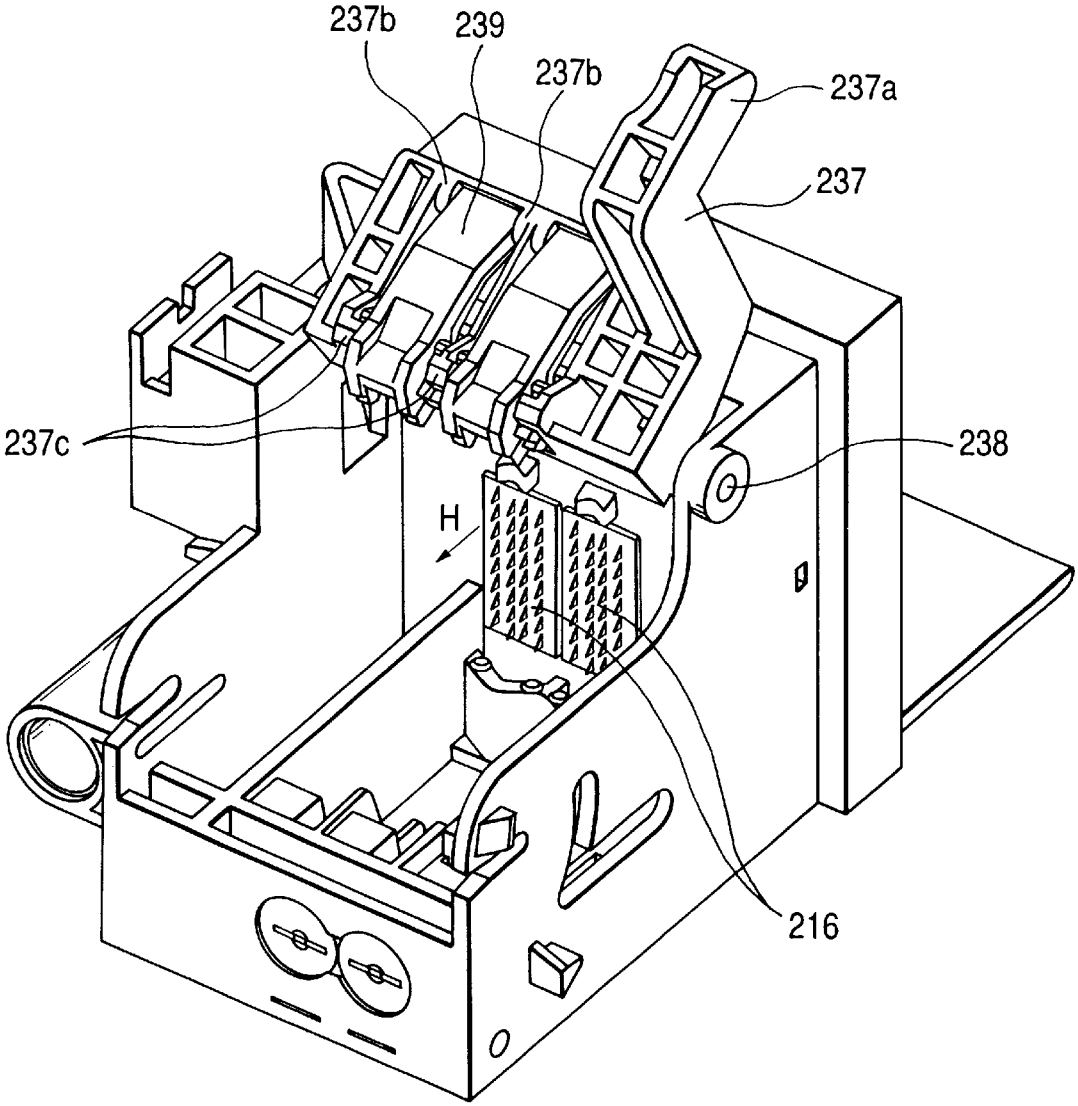
FIG. 16 is a perspective view of a carriage with no liquid jet head unit installed therein.

The carriage 200 has substrates, such as CR printed wiring board containing two CR connectors 216 for exchanging signals with the liquid jet head unit 401, mounted thereon, as shown in FIGS. 15 and 16.

In the inner portion of the carriage 200 (the portion behind the space where the liquid jet head unit 401 is mounted), the CR connectors 216 are fixed vertically in such a manner as to be opposite to one side of the liquid jet head unit 401. And the substrates are covered with a CR printed wiring board cover 219, as shown in FIG. 7.

To these substrates connected is a flexible cable (hereinafter referred as "FPC") 220 through which electrical signals and power supply are transmitted from a control substrate (not shown in the figures) outside the carriage 200. The FPC 220 is connected in such a manner as to extend outside of the carriage 200 through the clearance between the carriage 200 and the CR printed wiring board cover 219 and is fixed with a FPC stopper 221 attached to the carriage 200 and the CR printed wiring board cover 219 in state where it is sandwiched therebetween. Thus the FPC 220 will not come off even when force is applied outside.

The FPC 220 is connected to the control substrate of the printing machine body. Meanwhile, when the carriage 200 moves, the spacing between the carriage 200 and the control substrate of the printing machine body is varied. Thus, the FPC 220 is provided with adequate length and slackness, and due to the slackness, the FPC 220 is not excessively stressed regardless of the position of the carriage 200.

(Carriage Configuration: Recovery System Unit Related Portion)

Figure 17:
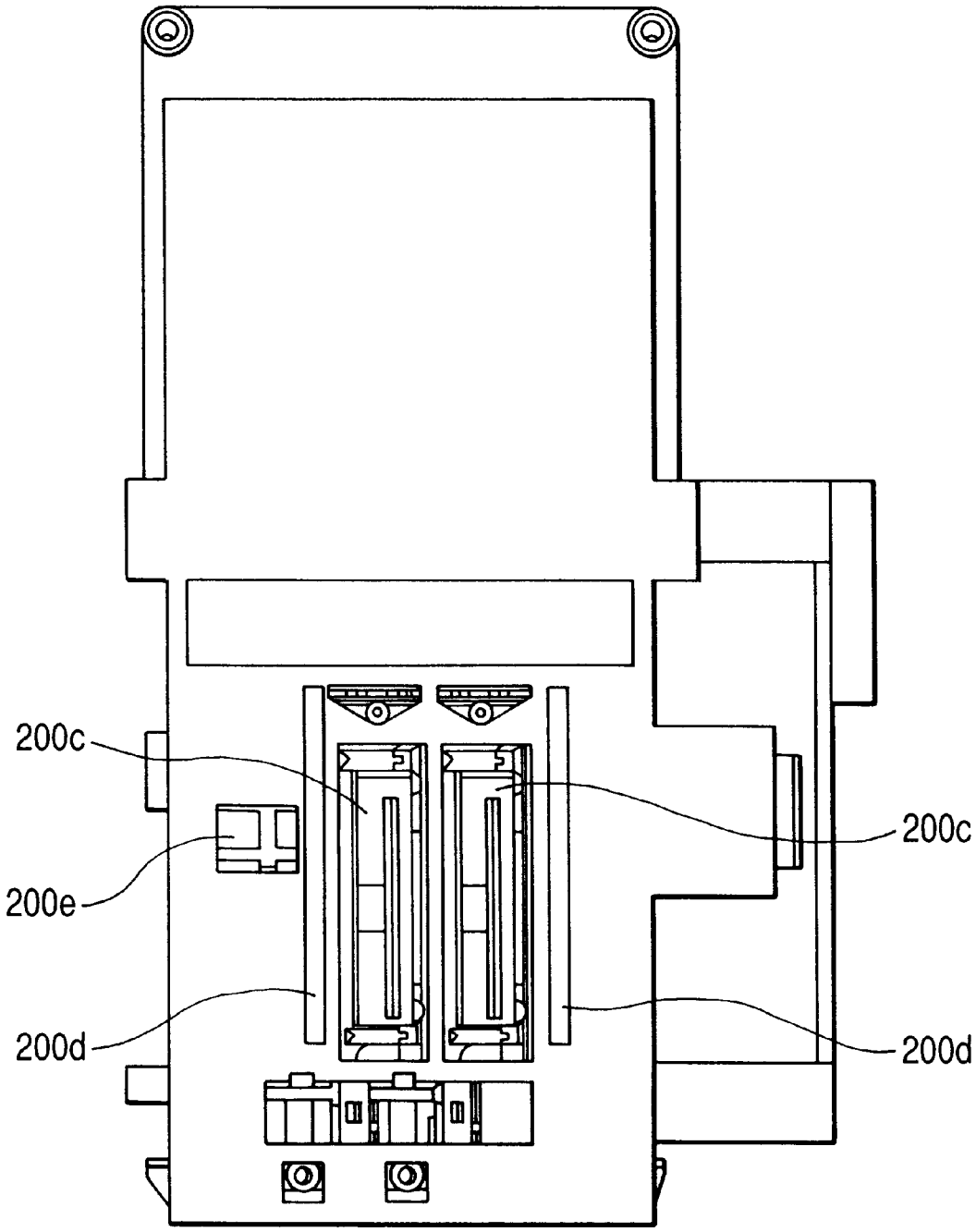
FIG. 17 is a bottom view of a carriage.
Figure 18:
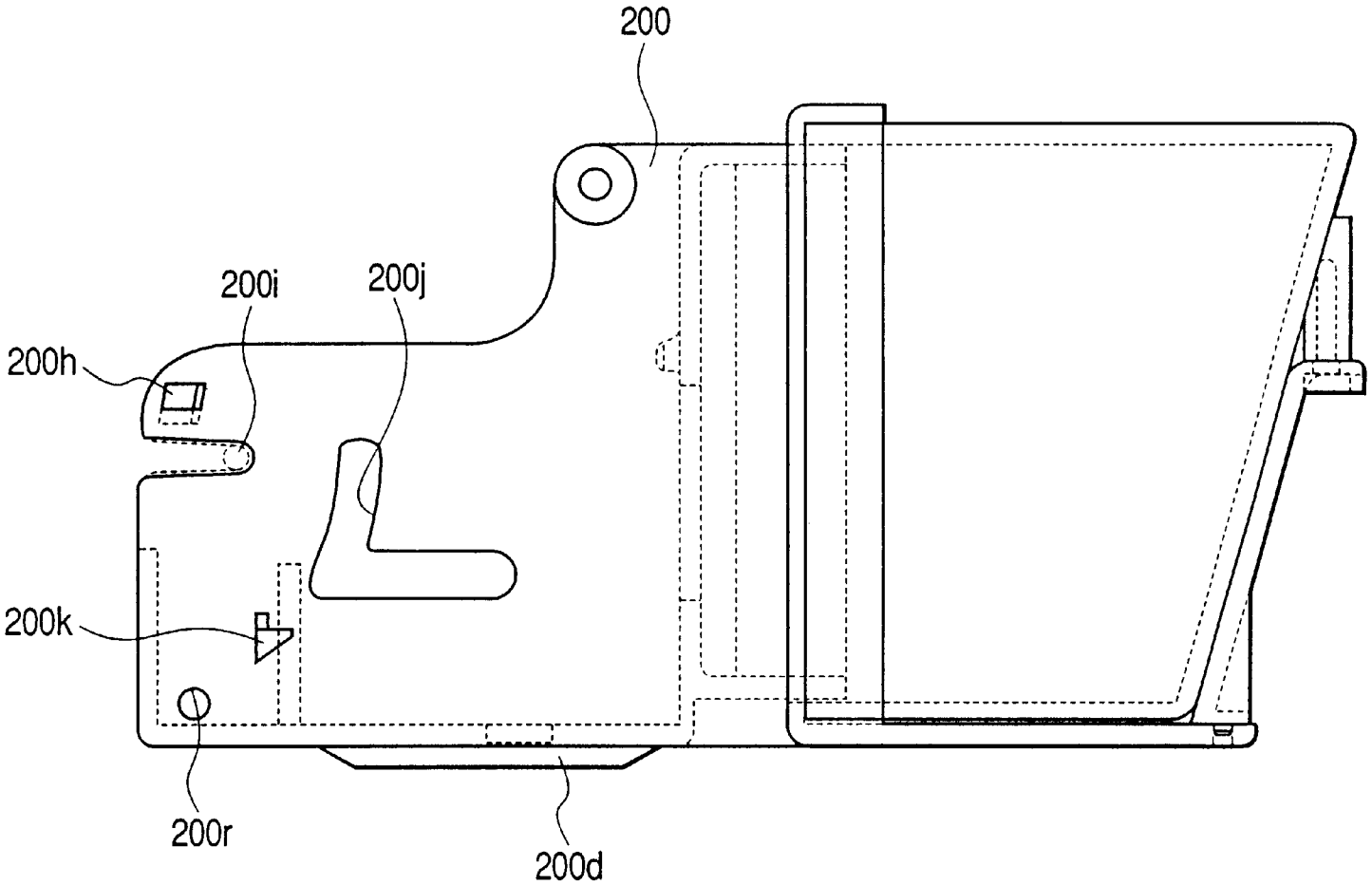
FIG. 18 is a front view of a carriage.
Figure 19:
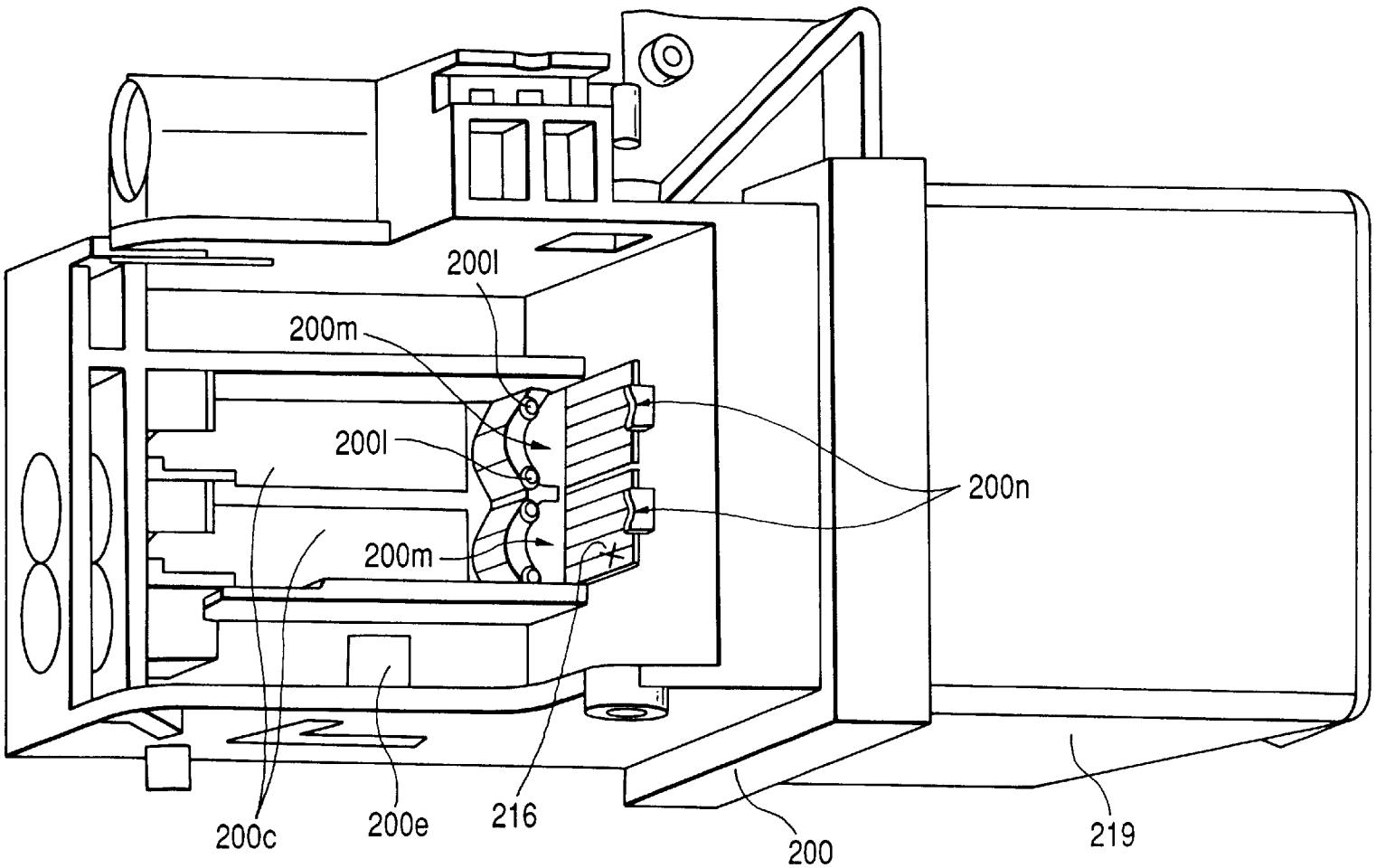
FIG. 19 is a perspective view of a carriage, as seen from above.

As shown in FIGS. 17, 18 and 19 which are a bottom view, a side view and a perspective view of the carriage 200, respectively, there are provided two hole portions 200*c*, for exposing the nozzles of the liquid jet head unit 401, on the bottom portion of the carriage 200 and CR blade ribs 200*d* parallel to the carriage 200 moving direction on both the left and right sides with respective to the hole portions 200*c*. The action of the CR blade ribs 200*d* will be described separately in the section of the recovery system unit 300.

There is provided a four-sided hole 200*e* on the right bottom portion of the liquid jet head unit 401 mounting portion of the carriage 200. Into the hole 200*e* inserted is a carriage rock arm 390 of the recovery unit 300 which prevents the carriage 200 from moving, due to the vibration of the entire printing machine, when the nozzles of the liquid jet head unit 401 are covered with a cap 308 of the recovery system unit 300. The detailed configuration will be described separately in the section of the recovery system unit 300.

(Carriage Configuration: Ink Supplying Portion)

Figure 20:
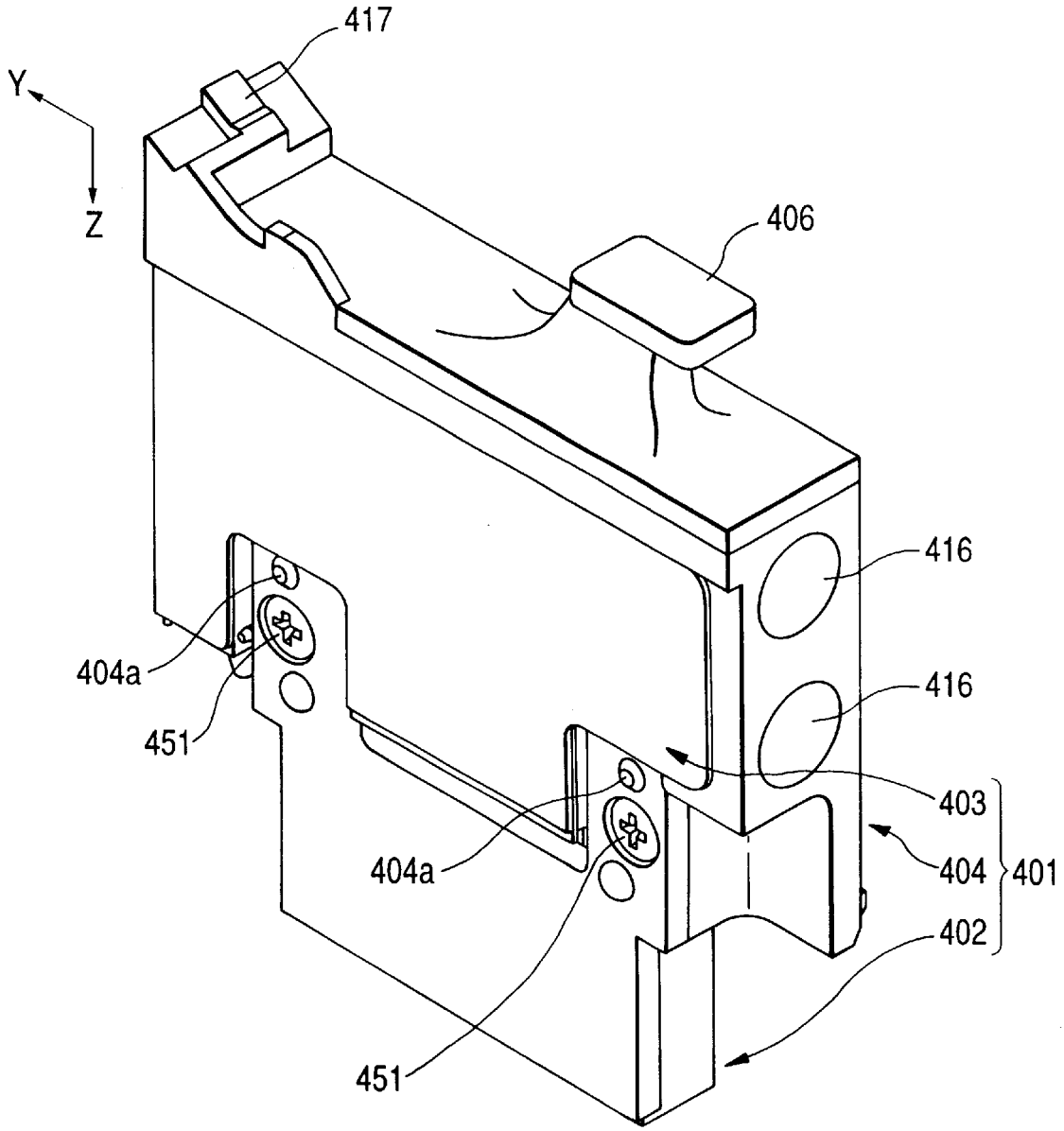
FIG. 20 is a perspective view of a liquid jet head unit.

As shown in FIG. 20, there are provided two joint rubbers 416 on the front side surface of the liquid jet head unit 401. When the point of each CR needle 222 (refer to FIG. 21) is inserted through the surface of each joint rubber 416 and passed through the inside of he tank of the liquid jet head unit 401, ink is supplied from the ink supplying system, which is on the upstream side of the CR needles 222 and connected to the CR needles 222 by the connecting means such as CR tube 226, to the inside of the tank of the liquid jet head unit 401.

There is provided a mechanism for supplying ink to the liquid jet head unit 401 on the front side of the liquid jet head unit 401 mounting portion of the carriage 200. Now the mechanism will be described below.

Figure 21:
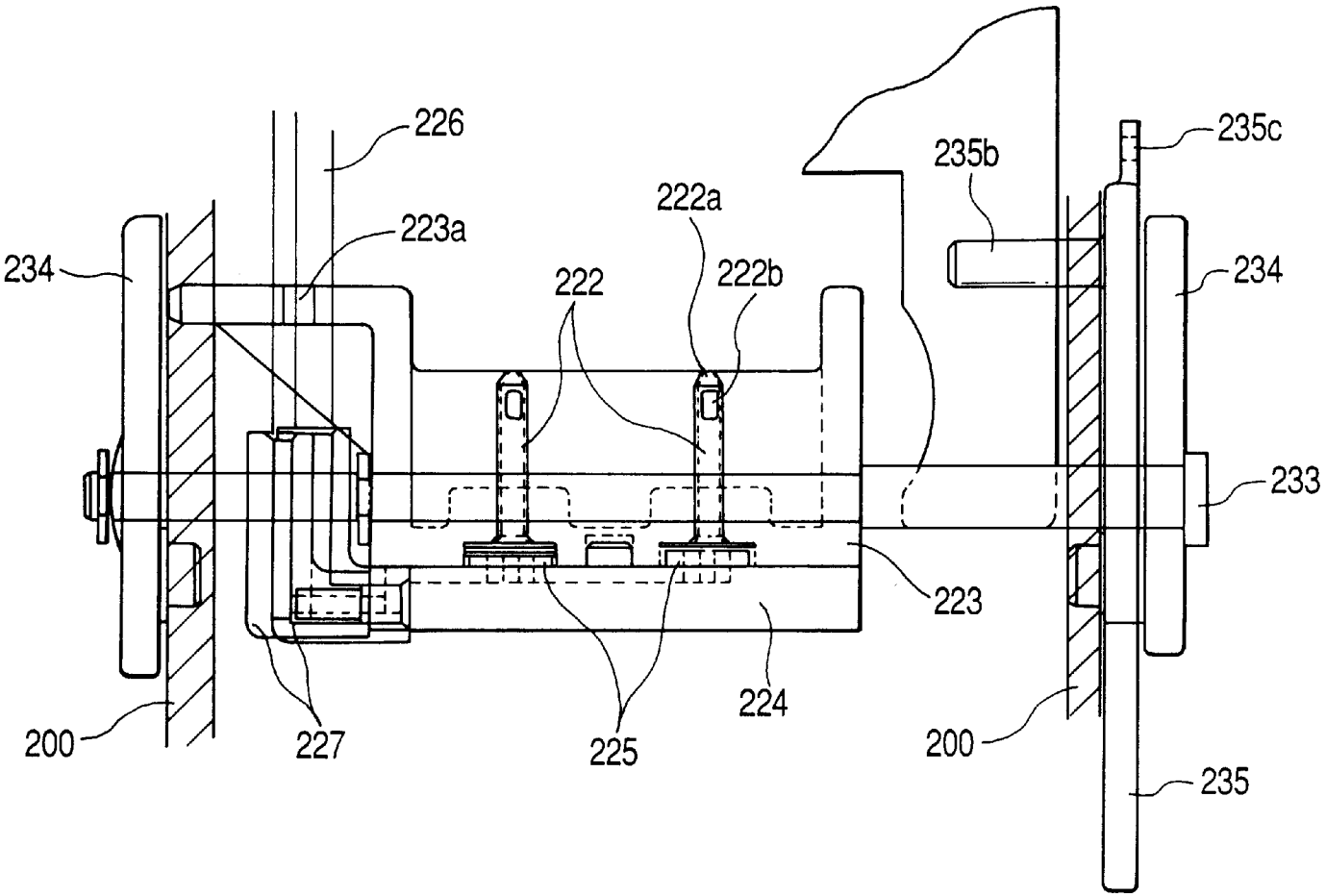
FIG. 21 is a front view of an attachment portion of CR needles.
Figure 22:
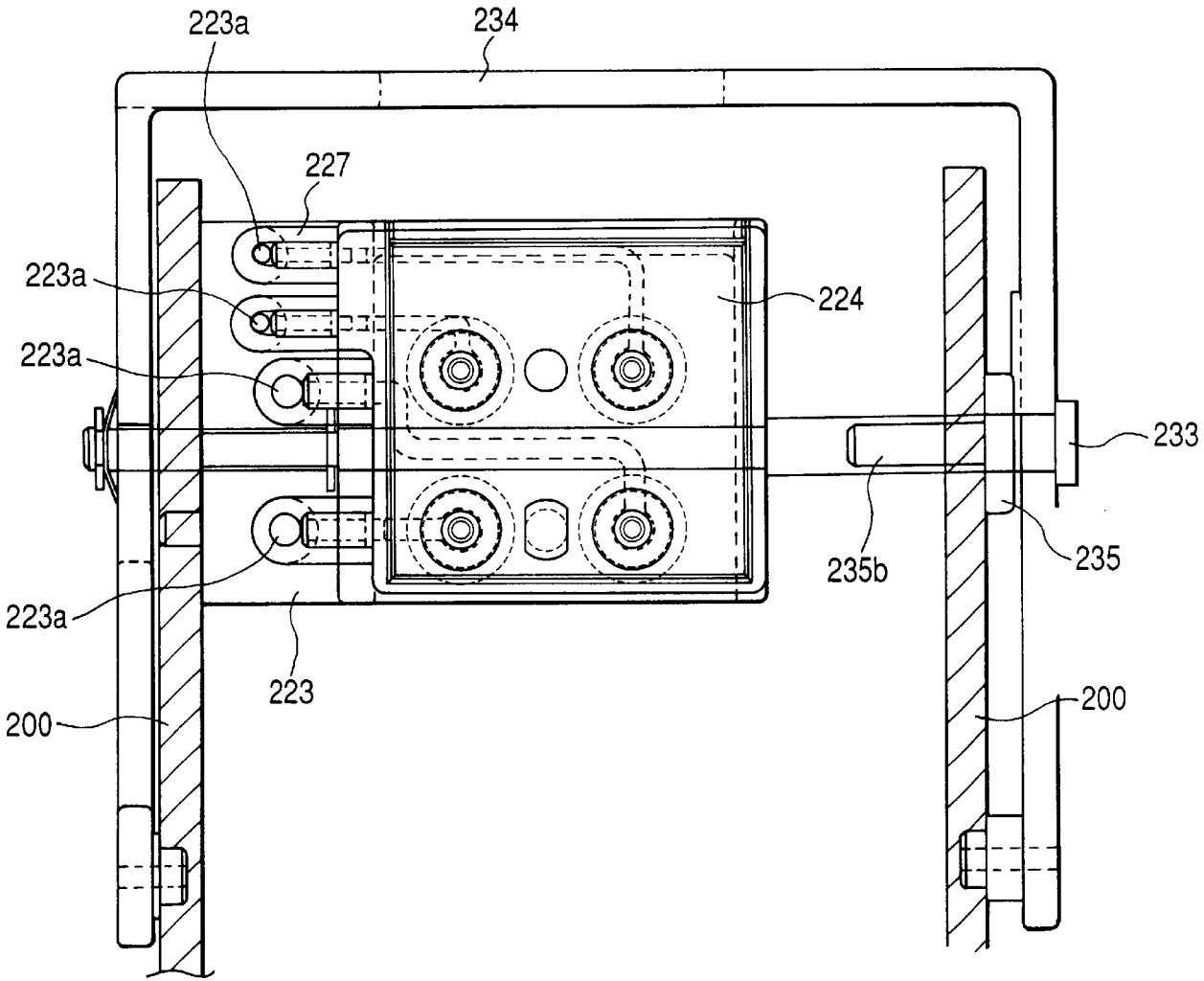
FIG. 22 is a plan view of an attachment portion of CR needles.

As shown in FIGS. 21 and 22, four CR needles 222, each of which is in the form of fine hollow pipe, are provided on the front side with respect to the liquid jet head unit 401 toward the front side of the same. The point of each CR needle 222 is a closed semi-spherical-shaped portion 222*a* in the vicinity of which there exists a four-sided hole 222*b* opened upwardly in the middle of the hollow portion of the pipe. Each CR needle 222 is fixed with a plastic CR joint support 223 and a CR tube joint 224. The CR joint support 223 and CR tube joint 224 are integrally formed by deposition and a thin CR needle seal 225 made up of a doughnut-shaped rubber is held in each root of the CR needles 222, so as to prevent ink from leaking. In the CR joint support 223 and CR tube joint 224, there are provided flow paths for each of the four CR needles 222 and the flow paths are in communication with four respective pipe-like portions provided on the CR tube joint 224.

Each of the four pipe-like portions provided on the CR tube joint 224 is covered with one end of a L-shaped pipe-like CR joint rubber 227, and into the other end of each CR joint rubber 227 inserted is a CR tube 226. In other words, each CR joint rubber 227 functions as a joint between the CR tube joint 224 and the CR tube 226.

The four CR tubes 226 pass through four respective holes 223*a* provided in the side plate of the CR joint support 223 in state where they are press fitted in the holes; thus, the CR tubes 226 are fixed in such a manner that they do not come off from the respective CR joint rubbers 227 even when the CR joint support 223, which will be described later, moves. Although not shown in the figures, the four CR tubes 226 are provided with slackness so that the CR joint support 223 can move.

Further, the four CR tubes 226 are passed though the hole portion of a CR tube rubber not shown in the figures, fixed together with the CR tube rubber between the carriage 200 and a CR tube stopper not shown in the figures, and extend to the outside of the carriage 200. Although not shown in the figures, the four CR tubes 226 constitute an integrally formed belt, and each of their tips is connected to a joint plug through a rubber CR joint. The joint plug is removably bonded to the CR joint and connected to the ink supplying system unit.

Each CR tube 226 is provided with slackness between the carriage 200 and the ink supplying system unit 10 so as to allow the carriage 200 to move. Due to the slackness, the CR tubes 226 are not excessively stressed regardless of the position of the carriage 200.

(Carriage Configuration: Ink Supplying Joint Portion)

A mechanism for inserting and pulling out the above described four CR needles 222 into and from the liquid jet head unit 401 will be described with reference to FIGS. 18 and 21 to 26. In these figures, however, the liquid jet head unit 401 is omitted.

As shown in FIGS. 21 and 22, there is fixed a CR joint shaft 233 to the integrally formed CR needles 222, CR joint support 223 and CR tube joint 224. And as shown in FIGS. 18 and 23 to 26, there is provided a slotted hole 234*a* in a CR joint lever 234 rotating on a hole 200*r* provided on the left and right side surfaces of the carriage 200 in the middle portion thereof, and into the slotted hole 234*a* inserted is a CR joint shaft 233 which is fixed in such a manner as not to come off. Accordingly, when rotating the CR joint lever 234, sequentially the CR joint shaft 233 moves back and forth (between the front side and the back side), and sequentially the CR needles 222, CR joint support 223 and CR tube joint 224 move back and forth (between the front side and the back side).

Thus, when putting the CR joint lever 234 down toward the backside (in the direction shown by the arrow E of FIG. 25), the CR needles 222 are inserted into the two joint rubbers 416 provided on the front side surface of the liquid jet head unit 401. Further, since the CR joint lever 234 climbs over the projecting portion 200*h* of the carriage 200 on the way of its rotation, when putting the CR joint lever 234 down completely toward the backside, it is fixed and cannot be moved. In such conditions, the carriage 200 is located in a steady manner since the CR joint shaft 233 is fitted into the groove portion 200*i* (refer to FIG. 18) provided on both the left and right side surfaces of the carriage 200.

When putting the CR joint lever 234 down toward the front side (in the direction shown by the arrow C of FIG. 24, refer to FIG. 18), the CR needles 222 are pulled out from the joint rubbers 416 provided on the front side surface of the liquid jet head unit 401. At this time, since a L-shaped portion 234*c* provided at the lower end portion of the CR joint lever 234 bumps against a rib 200*k* of the carriage 200 (refer to FIG. 18), the CR joint lever 234 stops rotating at this position.

Figure 23:
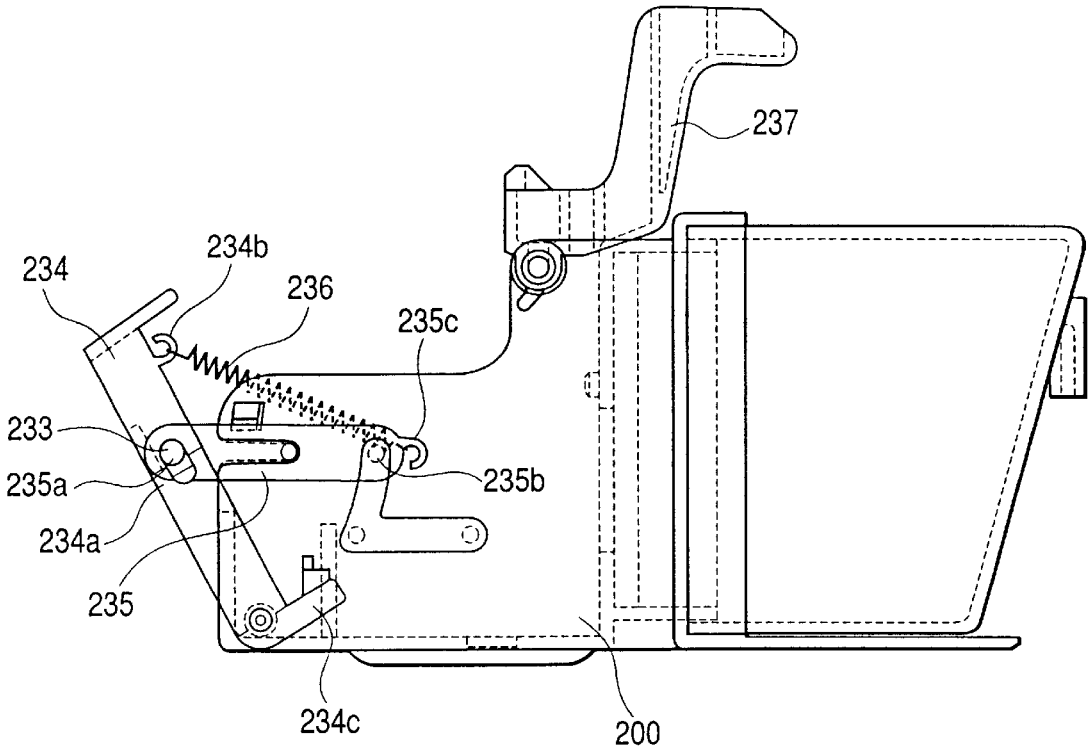
FIG. 23 is a side view showing a procedure of installing a liquid jet head unit in a carriage.

Then a CR joint lever stopper 235 will be described below. As shown in FIG. 23, there is provided in one end portion of the CR joint lever stopper 235 a hole 235*a* into which the CR joint shaft 233 is inserted, and the CR joint lever stopper 235 has a sequential motion with the CR joint lever 234. On the other end portion of the CR joint lever stopper 235 provided is a shaft 235*b* which is inserted into the carriage 200 through a L-shaped slotted hole 200*j* provided on the right side of the carriage 200 and is movable along the slotted hole 200*j*. On this end portion there is also provided a hook portion 235*c* for hanging a spring, and a CR joint lever spring 236 which is an extension spring is hung between the hook portion 235*c* and another hook portion 234*b* for hanging a spring provided on the CR joint lever 234.

Next, a mechanism to prevent misoperation of the sequence of a CR lever 237, which holds and fixes a liquid jetting head unit 401 mounted on a carriage 200, and a CR joint lever 234, which moves a CR needle 222 to supply ink to the liquid jetting head unit 401 mounted on the carriage 200, in mounting and demounting the liquid jetting head unit 401 on and from the carriage 200 respectively, will be described below.

FIG. 23 shows a status in which the liquid jetting head unit 401 has not been mounted, the CR lever 237 is positioned upward, and the CR joint lever 234 is positioned frontward. In this status, a CR joint lever stopper 235 is lifted up by a CR joint lever spring 236 and a shaft 235*b* collides against an top edge of an L-shaped long hole 200*j* of the carriage, and the CR joint lever 234 does not move. Thus, in the status in which the liquid jetting head unit 401 has not been mounted, the CR needle 222 cannot be moved to a mounting unit of the liquid jetting head unit 401.

Figure 24:
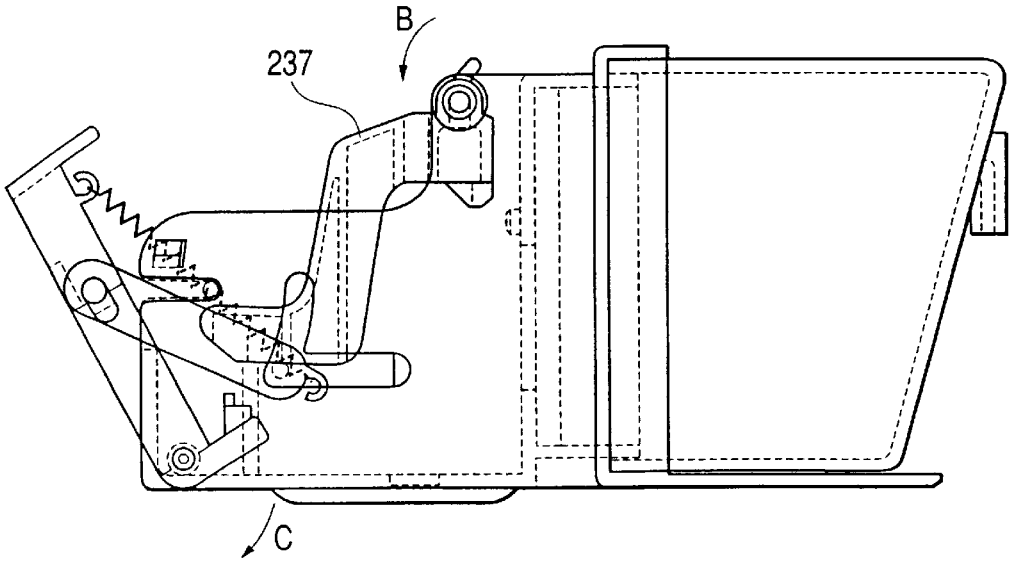
FIG. 24 is a side view showing a procedure of installing a liquid jet head unit in a carriage.
Figure 25:
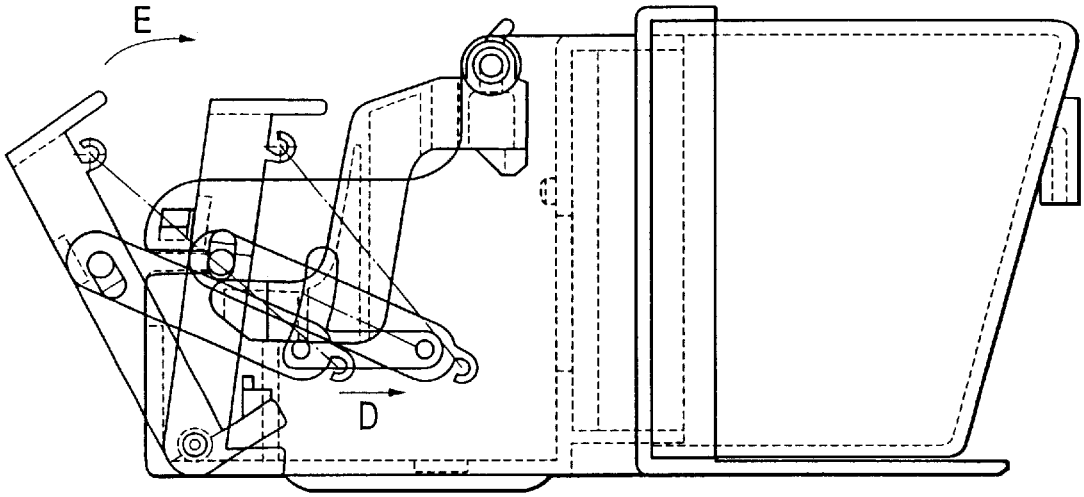
FIG. 25 is a side view showing a procedure of installing a liquid jet head unit in a carriage.

As shown in FIG. 24, when the liquid jetting head unit 401 is installed by a rotative motion of the CR lever 237 in a direction of an arrow B, the shaft 235*b* of the CR joint lever stopper 235 abuts on the CR lever 237 to be pressed down in the direction of the arrow C along with the L-shaped long hole 200*j* of the carriage 200 opposing a force of the CR joint lever spring 236. Here, the shaft 235*b* of the CR joint lever stopper 235 is in a bottom part of the L-shaped long hole 200*j* of the carriage 200. Hence, as shown in FIG. 25, the shaft 235*b* of the CR joint lever stopper 235 can move in the direction of the arrow D along with a linear part of the L-shaped long hole 200*j* of the carriage 200. Therefore, the CR joint lever can be fallen backward (in the direction of the arrow E) to allow the CR needle 222 to be inserted into the liquid jetting head unit 401.

Figure 26:
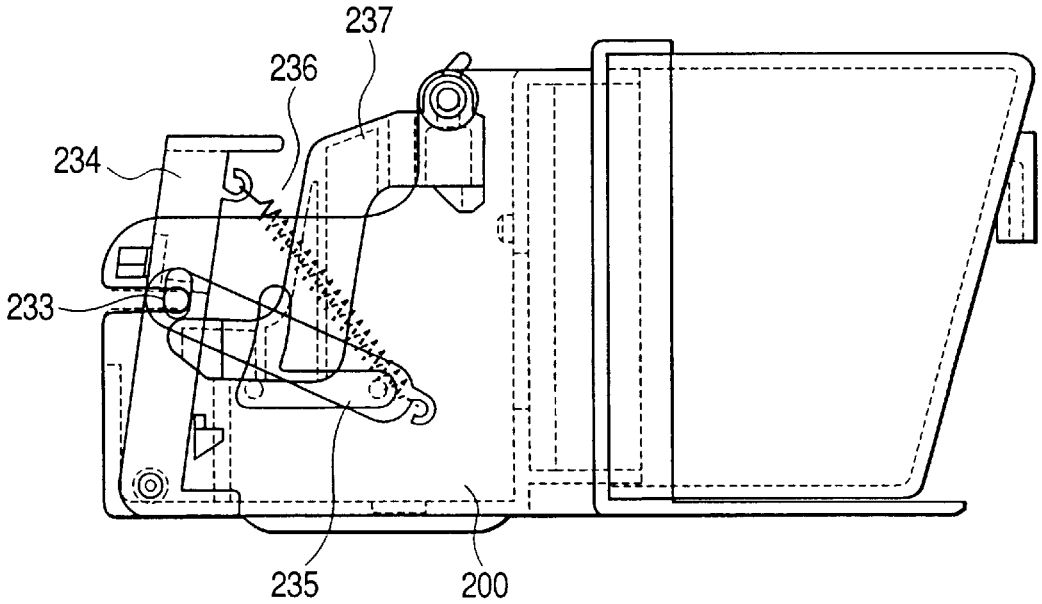
FIG. 26 is a side view showing a procedure of installing a liquid jet head unit in a carriage.

In addition, as shown in FIG. 26, in the status in which the liquid jetting head unit 401 has been inserted to fix, the CR joint lever 234 has been pushed backward, a CR joint shaft 233 is on a lever part 237*a* of the CR lever 237, and thus, an operator cannot touch the lever part 237*a* to operate. Therefore, in the status in which the liquid jetting head unit 401 has been inserted and the CR needle 222 has been inserted, the liquid jetting head unit 401 cannot be removed.

(Configuration of the Carriage: a Part to Fix the Liquid Jetting Head Unit)

As shown in the FIG. 16, a squared hole is formed on a backward wall of the carriage 200. In the hole part, two CR connectors 216 are installed collocating to transfer a signal from and to the liquid jetting head unit 401. The CR connector 216 has many contacts. Respective contacts are adapted to move back-and-forth independently. According to this structure, in mounting the liquid jetting head unit 401 on the carriage 200, when the contact part of the liquid jetting head unit 401 comes to a surface of a contact pad 421 (in detail, refer to the item of the liquid jetting head unit described later,) the contact of the CR connector 216 retreats and also the contact of the CR connector 216 receives the force to push back the contact part of the liquid jetting head unit 401 in the direction of the arrow H by the opposite force thereof.

In the top of the carriage 200, the CR lever 237 is rotatively supported by a CR lever shaft 238 supported by left and right side faces of the carriage 200. In the CR lever 237, the lever part 237*a* is installed to allow a rotative motion of the CR lever 237.

Figure 55:
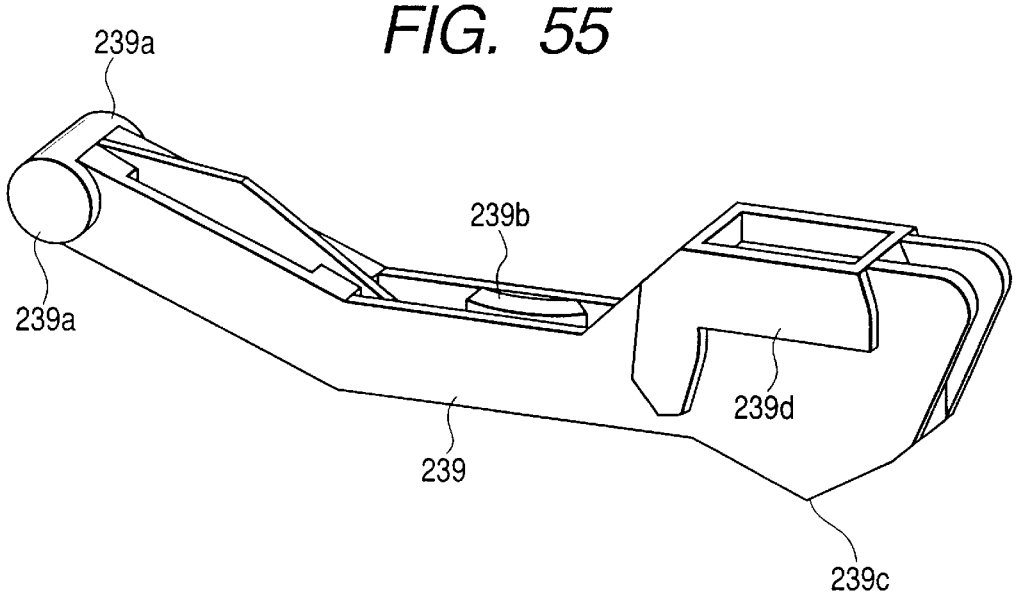
FIG. 55 is an enlarged view of a head set plate.

In a center part of the carriage 200 two head set plates 239 are held as shown in FIG. 55. One head set plate 239 is installed for one liquid jetting head unit 401. In this example, a configuration is made by mounting two liquid jetting head units 401 on one carriage 200 and thus, two head set plates 239 are installed. Number of these liquid jetting head unit 401 and head set plate 239 can be properly changed according to a design.

A shaft 239*a* installed in backward left-and right sides of the head set plates 239 is fitted to a U-shaped receiver 237*b* installed in the CR lever 237 to move rotatively the head set plate 239 with making this part as a center. On the other hand, the central part of the head set plate 239 has a spring receiver 239*b*. Between this part and a spring receiving part, not illustrated, in a back face of the CR lever 237, a CR set plate panel 240 comprising a compression spring, not illustrated, is installed. By action of the CR set plate panel 240, in the head set plate 239, a front end part 239*c* of the head set plate 239 starts rotation toward downward and backward direction about the shaft 239*a* installed in backward left and right sides, when the CR lever 237 is set. According to this, in the status in which the liquid jetting head unit 401 is set, the liquid jetting head unit 401 is pressed downward and backward by the head set plate 239. Here, in the status in which the liquid jetting head unit 401 is not set, in order to prevent the head set plate 239 from being removed from the CR lever 237, the CR lever 237 has a part 237*c* to receive a rib 239*d* installed in the left and right sides of the front end of the head set plate 239.

On a bottom face of the carriage 200, as shown in the FIG. 19, two bosses 2001 having a trapezoid shape, of which top face is flat, are installed for one liquid jetting head unit 401 making a total of four. In the status in which the liquid jetting head unit 401 is set, two bosses (in detail, refer to the item of the liquid jetting head unit described later) installed respectively on a bottom face of respective liquid jetting head units 401 is adapted to collide against bosses 2001, respectively. According to this, a position of the liquid jetting head unit 401 in a height direction is determined. In addition, on the bottom face of the carriage 200, one U-shaped rib-like part 200*m* is installed for one liquid jetting head unit 401 making a total of two. In the status in which respective liquid jetting head units 401 are set, side faces of bosses installed in the bottom faces of respective liquid jetting head units 401 are adapted to collide against these rib-like part 200*m*, respectively.

In a part of a vertical wall of the upward and backward side of the CR connector 216 of the carriage 200, another U-shaped rib-like part 200*n* is installed to oppose the above described U-shaped rib-like part 200*m*. In viewing this part from the top part of the carriage 200, the part shows the configuration presented in FIG. 56. In the part where the U-shaped rib-like part 200*m* installed in the bottom face of the carriage 200 meets the U-shaped rib-like part 200*n* installed in the vertical wall, a cylindrical shape 200*p* is formed. In the status in which the liquid jetting head unit 401 has been set, a spherical projection (in detail, refer to the item of the liquid jetting head unit described later,) which is installed in the upward part of the contact pad 421 being the contact part of the backward side of the liquid jetting head unit 401, collides against the U-shaped rib-like part 200*n* installed in the part of the vertical wall.

Figure 57B:
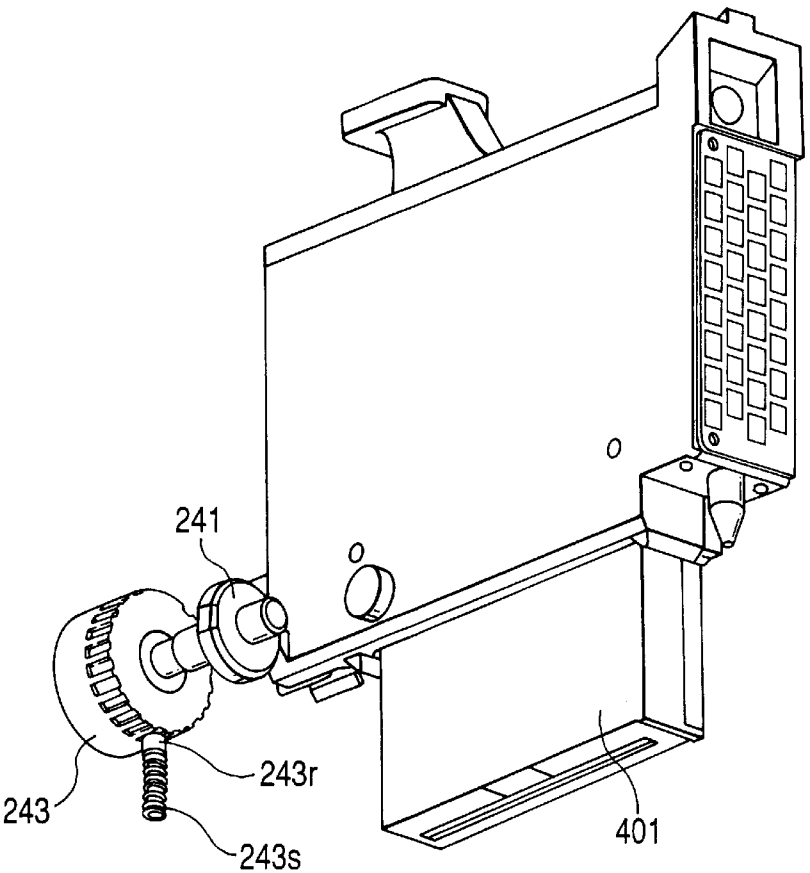
FIGS. 57A and 57B are perspective views of an adjusting mechanism for adjusting the rotating direction of a liquid jet head.
Figure 57A:
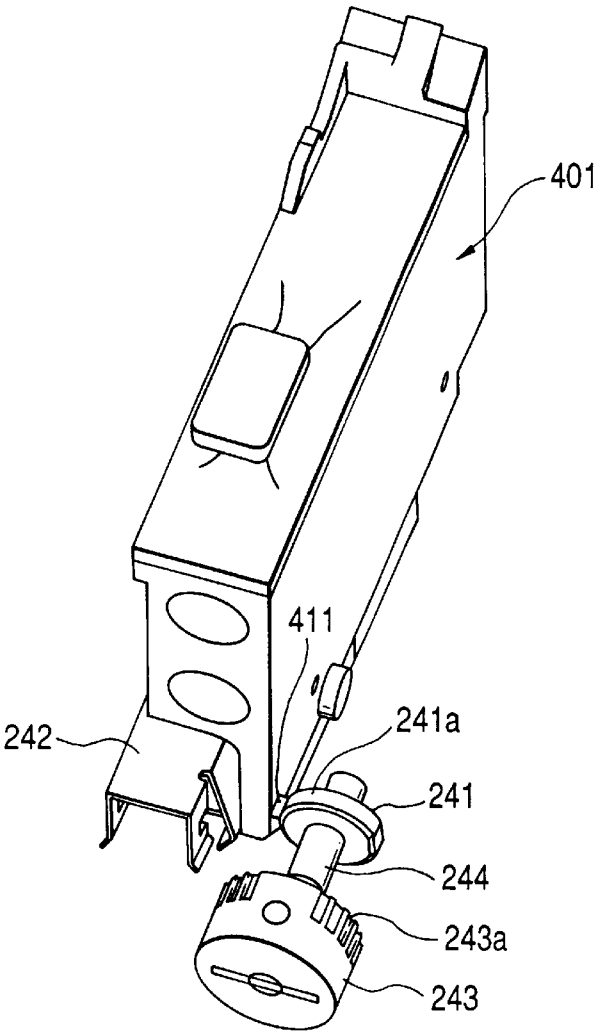

In frontward side of the carriage 200, as shown in FIGS. 57A and 57B, a mechanism (in detail, refer to the item of the adjusting mechanism for the rotation direction of the liquid jetting head unit described later,) is installed to adjust the rotation direction (a slope of a series of nozzles configuring the liquid jetting head) of the liquid jetting head unit 401. This mechanism is configured by a CR head spring 242 made from a leaf spring and a CR head cam 241. The CR head cam 241 is adapted to adjust finely a colliding position of a left circumferential face 241*a* of the cam by rotation. According to this, the rotation direction of the liquid jetting head unit 401 is adjusted. The CR head spring 242 is installed to adapted to push an opposite face of a face, of the liquid jetting head unit 401 and to which the left circumferential face 241*a* of the CR head cam 241 contacts, toward the CR head cam 241. A part, of the liquid jetting head unit 401 and to which the left circumferential face 241*a* of the CR head cam 241 contacts, has a trapezoid projection 411. In this part, the rotation direction (a slope of a nozzle of the head) of the liquid jetting head unit 401 is positioned.

Figure 61:
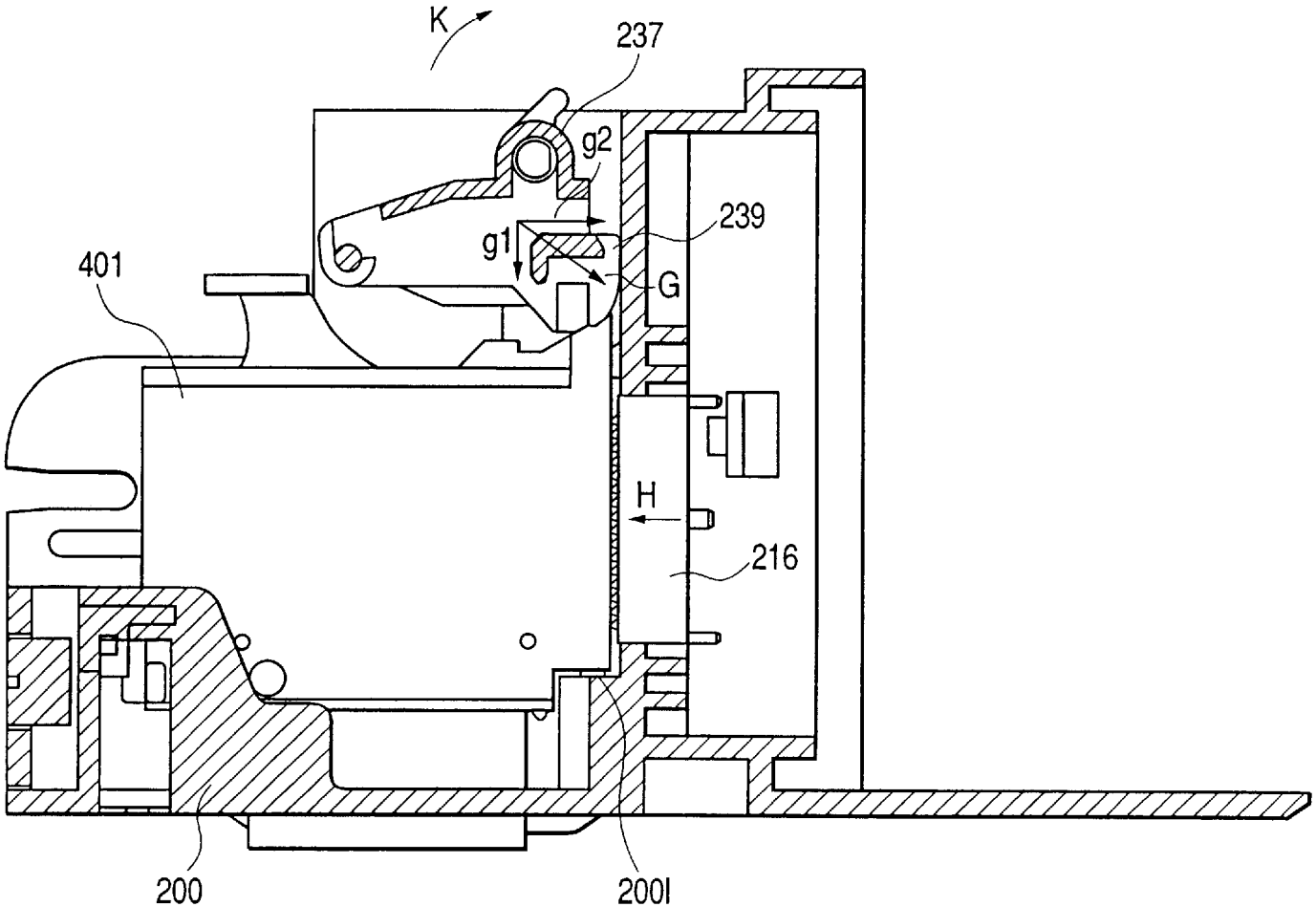
FIG. 61 is a view illustrating an installing and removing operation of a head of a carriage.
Figure 62:
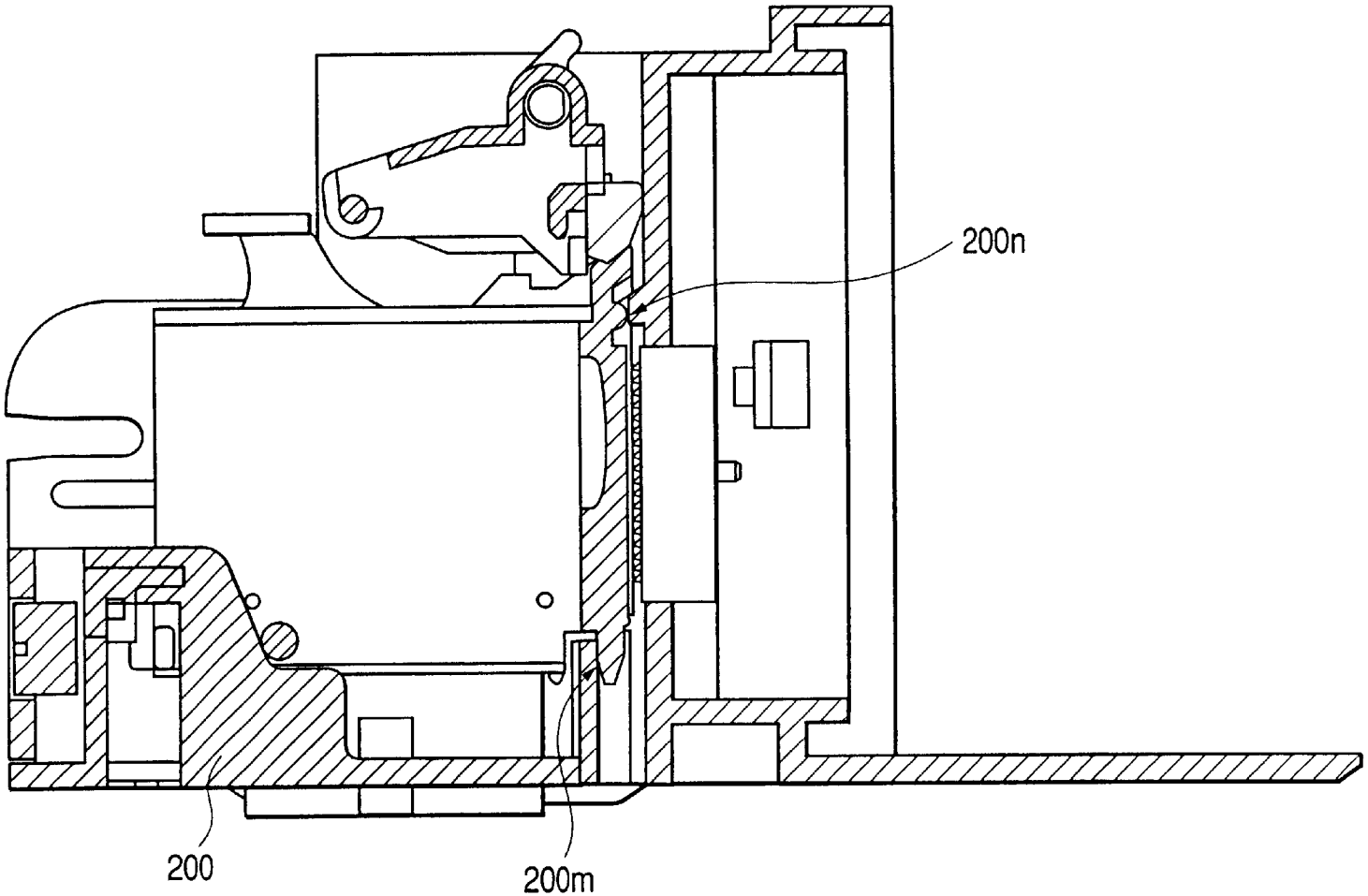
FIG. 62 is a sectional view of a carriage with a head installed therein.

According to the above described configuration, positioning of the liquid jetting head unit 401 installed in the carriage 200 in the height direction is, as shown in FIG. 61 and FIG. 62, determined by the force gl, pressing downward, of a partial force of the head set plates 239 and by collision of two bosses 2001 having a trapezoid shape, of which top face is flat, installed in the bottom face of the carriage 200 against two bosses installed in the bottom face of the liquid jetting head unit 401.

Figure 56:
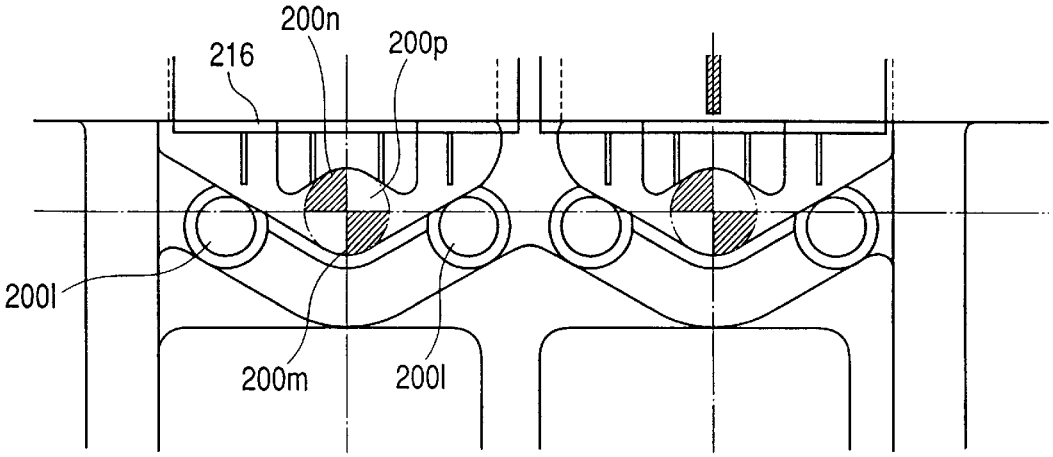
FIG. 56 is a plan view of a rib-like portion of a CR connector.

Front-to-back and left-to-right positioning of the liquid jetting head unit 401 is determined by colliding part of the U-shaped rib-like part 200*m* installed in the bottom face of the carriage 200 against the side face of the boss installed in the bottom face of the liquid jetting head unit 401, colliding part of the U-shaped rib-like part 200*n* installed in the backward vertical wall of the carriage 200 against the spherical part installed upward contact part of the backward side of the liquid jetting head unit 401, and a balance between an opposite force H of the CR connector 216 in the frontward direction and downward and backward force g2, of the head set plates 239, generated by the CR set plate panel 240 installed in the CR lever 237. In conclusion, according to the present invention, as shown in FIG. 56, the front-to-back and left-to-right positions of the liquid jetting head unit 401 are determined by about the cylindrical shape 200*p* formed by the opposite U-shaped rib-like parts 200*m* and 200*n* installed in the bottom face and the backward vertical wall of the carriage 200, respectively.

The liquid jetting head unit 401, as described above, rotates around the cylindrical shape 200*p* formed by the opposite U-shaped rib-like parts 200*m* and 200*n* installed in the bottom face and the backward vertical wall of the carriage 200, respectively. The rotation direction (the slope of a nozzle of the head) of the liquid jetting head unit 401 is positioned by inserting the trapezoid projection 411 installed in a frontward and downward side of the liquid jetting head unit 401 between the left circumferential face 241*a* of the CR head cam 241 installed in the frontward side of the carriage 200 and the CR head spring 242.

(Configuration of the carriage: the Adjusting Mechanism Part for the Rotation Direction of the Liquid Jetting Head Unit)

Referring to FIGS. 57A and 57B, a further detailed description will be given for the adjusting mechanism for the rotation direction of the head unit 401 installed in the frontward side of the carriage 200, which has been described in the section of the part to fix the liquid jetting head unit 401 as described above.

The adjusting mechanism for the rotation direction of the head unit 401 is rotatively held by two sets of bearing shape parts installed in the frontward side of the carriage 200. The adjusting mechanism for the rotation direction comprises the disk-shaped CR. head cam 241 having a D-shaped hole in the center thereof, a CR head dial 243 rotating the CR head cam 241 and having a groove 243*a* in the outer circumferential face with an equal distance and the D-shaped hole in the center thereof, and a D-cut shaped CR head shaft 244 connecting the CR head cam 241 to the CR head dial 243. In spite of no illustration, the groove 243*a* formed in the outer circumference of the CR head dial 243 has a configuration in which a steel ball 243*r* collides against the spring 243*s*. According to this, rotation of the CR head dial 243 is kept clicking in a certain angle.

According to the above described configuration, if the CR head dial 243 is clicked in a certain angle to rotate, the CR head cam 241 rotates through the CR head shaft 244 and the position of the left circumferential face 241*a* of the CR head cam 241 moves in very small distance. Here, against the left circumferential face 241*a* of the CR head cam 241, the trapezoid projection 411 installed in the frontward and downward side of the liquid jetting head unit 401 is pushed by the CR head spring 242 with a form of the leaf spring installed in the carriage 200.

As described above, when the CR head cam 241 rotates to move the position of the left circumferential face 241*a* thereof in very small distance, the trapezoid projection 411 installed in the frontward and downward side of the liquid jetting head unit 401 moves according to a rotation of the CR head cam 241 and the liquid jetting head unit 401 rotates about the cylindrical shape 200*p* formed by the opposite U-shaped rib-like parts 200*m* and 200*n* installed in the bottom face and the backward vertical wall of the carriage 200, respectively. Thus, by adjusting rotation of the CR head dial 243, the rotating direction (the slope of the nozzle to discharge ink of the head) of the liquid jetting head unit 401 can be freely adjusted. In the embodiment, this adjusting mechanism is installed in each of respective liquid jetting head units 401. Therefore, the slope of the nozzle to discharge ink of the liquid jetting head unit 401 can be adjusted every liquid jetting head units 401 in the very small distance.

(Configuration of the Carriage: Fitting Steps of the Liquid Jetting Head Unit)

Subsequently, fitting steps of the liquid jetting head unit 401 will be described below with reference to FIG. 58 to FIG. 62.

Figure 58:
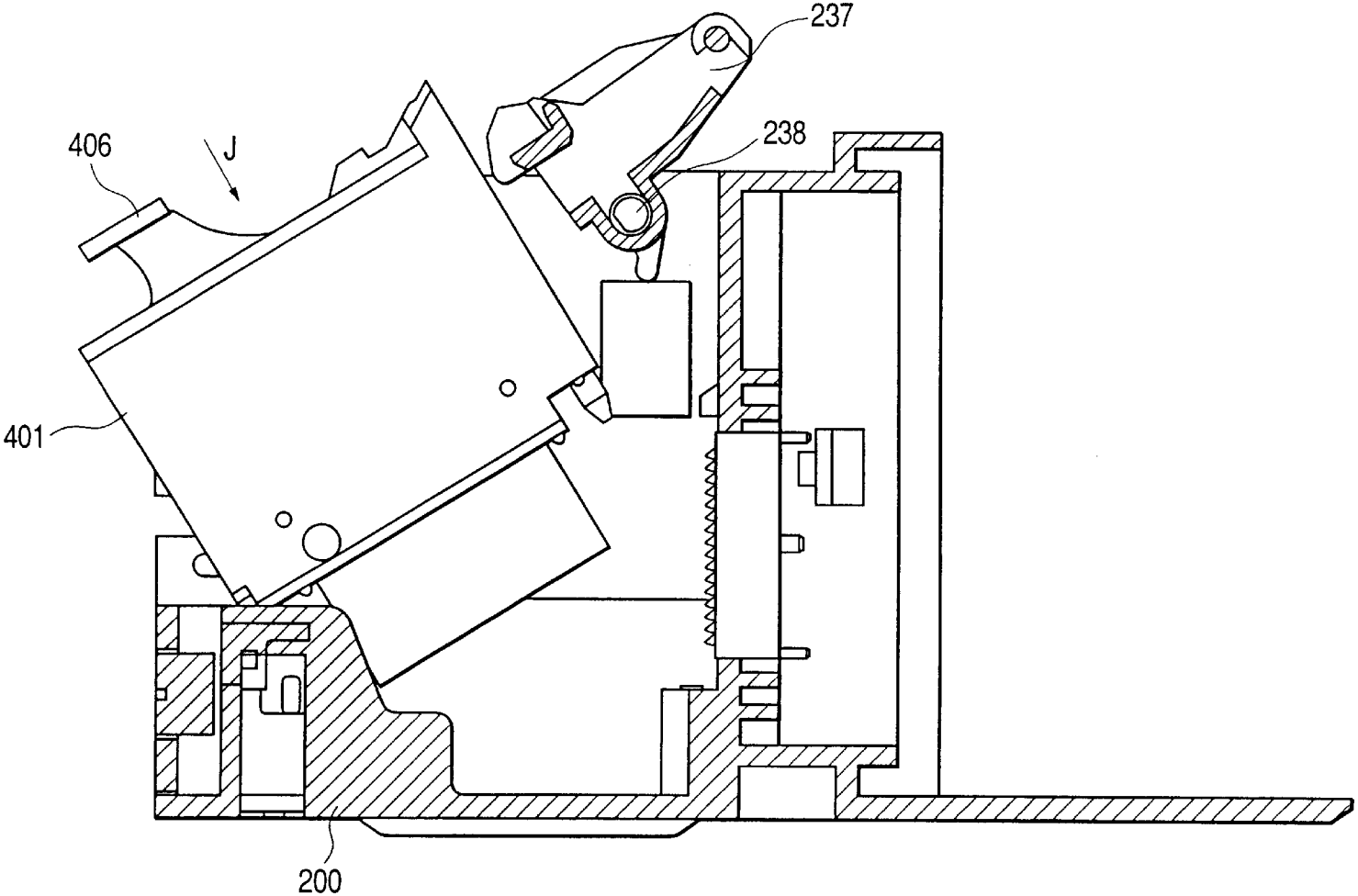
FIG. 58 is a view illustrating an installing and removing operation of a head of a carriage.

First, as shown in FIG. 58, the CR lever 237 is rotated about the CR lever shaft 238 supported on the left and right side boards of the carriage 200 to allow the liquid jetting head unit 401 to insert in the carriage 200. In this status, a handle 406, which is installed in a upper part of the liquid jetting head unit 401, is held by a hand to insert the liquid jetting head unit 401 from the frontward side of the carriage 200 to the direction shown by the arrow J holding the nozzle thereof in a obliquely downward position.

Figure 59:
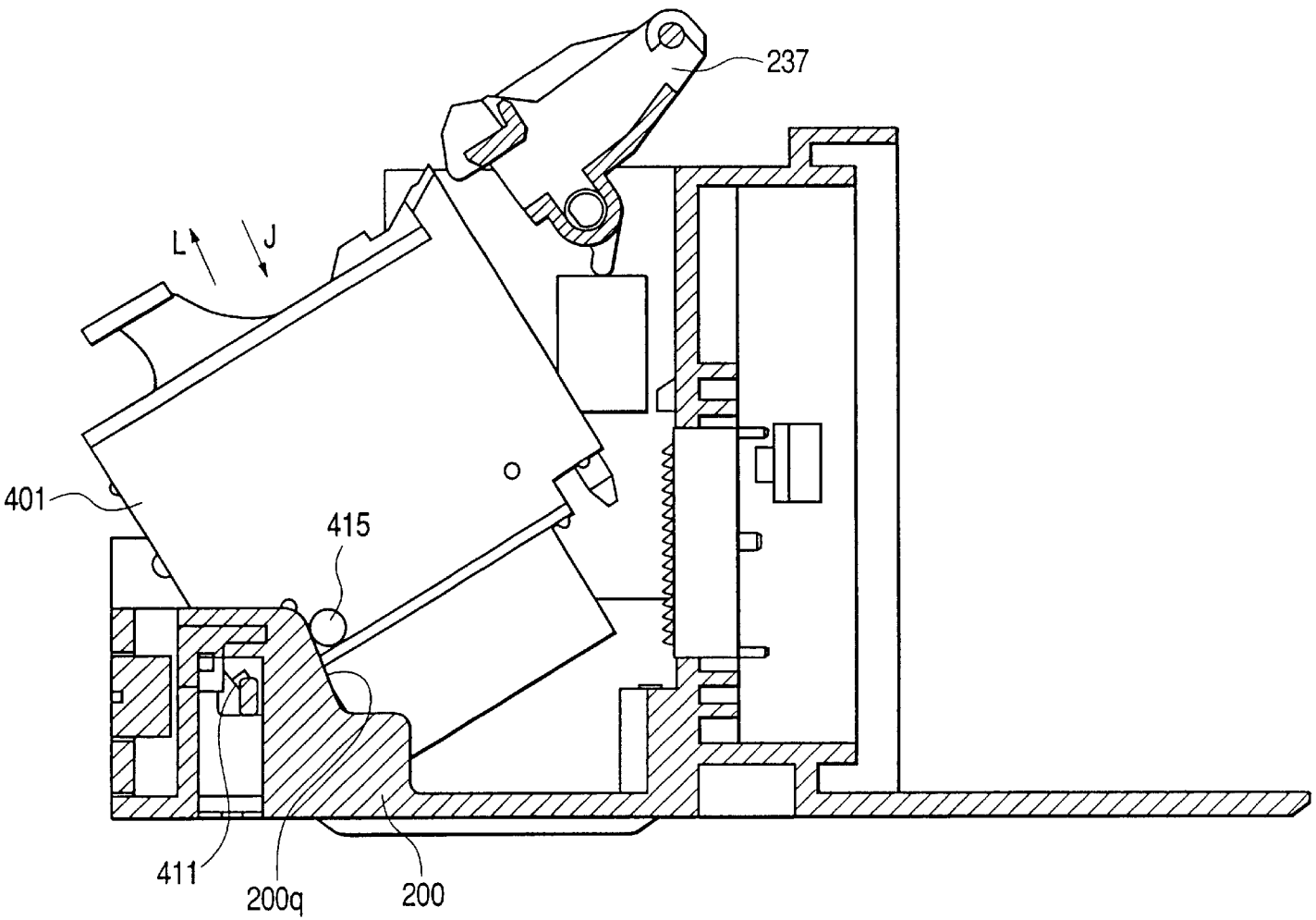
FIG. 59 is a view illustrating an installing and removing operation of a head of a carriage.

When the liquid jetting head unit 401 is further inserted, as shown in FIG. 59, the side face of a cylindrical projection 415 installed in the right side face of the liquid jetting head unit 401 collides against a guide part 200*q*, which is installed on the wall located in the right side of the inserting position of the head unit of the carriage 200, for guiding of insertion of the head unit. In addition, when the liquid jetting head unit 401 is further inserted backward, the cylindrical projection 415 is guided by the guide part 200*q* to place the liquid jetting head unit 401 in the inserting position of the head unit of the carriage 200. The trapezoid projection 411 installed in the frontward and downward side face of the liquid jetting head unit 401 is inserted between the CR head cam 241 (refer to FIG. 57A) and the CR head spring 242 (refer to FIG. 57A.)

Figure 60:
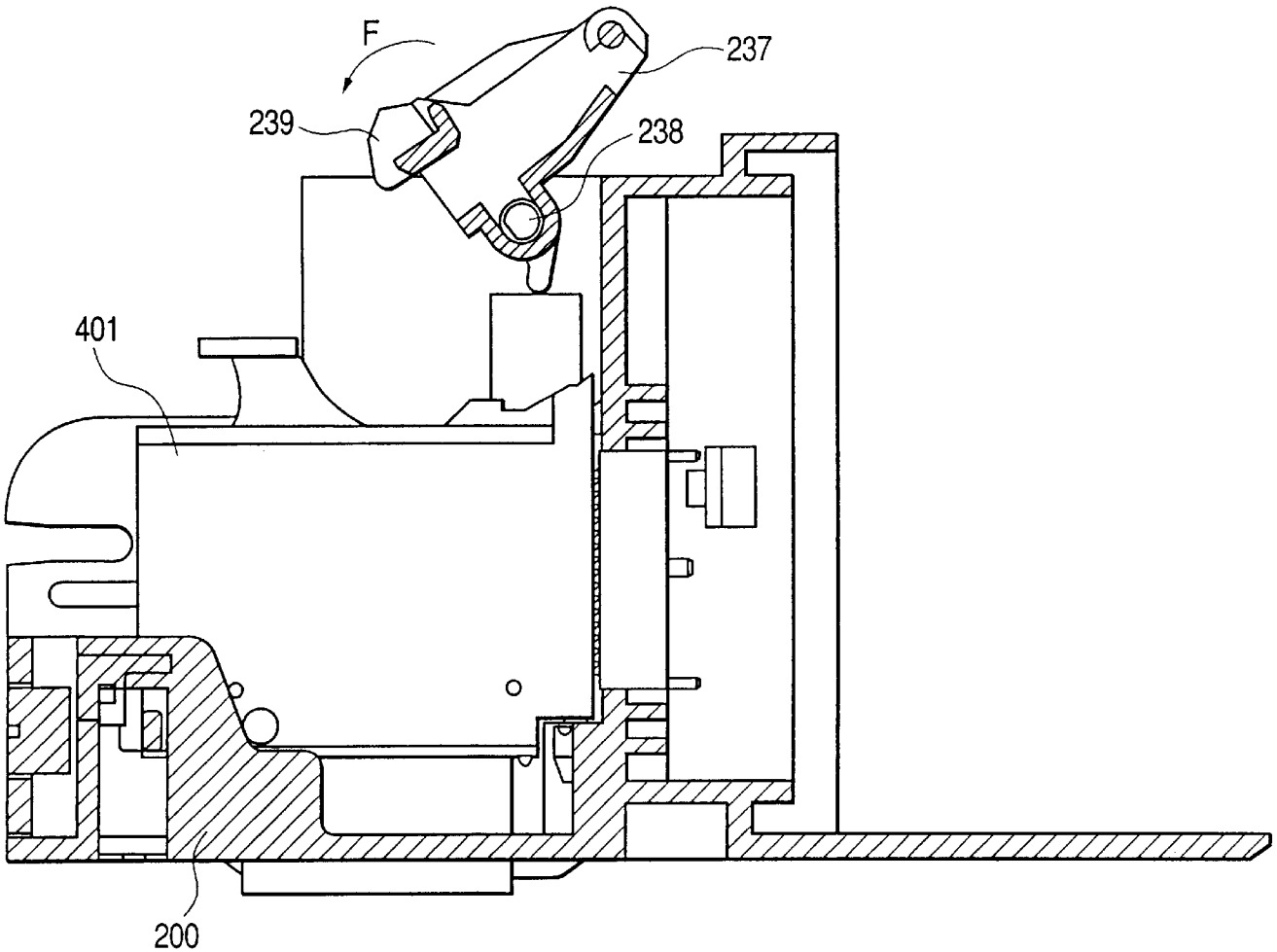
FIG. 60 is a view illustrating an installing and removing operation of a head of a carriage.

When the liquid jetting head unit 401 is inserted in the inserting position of the head unit of the carriage 200, as shown in FIG. 60, the CR lever 237 is rotated around the CR lever shaft 238 in the direction of the arrow F. Then, a front end part 239*c* (refer FIG. 55) of the head set plate 239 held by the CR lever 237 pushes the liquid jetting head unit 401 to the downward and backward side.

According to this, as shown in FIG. 61 and FIG. 62, the liquid jetting head unit 401 is held in the status in which it has been placed in the inserting position of the head unit of the carriage 200 to complete attaching the liquid jetting head unit 401 to the carriage 200.

(Configuration of the Carriage: Removing Steps of the Liquid Jetting Head)

Removing steps of the liquid jetting head unit 401 from the carriage 200 reverse the fitting steps described above.

First, in the status in which the liquid jetting head unit 401 has been placed in the inserting position of the head unit of the carriage 200 as shown in FIG. 61 and FIG. 62, a pressure to the liquid jetting head unit 401 by the front end part 239*c* of the head set plate 239 is released by rotating the CR lever 237 about the CR lever shaft 238 in the direction of the arrow K.

Then, by the opposite force H in the frontward side direction of the CR connector 216 mounted on the carriage 200, the liquid jetting head unit 401 is pushed to the frontward side. Here, the side face of the cylindrical projection 415 of the liquid jetting head unit 401 collides against the guide part 200*q* of the carriage 200 and thus, the liquid jetting head unit 401 rises obliquely to make the status shown in FIG. 59.

In this status, the handle 406 of the liquid jetting head unit 401 is held by the hand to draw the liquid jetting head unit 401 from the frontward side of the carriage 200 to the direction shown by the arrow L shown in the FIG. 59. According to this operation, the liquid jetting head unit 401 is removed from the carriage 200.

(Recovery System Unit)

Next, a recovery system unit 300 is installed to solve non-discharge and dot mis-alignment (deviation of placement position of an ink droplet, caused by discharge of ink in an abnormal direction) of ink, which is caused by attaching of dust to a place around the nozzle of the liquid jetting head unit 401 or drying of ink attached to an inside of the nozzle and a surface 401*a* of the nozzle to thicken, will be described below.

Discharge performance recovery means of the recovery system unit 300 in the embodiment is mainly exemplified by the following three.

One is predischarge means. By operating ink discharge from all the nozzles in a predetermined area set in an area, e.g., the recovery system unit 300 in the embodiment, other than a printing medium in non-printing period, thickened ink in the nozzle and around the nozzle and ink of other kind, which invades in the nozzle in the case where a plurality of ink species can be discharged in the same apparatus, are wasted. Ink wasted are sent to a waste ink tank.

Another one is wiping means. This means comprises a blade 303 and the like, which are installed to remove mist discharged together with a main ink droplet discharged for printing, mist splashed by collision of the main ink droplet to a printing medium, or ink attached to a surface forming the nozzle by a suction recovery process described later, and configured by an elastic member such as rubber.

Further one is suction recovery means. This means abuts a cap 308 made of such elastic material as rubber against the nozzle face 401*a* of the liquid jetting head unit 401 to contact closely each other and discharges ink forcedly from the nozzle by reducing an atmospheric pressure inside the cap 308 to an outside atmospheric pressure or lower by pumping means to eliminate an element, e.g. dust, dried ink, a bubble, and the like, in the nozzle, which disturbs ink discharge, by using the ink flow. Ink sucked is sent to the waste ink tank for process.

The configuration of the recovery system unit 300 in the embodiment will be described below in detail.

Figure 27:
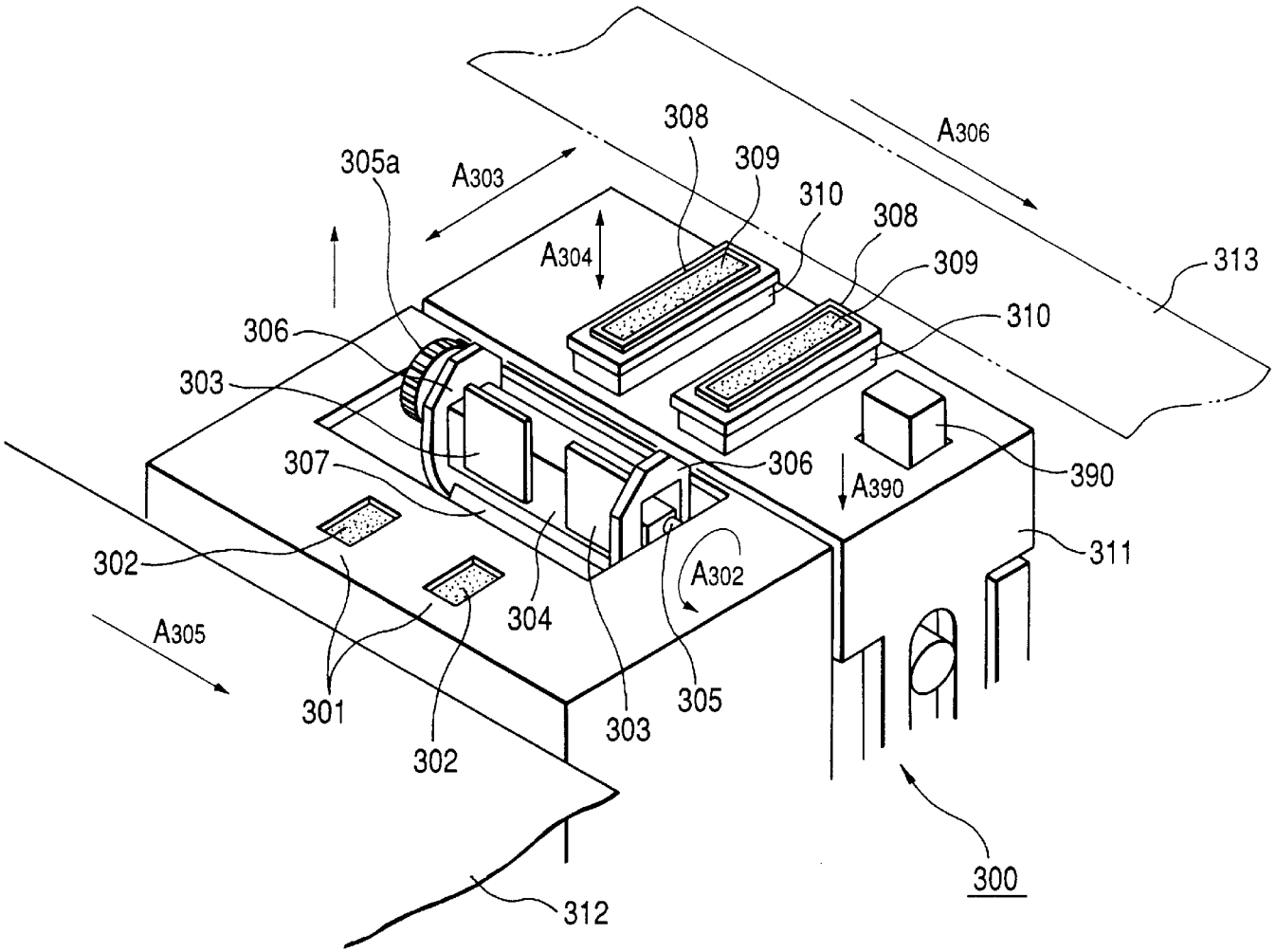
FIG. 27 is a perspective view of a recovery system unit.

FIG. 27 is a perspective view of the recovery system unit 300. The recovery system unit 300 is fixed to a CR frame 201, in which a carriage guide member such as the CR shaft 202 passed through the carriage is installed, and therefore, relative position to the carriage 200 and the liquid jetting head unit 401 is precisely realized.

A predischarge port (predischarge receiving port) 301 is formed in the direction of a nozzle row of the liquid jetting head unit 401 to make its length shorter than a total length of the nozzle row of the liquid jetting head unit 401. This is possible by sequential operation of every group made by dividing nozzles in several groups and no simultaneous operation of predischarge for all the nozzles. According to this, miniaturization of the recovery system unit 300 is achieved. On the other hand, discharge operation (so-called flow predischarge) accompanied with scanning job of the carriage 200 is adopted for the embodiment in order to avoid prolongation of processing time for predischarge caused by dividing and discharging. In detail, if it is assumed that 616 nozzles installed in the liquid jetting head unit 401 are divided in, for example, 9 blocks of every 62 nozzles and one block of remaining 58 nozzles making the total of 10 blocks, and that predischarge frequency of every nozzle in predischarging is 200 times, radio frequency for predischarge is 8 kHz, and distributing pitch of nozzles is 600 dpi, operation of sequential predischarge from a nozzle block located in the direction of progress of the carriage 200 moving the carriage 200 in a constant speed of 105/mm sec allows ink to reach a range of length just twice the 62 nozzles, i.e., about 5.25 mm. Then, in the embodiment, the length of the predischarge port 301 is set 8 mm little longer than the reachable range as described above. Namely, in contrast to the nozzle row having the length of about 26 mm, the length of the predischarge port 301 is ⅓ or shorter. Besides, inside the predischarge port 301, a predischarge absorbent 302 made from a porous resin material is installed to hold ink discharged and collect by an idle suction process of the predischarge port, described later, without leaving ink.

In the above described flow predischarge, scanning by the carriage 200 in a constant speed is not always required. For example, predischarge may be operated by using a lamp-up or lamp-down area of the carriage 200 in order to shorten the process time.

On the other hand, predischarge may be operated by moving the carriage 200 not continuously but discontinuously and in a stopping status: for example, as described before, discharge is not operated scanning by the carriage 200, but predischarge is carried out in a predetermined frequencies after stopping in the upper position of the predischarge port 301 by moving the carriage 200 sequentially every nozzle block.

Every one of the blades 303 comprising a flat plate of the elastic material such as rubber is installed for every one of two liquid jetting head units 401. This, in comparison with an integrated configuration, eliminates an effect of a difference in a height of the nozzle face 401*a* of the liquid jetting head unit 401 and presents the effect to prevent malfunction in which respective inks are mixed in the case where the kind of inks discharged by the two liquid jetting head units 401 differs. The blade 303 is fixed to a blade holder 304. The blade holder 304 is elastically energized in an upward direction (the direction of the arrow $A_{301}$) toward the blade shaft 305 integrated with a blade gear 305*a* through a blade spring described later. Further, the blade shaft 305 is rotatable in the direction of the arrow $A_{302}$ by a blade actuating means described later and thus, the blade 303 engaged with this is also rotatable. Furthermore, the configuration is adapted to make that the blade holder 304 has integrally a blade cam 306, and when the carriage 200 scans on a wiping means in the direction of the arrow $A_{303}$, it is elastically pressed down to the blade rib (not illustrated) on the carriage 200 and thus, keeping precisely an overlapped volume (hereafter, invasion volume) of the blade 303 and the nozzle forming surface of the liquid jetting head in order to execute wiping. According to this, a stable invasion volume can be kept independently from a difference between attaching positions of the liquid jetting head unit 401 and the recovery system unit 300 in a height direction to realize good wiping.

According to the embodiment, a blade cleaner 307 described later, the cap 308 formed by such elastic material as rubber, the cap absorbent 309 made of the porous material and installed in the cap 308, a cap holder 310 holding the cap 308, and a cap lever 311 which energizes the cap holder 310 in the direction of the arrow $A_{304}$ through the cap spring, not illustrated, and is configured movably upward and downward allowing opening or closing the cap by a cap lever cam described later are installed. Respective carrying directions of each of an envelope 312 being the printing medium and a continuous paper (tape) 313 are directions of arrows $A_{305}$ and $A_{306}$. A carriage lock arm 390 is a member engaged with a hole (not illustrated,) which is made in the carriage 200, to fix the carriage 200 and resulting in prevention of moving the position of the liquid jetting head unit 401 and the cap 308 by a shock, when capping is operated or the cap lever 311 rises.

The carriage lock arm 390 has been attached to the cap lever 311 through a lock spring, not illustrated, and thus, is possible to go down elastically in the direction of the arrow $A_{390}$. Therefore, even if the carriage lock arm 390 is abutted against the part other than the hole part of the carriage, the recovery system unit 300 and the carriage 200 are not damaged.

As described above, according to the embodiment, arrangement is in the order of an envelope carrying space, the predischarge port, wiping means, capping means, and a continuous paper carrying space. The reason of the order will be described below.

First, the cap 308 will be described next. A malfunction such as leak of ink is caused by an foreign matter or dried ink attached to accumulate on a closely contacted face (the front end face of an annular rib to cover normally the series of nozzles) with a nozzle face 401*a* of the cap 308 to prevent drying of ink in the nozzle or to waste ink forcedly from the nozzle by suction means described later. Main foreign matter in the present printing apparatus is a fibrous foreign matter, called a paper powder, produced by the printing medium in carrying operation. In the embodiment, the paper powder merely occurred from the continuous paper, but a large quantity of the paper powder was produced by the envelope. On the other hand, concerning ink mist, though there is mist driven from a printing position, the quantity is distinctly larger in ink mist splashed by the blade in the wiping step. On the basis of the above described reasons, in order to reduce minimum quantity of the paper powder and ink driven to the cap, the cap 308 is located in the position most far from the envelope printing position and not coming of ink splashed and driven by the blade 303 in the wiping step.

As described above, the blade 303 splashes ink in the wiping step and therefore, in order to prevent stain of not only the cap 308 but also the printing medium, the blade 303 of the wiping means should be kept a predetermined distance from the printing position. Thus, the predischarge port is made between the envelope carrying space and the wiping means to keep an enough distance from the printing position (envelope carrying space.)

Figure 28:
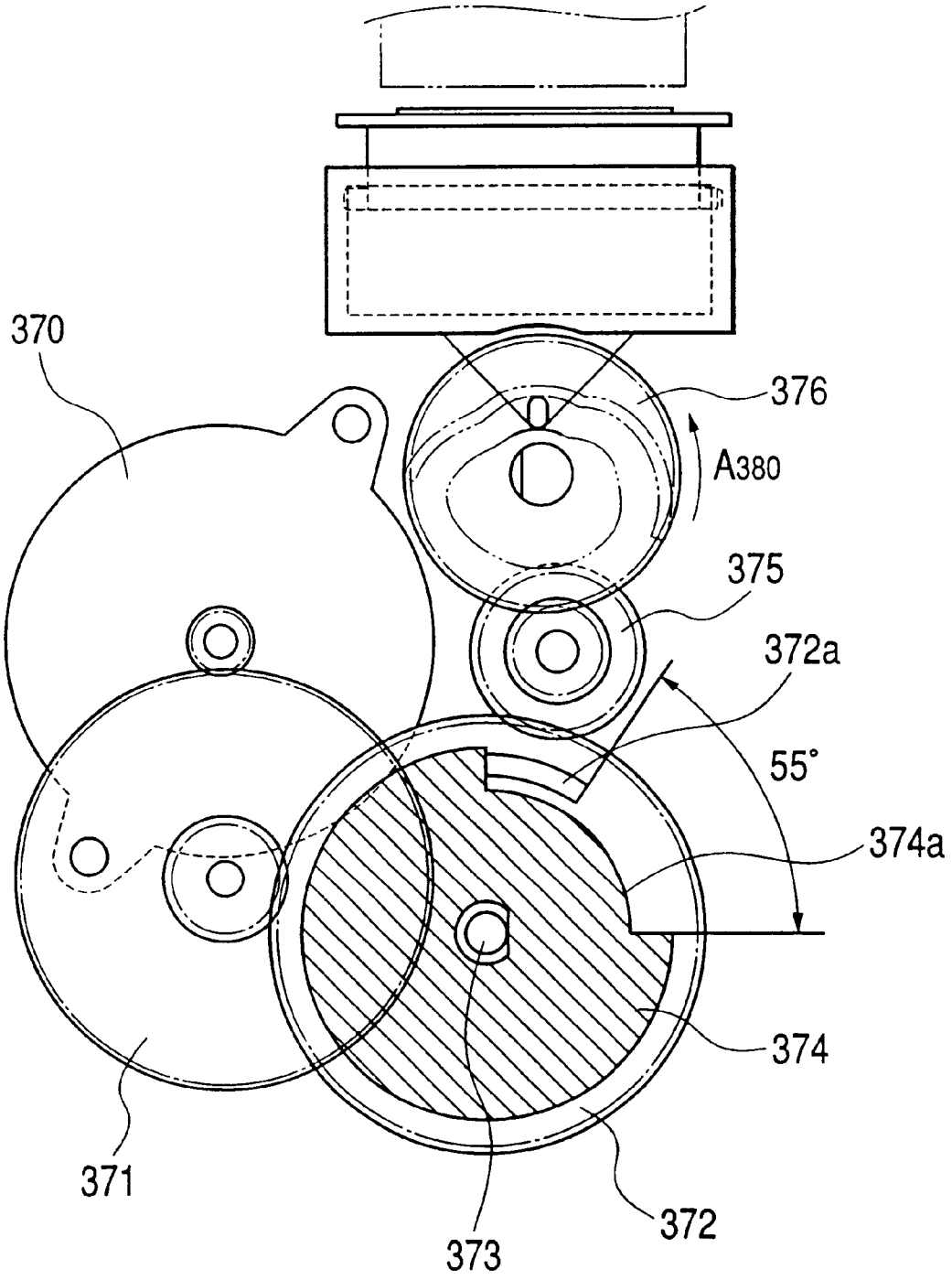
FIG. 28 is a schematic view showing a driving system of a recovery system unit.

FIG. 28 is a figure showing the configuration of a driving system of the recovery system unit 300.

As the driving system, a motor 370, in which a gear is firmly attached to a rotation shaft, exclusively for driving in the recovery system, a first double gear 371, being the gear of the next stage of a motor, for reducing a speed, an idler gear 372 engaged with a first double gear and rotatable about a pump shaft 373 to which a roller guide, described later, is firmly attached, and a pump cam 374 (indicated by shadowing) firmly attached to the pump shaft 373 and having a notch part 374*a* engaged with a rib 372*a* installed in the idler gear 372 are installed, and a play of a rotation angle of 55° between the rib 372*a* and the notch part 374*a*, In addition, a second double gear 375 engaged with the idler gear 372 and a one-way clutch 376, integral with the gear, to generate a tightening torque against the cam shaft, described later, which becomes the rotation center, only when rotates in the direction of the arrow $A_{380}$, are installed.

Figure 29:
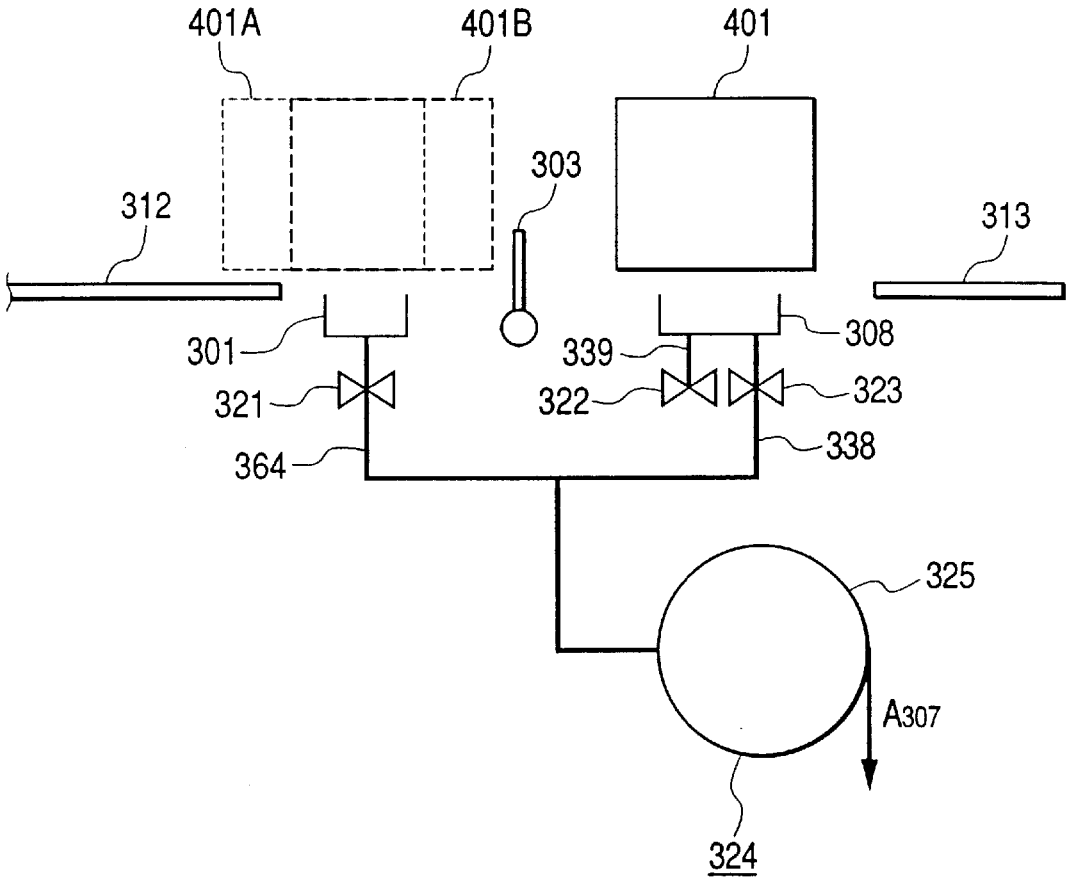
FIG. 29 is a view showing a relationship between flow paths and valves of a recovery system unit.

FIG. 29 is a figure showing the configuration of an ink path and a valve of the recovery system unit 300. The embodiment has two lines of flow path to two liquid jetting head units 401. However, For simplifying the explanation, in the FIG. 29, only one line of the flow path is shown for the one liquid jetting head units 401.

In the embodiment, corresponding to the liquid jetting head units 401, a predischarge valve 321, an atmosphere communication valve 322, a suction valve 323, and a negative pressure generating means (in the embodiment, a tube pump 324) to generate a negative pressure in suction recovery of the liquid jetting head units 401 are installed.

First, description is given to the condition of the valve in the case where an idle suction process of the predischarge port is operated to collect ink discharged by the predischarge process. The predischarge is operated during movement from 401A to 401B of the liquid jetting head units 401. Subsequently, the predischarge valve 321 only is opened, other two valves 322 and 323 are closed, and the tube pump 324 is driven by the above described driving system to generate the negative pressure inside a tube. According to this, ink staying in the predischarge port 301 passes through a predischarge tube 364 and a pump tube 325 and is discharged in the direction of the arrow $A_{307}$ to be sent to a waste ink process means, not illustrated.

Next, the status of the valve in operation of the suction recovery process will be described below. In the FIG. 29, the cap 308 is located far from the liquid jetting head units 401. However, in practice, the suction recovery process is operated in the status in which the cap lever cam 350, described later, is actuated, the cap lever 311 is raised to energize the cap 308 resulting in elastic close contact to the nozzle face 401*a* of the liquid jetting head unit 401 to cover the series of nozzles. In the status in which the predischarge valve 321, the atmosphere communication valve 322, and the suction valve 323 are closed, the tube pump 324 is worked and then only the suction valve 323 is opened to instantaneously reduce the pressure inside the cap resulting in suction of ink in the cap 308. Idle suction operated for collection of ink inside the cap 308, the cap tube 338, the pump tube 325 is carried out by working the tube pump 324 after opening the atmosphere communication valve 322 and the suction valve 323 keeping the status in which the cap 308 is closely contacted to the liquid jetting head unit 401 to make a status allowing intake of air from an atmosphere communication tube 339.

Next, the mechanism of the tube pump 324 will be described below with reference to FIG. 30 and FIG. 31.

In a roller guide 327, two rollers 326 are rotatably installed with a phase shift of 180 degrees. Besides, in a roller guide 327, a groove 327*a*, into which the shaft part 326*a* made in both ends of the roller 326 is inserted, is formed and along with this groove 327*a*, the roller 326 can move. The roller 326 can roll to squeeze and draw the pump tube 325 made of silicon. A roller damper 328 is formed with such elastic material as rubber.

Figure 30:
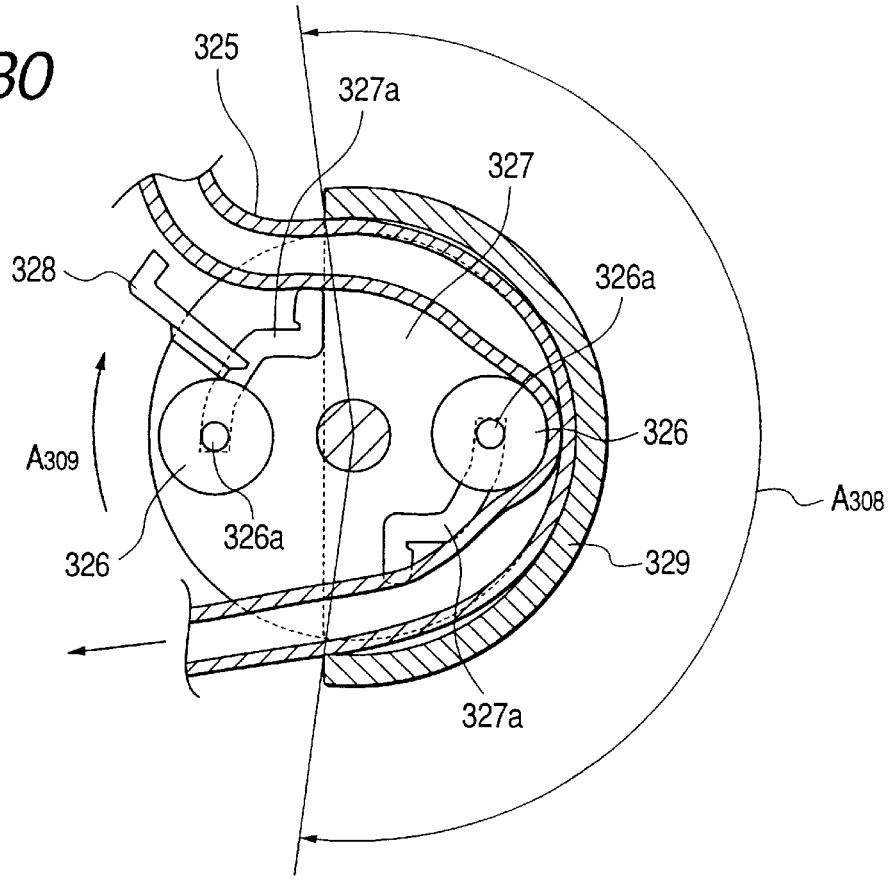
FIG. 30 is a schematic view showing a state where a negative pressure is generated by a tube pump.

FIG. 30 is a status in which the negative pressure is generated by action of the tube pump 324. The roller 326 located in the one end of the groove 327*a* moves to a place most near the outer circumference to rotate squeezing the pump tube 325 and draw the pump tube 325. The roller damper 328 locates the roller 326 in the one end of the groove 327*a* out of the range of an area $A_{308}$ squeezed by the pump tube. Two rollers 326 has the phase shift of 180 degrees and the tube guide 329, as shown in $A_{308}$, is located in the area 180 degrees or wider and therefore, the negative pressure always continuously occurs during rotation of the roller guide 327 in the direction of the arrow $A_{309}$.

Figure 31:
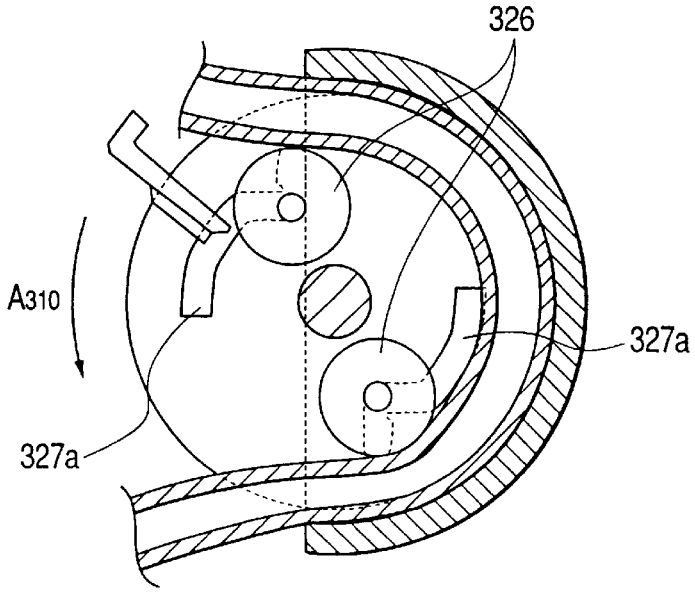
FIG. 31 is a schematic view showing a state where no negative pressure is generated by a tube pump.

FIG. 31 is a figure showing an action in the case where the roller guide 327 is rotated in an opposite direction of the FIG. 30 (in the direction of the arrow $A_{310}$.) In this case, the roller 326 is located in the end in the opposite direction to the FIG. 30 in the groove 327*a* by a load caused by interference with the pump tube 325 and the roller damper 328, and the status becomes that the roller 326 has gone away to the center of rotation of the roller guide 327 to make idle rotation substantially without squeezing the pump tube 325. Therefore, the status becomes that no negative pressure is generated and no fear of squeezing and creep of the pump tube 325. Therefore, in power-off or print preparation status in which printing may be stopped for a long time, this situation is preferably ideal. For reference, in order to shift reliably from the status of the FIG. 30 to the status of the FIG. 31, the rotation angle of 40 degrees is required in the configuration of the embodiment.

The configuration of the valve mechanism will be described below with reference to FIG. 32 to FIG. 34.

First, the predischarge valve 321 will be explained with reference to the FIG. 32. According to the embodiment, the predischarge valve cam 330 to regulate opening and closing of the predischarge valve 321, the valve holder 331 in which all valves are housed, a predischarge valve rubber 332 which is a diaphragm valve formed with such elastic material as rubber, the valve shaft 333*a* engaged with the predischarge valve rubber 332 or the suction valve rubber 342 described later, a first valve arm 334*a* engaged with the vale shaft, a cam follower 335*a* abutting against the first valve arm 334*a* and the predischarge valve cam 330 or a suction valve cam 341, a first valve arm spring 336*a* energizing the first valve arm 334*a* toward the direction of the predischarge valve rubber 332 or the suction valve cam 341, and a valve tube 337 to form the ink path from the predischarge valve 321 to a suction valve 323 described later are installed.

Figure 32:
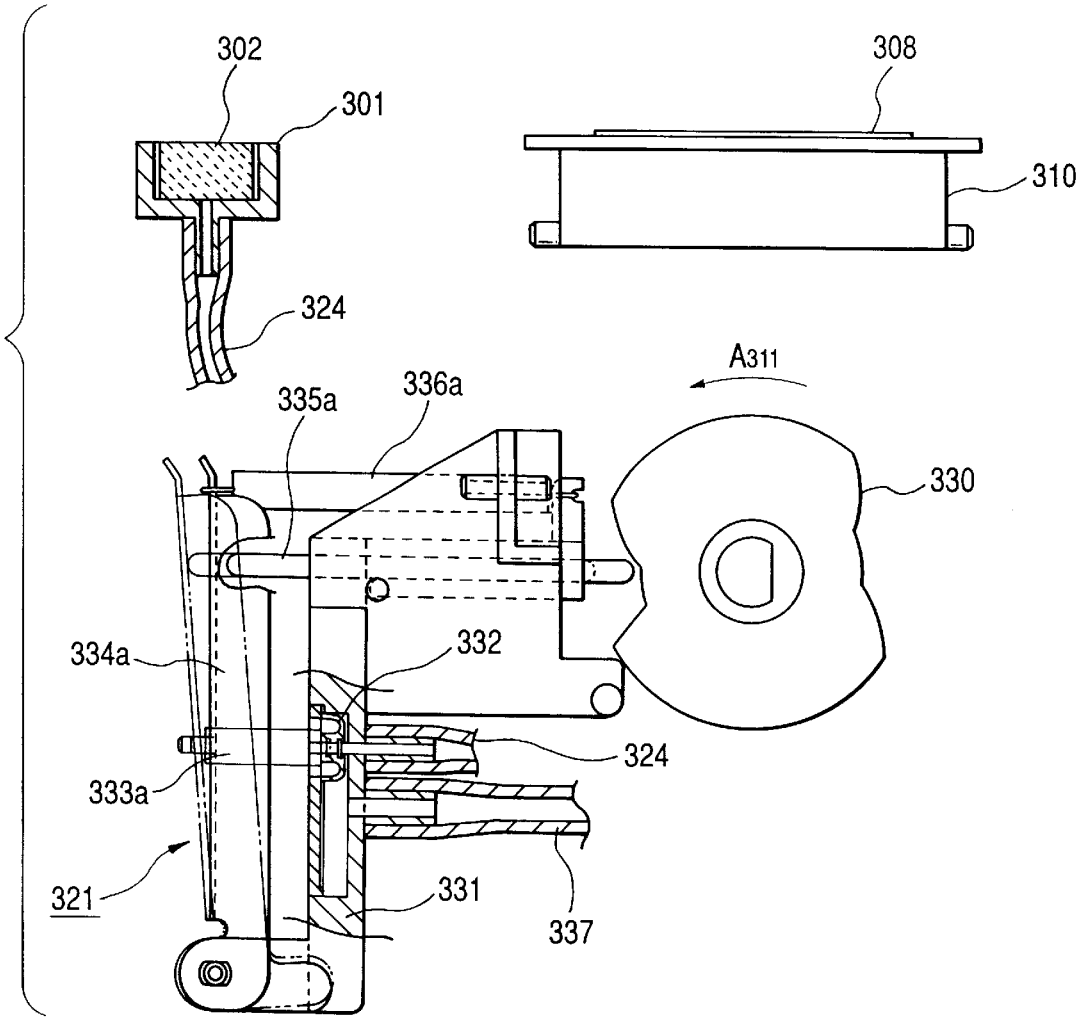
FIG. 32 is a schematic view showing an operation of a predischarge valve.

In the FIG. 32, a solid line represents the status in which the predischarge valve rubber 332 is located in the valve holder 331 and the flow path, which connects the predischarge tube 364 and the valve tube 337, has been closed. Starting from this status, when the predischarge valve cam 330 rotates to the direction of $A_{311}$ to rotate the first valve arm 334*a* to the point represented by a double chain line, the valve shaft 333*a* moves to the position of the double chain line to open the predischarge valve 321 and then, the flow paths of the e predischarge tube 364 and the valve tube 337 are opened.

In the FIG. 32, a reference numeral of which end has a character, a, shows a member, among respective members, used for the predischarge valve mechanism. In the FIG. 33, a reference numeral of which end has a character, b, shows a member, among respective members, used for the suction valve mechanism. Both types of members are same in function and shape with only difference in position they are used, and no explanation is given.

Figure 33:
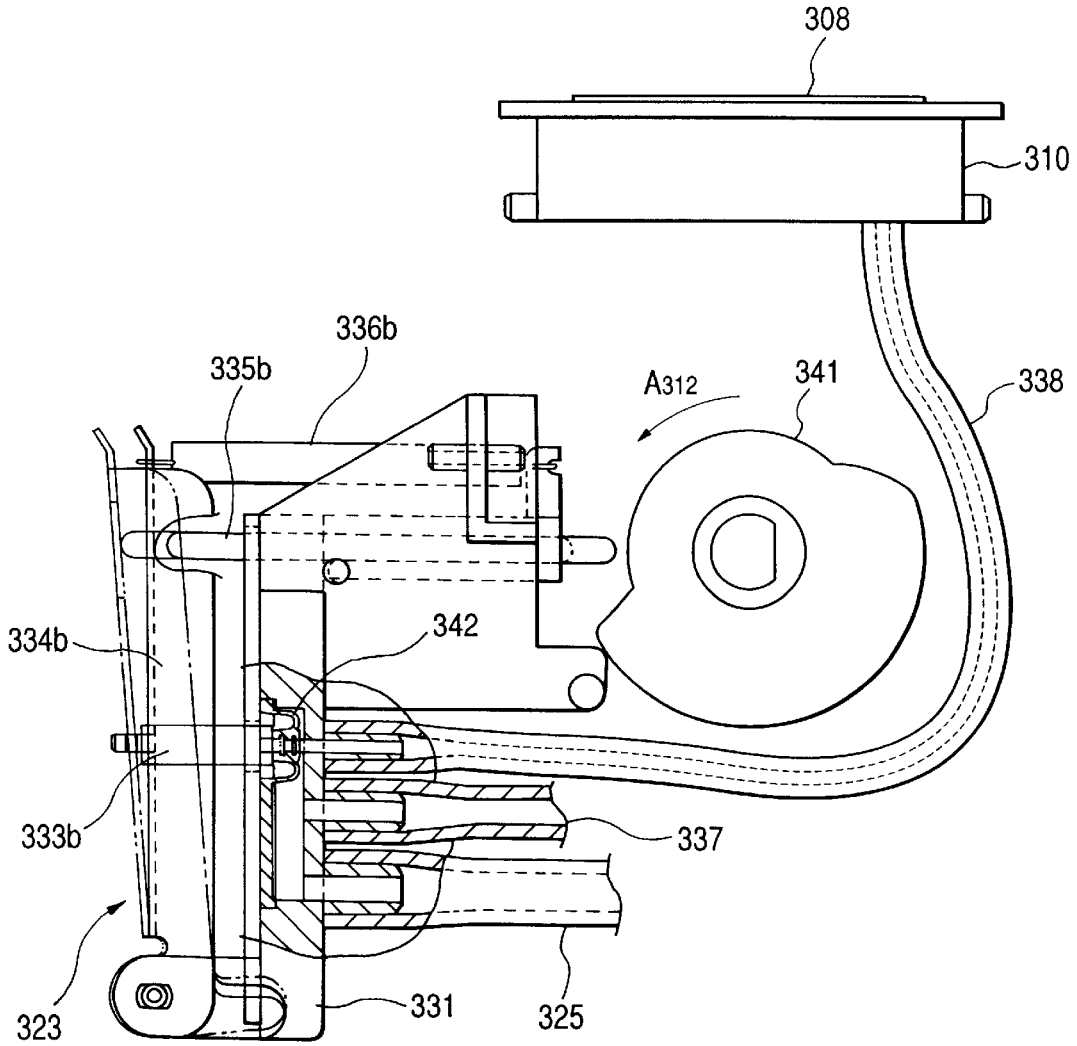
FIG. 33 is a schematic view showing an operation of a suction valve.

The FIG. 33 is a figure showing action of the suction valve 323. According to the embodiment, the suction valve cam 341 to regulate the action of the suction valve 323, the suction valve rubber 342 which is a diaphragm valve formed with such elastic material as rubber, and the cap tube 338 forming the ink path from the cap 308 to the valve holder 331 are installed.

In the FIG. 33, the solid line shows the status in which the suction valve 323 has been closed. The region between the cap tube 338 and the valve tube 337 is closed by the configuration as same as that of the above described predischarge valve 321. When the suction valve cam 341 rotates in the direction of the arrow $A_{312}$ to rotate the first valve arm 334*b* up to the status shown by the double chain line, the valve shaft 333*b* moves to the position of the double chain line to open the suction valve 323 and then, the flow paths of the cap tube 338 and the valve tube 337 are connected.

Figure 34:
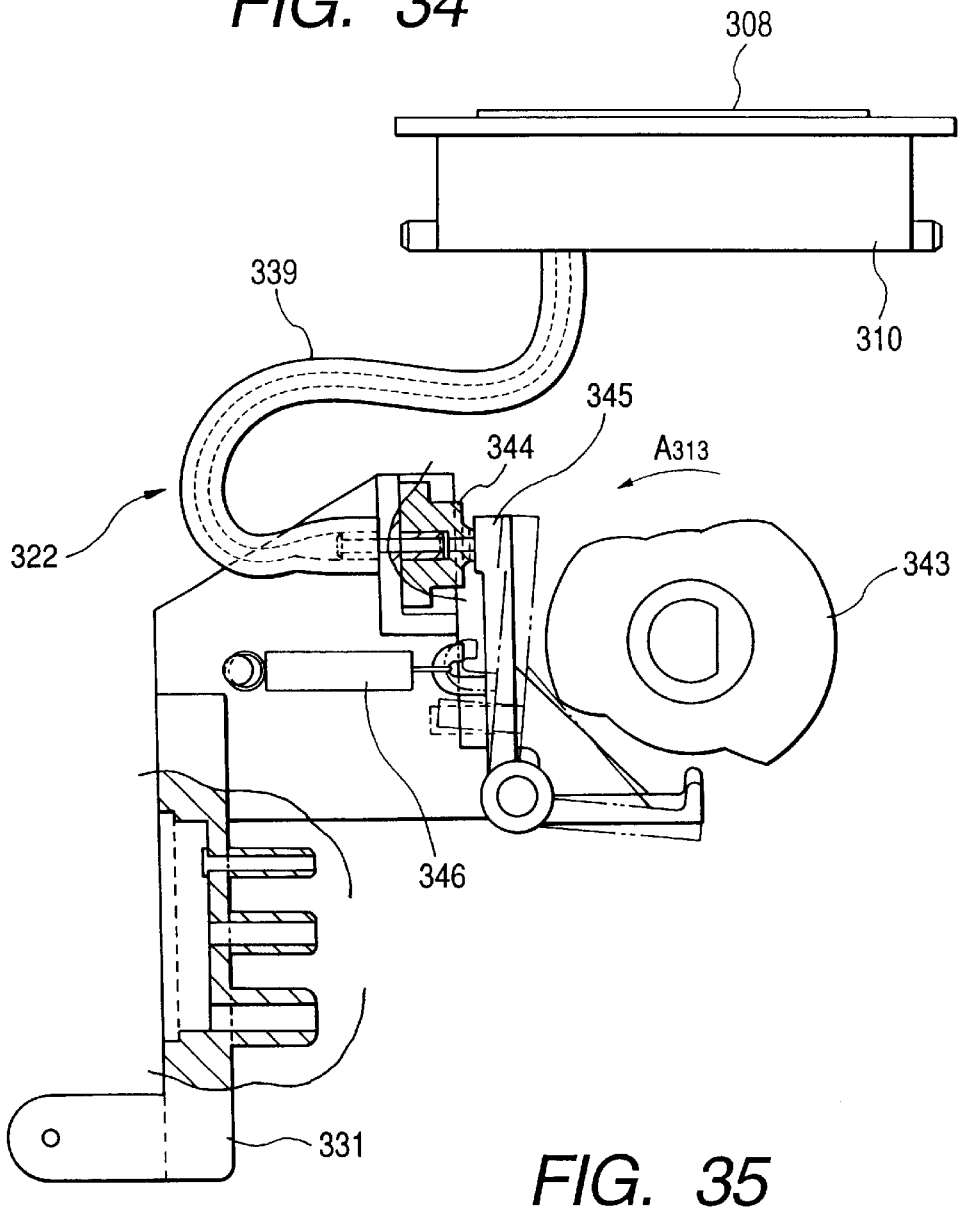
FIG. 34 is a schematic view showing an operation of an atmosphere communicating valve.

FIG. 34 is a figure showing the action of the atmosphere communication valve 322. According to the embodiment, an atmosphere communication cam 343 regulating the action of the atmosphere communication valve 322, an atmosphere communication valve rubber 344 which is a diaphragm valve formed with such elastic material as rubber, a second valve arm 345, and a second valve arm spring 346 energizing the second valve arm toward the direction of the atmosphere communication valve are installed.

In the FIG. 34, the solid line shows the status in which the atmosphere communication valve 322 has been closed. When the atmosphere communication valve cam 343 rotates in the direction of the arrow $A_{313}$ to rotate the second valve arm 345 up to the status shown by the double chain line, the atmosphere communication tube 339 is opened to atmosphere.

The atmosphere communication valve 322 differs from the above described predischarge valve 321 and the suction valve 323. Two lines of ink flow paths, namely the atmosphere communication tube 339 connected to two cap 308, are compiled in a single tube by a jointing member not illustrated to connect to the atmosphere communication valve rubber 344 and thus, only one valve mechanism is simply necessary for installation in two caps 308.

Figure 35:
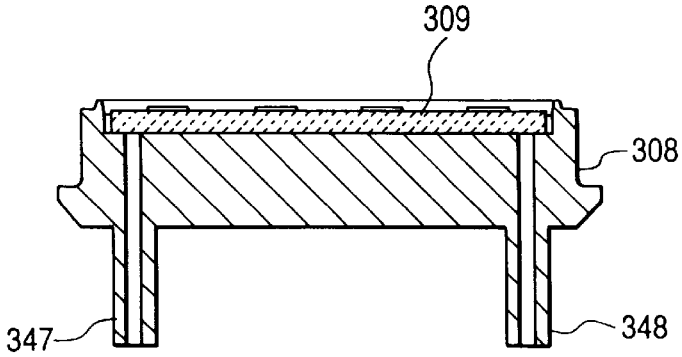
FIG. 35 is a sectional view of a cap.

FIG. 35 is a figure showing a sectional view of the cap 308. In the cap 308, a part 347 connecting to the atmosphere communication tube 339 and a part 348 connecting to the cap tube 338 are installed.

Figure 36:
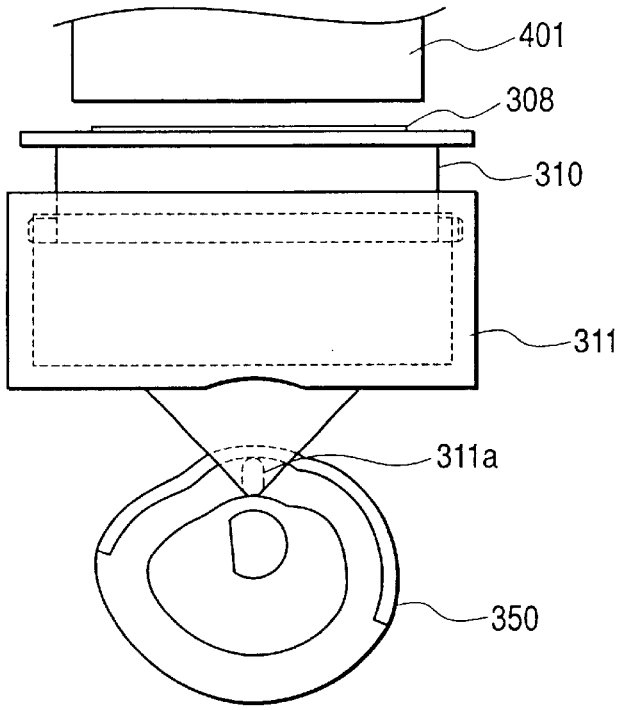
FIG. 36 is a schematic view of a cap in an opened state.
Figure 37:
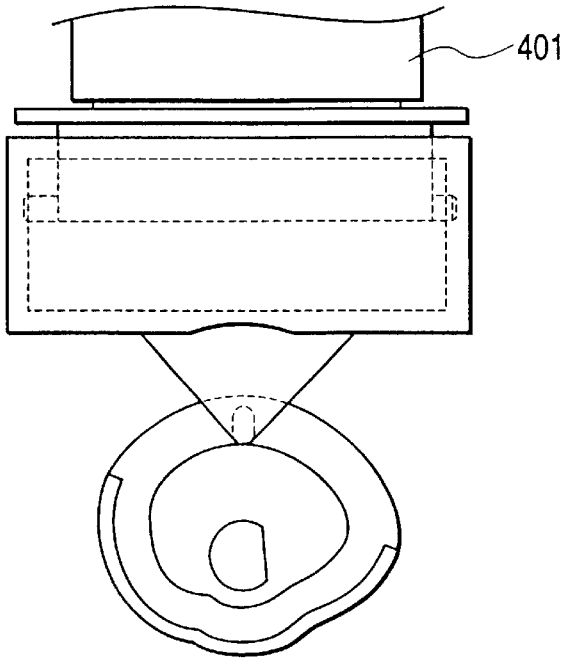
FIG. 37 is a schematic view of a cap in a closed state.

FIG. 36 and FIG. 37 are figures showing upward and downward actions of the cap 308. FIG. 36 is a figure showing the status of cap open, namely, the status in which the cap 308 most moved down, and FIG. 37 is a figure showing the status of cap close, namely, the status in which the cap 308 most lifted.

According to the embodiment, the cap lever cam 350 and the cam follower 311*a*, which is configured integrally with a cap lever 311, for the cap lever cam 350 are installed. Clearly known from FIGS. 36 and 37, abutting of and keeping a distance of the cap 308 against and from the nozzle face 401*a* can be controlled by the cap lever cam 350 rotated and stopped at a predetermined position. The cap spring stretched between the cap holder 310 and the cap lever 311 has been omitted. Configuration is adapted to realize that the cap lever cam 350 and the cam follower 311*a* of the cap lever 311 have a shape allowing not only simple abutting each other, but also engaging with each other and therefore, even in the case where the cap 308 attached to the liquid jetting head units 401 by fixing of ink and the like, they can be stripped off.

Next, the action of the wiping means will be edescribed below with reference to FIG. 38 and FIG. 39. In the wiping means, a blade intermittent gear 351 engaged with the blade gear 305, a blade trigger gear 352 engaged with the blade intermittent gear 351, a blade cleaner 307, and a blade spring 353 are installed. In the carriage 200, the blade rib is installed.

Figure 38:
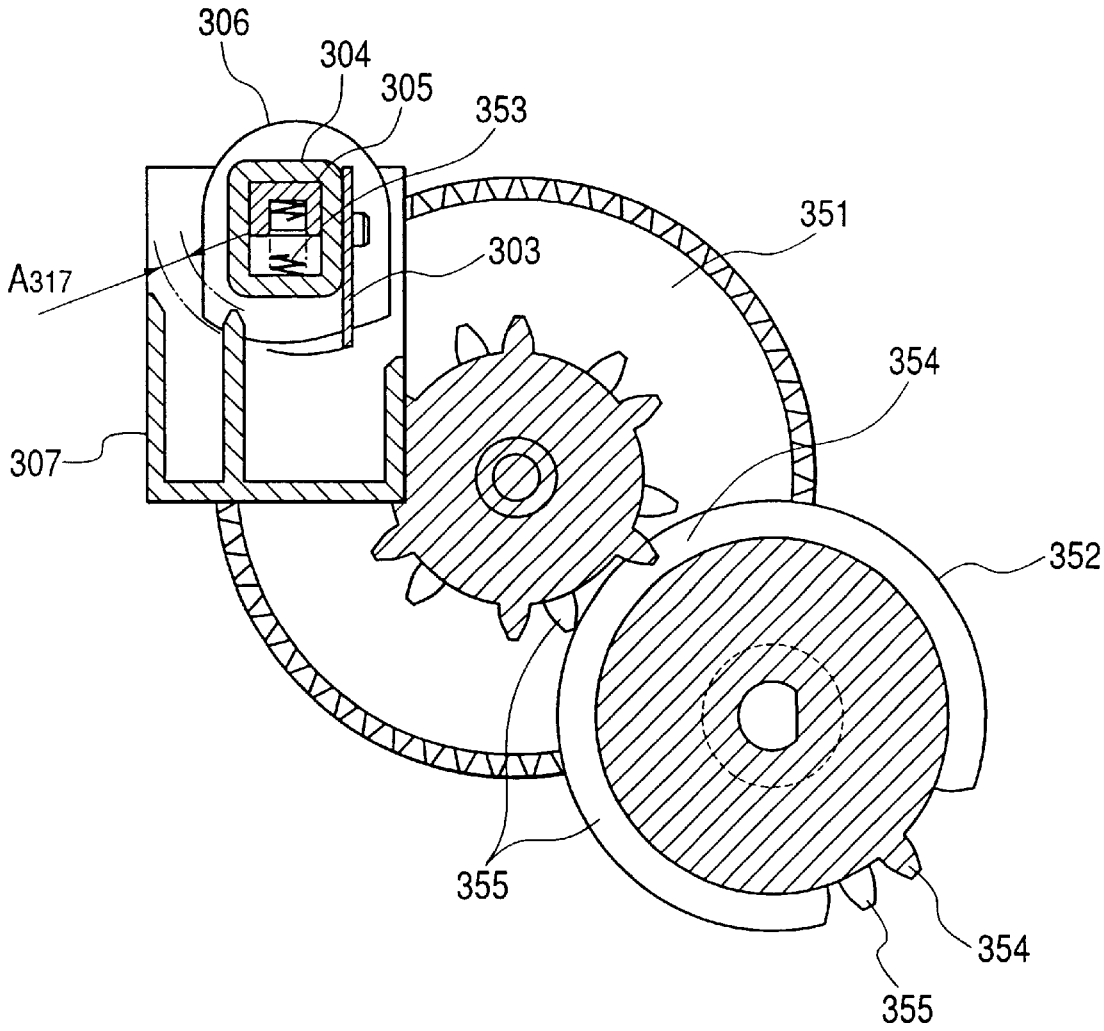
FIG. 38 is a schematic view of a wiping means in state where it is not wiping.
Figure 39:
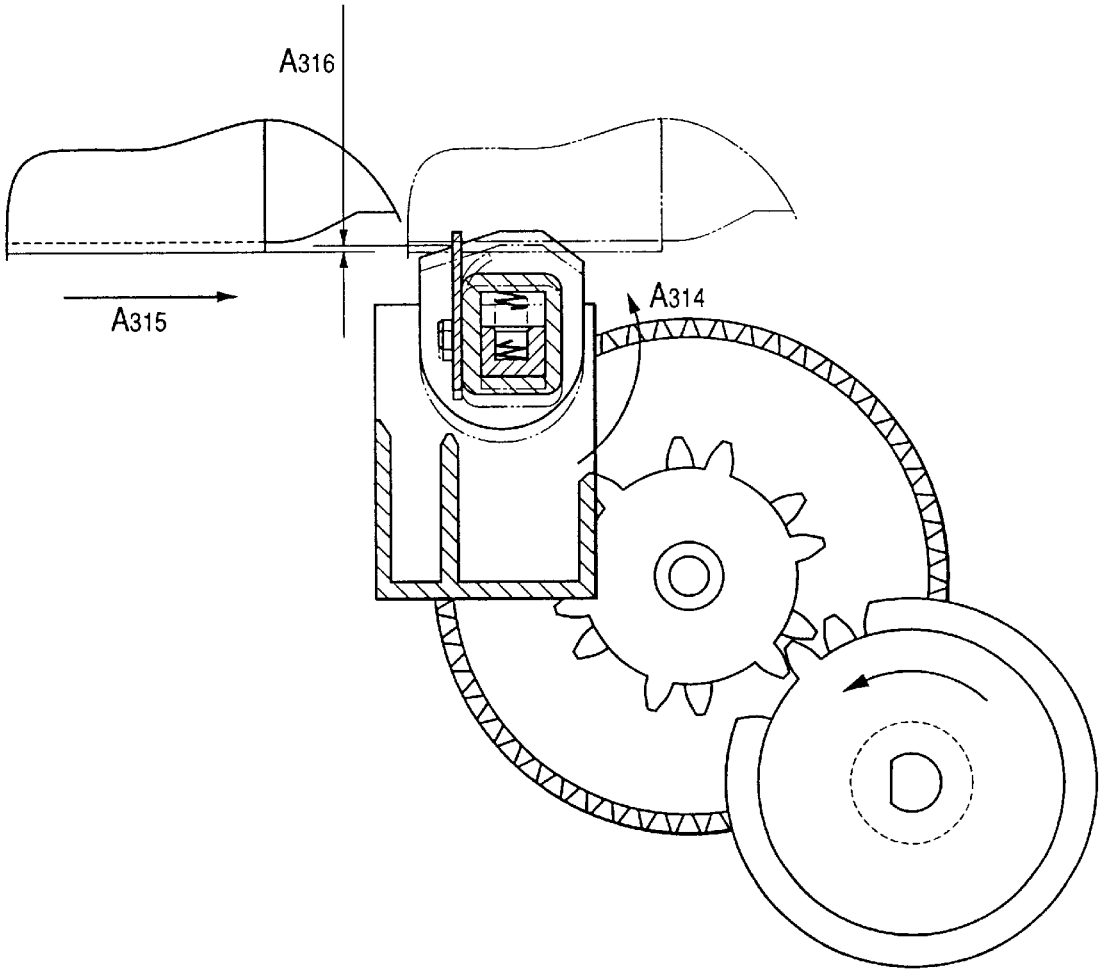
FIG. 39 is a schematic view of a wiping means in state where it is wiping.

For wiping, when the carriage 200 comes from the status of the FIG. 38, in which the blade has retreated, to the position of the solid line of the FIG. 39, the blade cam 306 is rotated in the direction of the arrow $A_{314}$ up to the position of the FIG. 39 in order to make the front end of the blade 303 upward for preparation condition of wiping. Subsequently, the carriage 200 is moved in the direction of the arrow $A_{315}$ in the predetermined speed to operate wiping. Here, the blade cam 306 is pressed down by the blade rib on the carriage 200 and the wiping means moves down up to the position of the double chain line in the FIG. 39. The blade holder 304 and the blade 303, which were moved down, is energized upward by the blade spring 353 to operate wiping by sliding of the blade cam 306 on the blade rib. According to this, a blade invasion volume $A_{316}$ is precisely kept to allow a stable good operation always. When the nozzle face 401*a* of the liquid jetting head unit 401 leaves the blade 303, wiping is finished. Subsequently, the wiping means starts rotation again, and the blade 303 scrapes off ink, which has attached, by the blade cleaner 307 and then, stops in the status shown in the FIG. 38. Here, interference volume $A_{317}$ of the blade cleaner 307 to the blade 303 becomes larger value than the above described the invasion area $A_{316}$ to remove reliably ink attached to the blade 303.

The position of the blade cleaner 307 is determined in the position to which ink splashed by the blade 303 in blade cleaning is not driven to members, such as the cap 308, which must not be attached with ink and, for example, in the embodiment, determined in a downward position of the blade 303. The blade cleaner 307 also is a container to store ink scraped of and is in the configuration easily replaceable if required. Therefore, when dissolve dried ink attached to the blade 303 again or so-called wet wiping, in which wiping is operated doing discharge in use of ink, e.g. pigment-based ink, with a high viscosity, is carried out, ink dropped from the blade 303 can be collected without invasion into other sites inside the apparatus.

Figure 40:
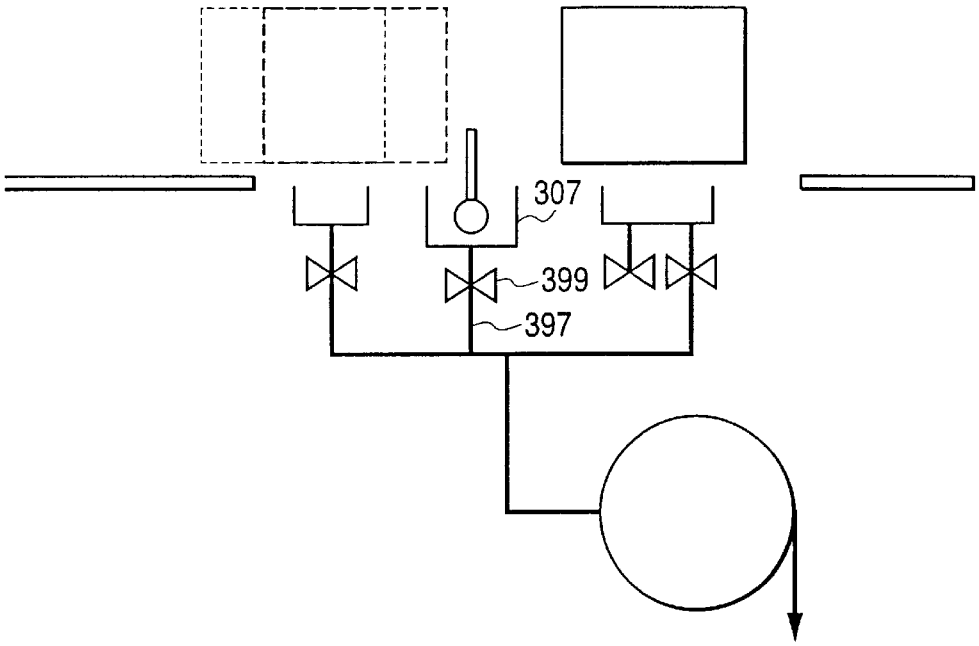
FIG. 40 is a schematic view of a configuration of sucking waste ink from a cleaner blade.
Figure 41:
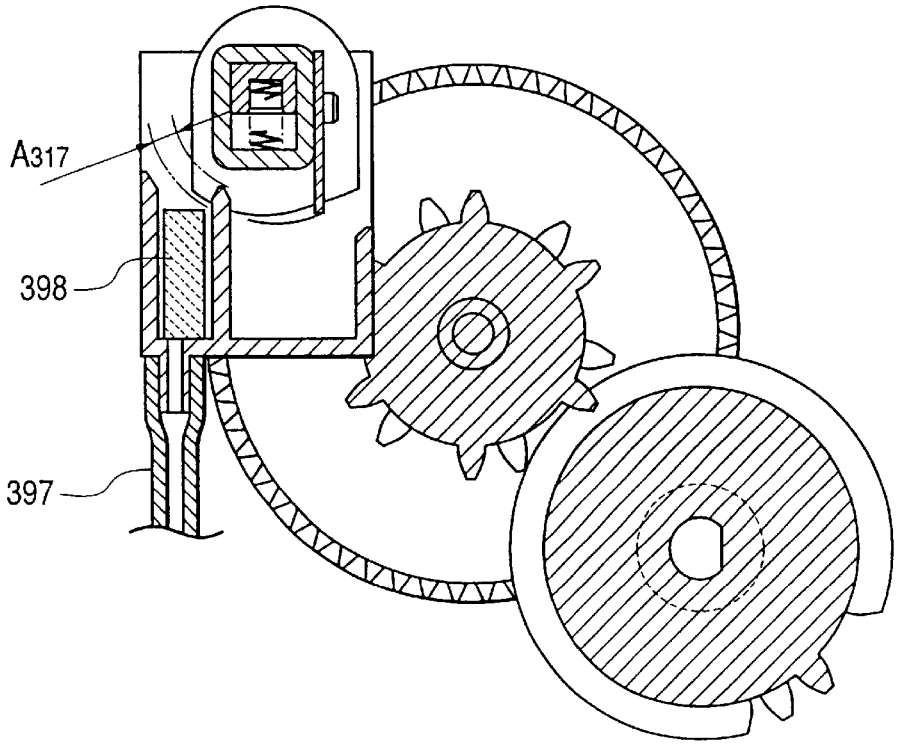
FIG. 41 is a schematic view of a configuration of sucking waste ink from a cleaner blade.

In addition, in the case where treatment by replacement is difficult due to abundant ink quantity stayed in the blade cleaner 307, as shown in FIG. 40 and FIG. 41, it may be operated that a cleaner tube 397 connected to the pump tube 325 is connected to the bottom face of the container part of the blade cleaner 307 and suction is performed if necessary to collect properly ink absorbed and held by the cleaner absorbent 398 installed inside the blade cleaner 307 and discharge to a waste ink process means. According to this, a user is free from annoyance by processing of ink stayed in the blade cleaner 307 in a life of a product. Explanation of the valve mechanism in this case is omitted. The configuration thereof is same as the configuration shown in the FIG. 32. According to the configuration, in the status in which the suction valve 323 and the predischarge valve 321 are closed, when the cleaner valve 399 is opened to work the pump, ink in the blade cleaner 307 can be collected.

Next, an actuating mechanism of the wiping means will be described below. In FIG. 38, the configuration is as that a tooth 354, illustrated by shadowing, among teeth of the blade intermittent gear 151 is engaged with only the tooth 354, illustrated by shadowing, among teeth of the blade trigger gear 352 and the tooth 355, illustrated without shadowing, among teeth of the blade intermittent gear 351 is engaged with only the tooth 355, illustrated without shadowing, among teeth of the blade trigger gear 352.

Consequently, while the disk-like part, which is a large part of teeth, without shadowing, in the blade trigger gear 352, is engaged with the blade intermittent gear 351, the blade intermittent gear 351 is in the status of stop and non-rotatable and the wiping means has stopped in the status in which the blade 303 is positioned downward, namely, not working. When the blade trigger gear 352 rotates, gears mesh each other and the wiping means, as shown in the FIG. 39, rotates in the direction of the arrow $A_{314}$ to return to the status shown in the FIG. 38 again.

In the embodiment, the blade trigger gear 352, the predischarge valve cam 330, the suction valve cam 341, and the cap lever cam 350 are firmly attached to an identical shaft (hereafter, camshaft). During the blade trigger gear 352 rotates 360 degrees, the blade intermittent gear 351 is engaged with the blade trigger gear 352 merely in a rotation angle of 45 degrees in the predetermined phase to rotate. The blade gear presents a speed-increasing ratio of 8 times the blade trigger gear 352. In other words, during rotation of only 45 degrees in a certain phase in 360 degree-rotation of the camshaft, the wiping means rotates continuously 360 degrees, and stops in the status in which the front end of the blade 303 faces downward during remained 315 degree-rotation of the camshaft. As described above, the configuration is as that because it is always in status of sopping in other statuses than wiping and wiping face (a face abutting against the nozzle formation) thereof faces to the opposite direction to t he envelope carrying space and the predischarge area, paper powder and ink mist driven or any other dust can be suppressed to a minimum quantity.

The actuating system of the recovery system unit 300 is configured by having an idle rotation area only for 55 degrees of the phase angle of the roller guide 327 in the gear row as described above, and in reversing the direction of rotation the roller guide 327 starts rotation delaying only for 55 degrees of the phase angle. Because transmission of actuating force to the camshaft is carried out by placing the e one-way clutch in an intermediate position, configuration is adapted to inhibit transmission of actuating force to the camshaft when the tube pump 324 is being actuated in the direction of generating the negative pressure.

Figure 42:
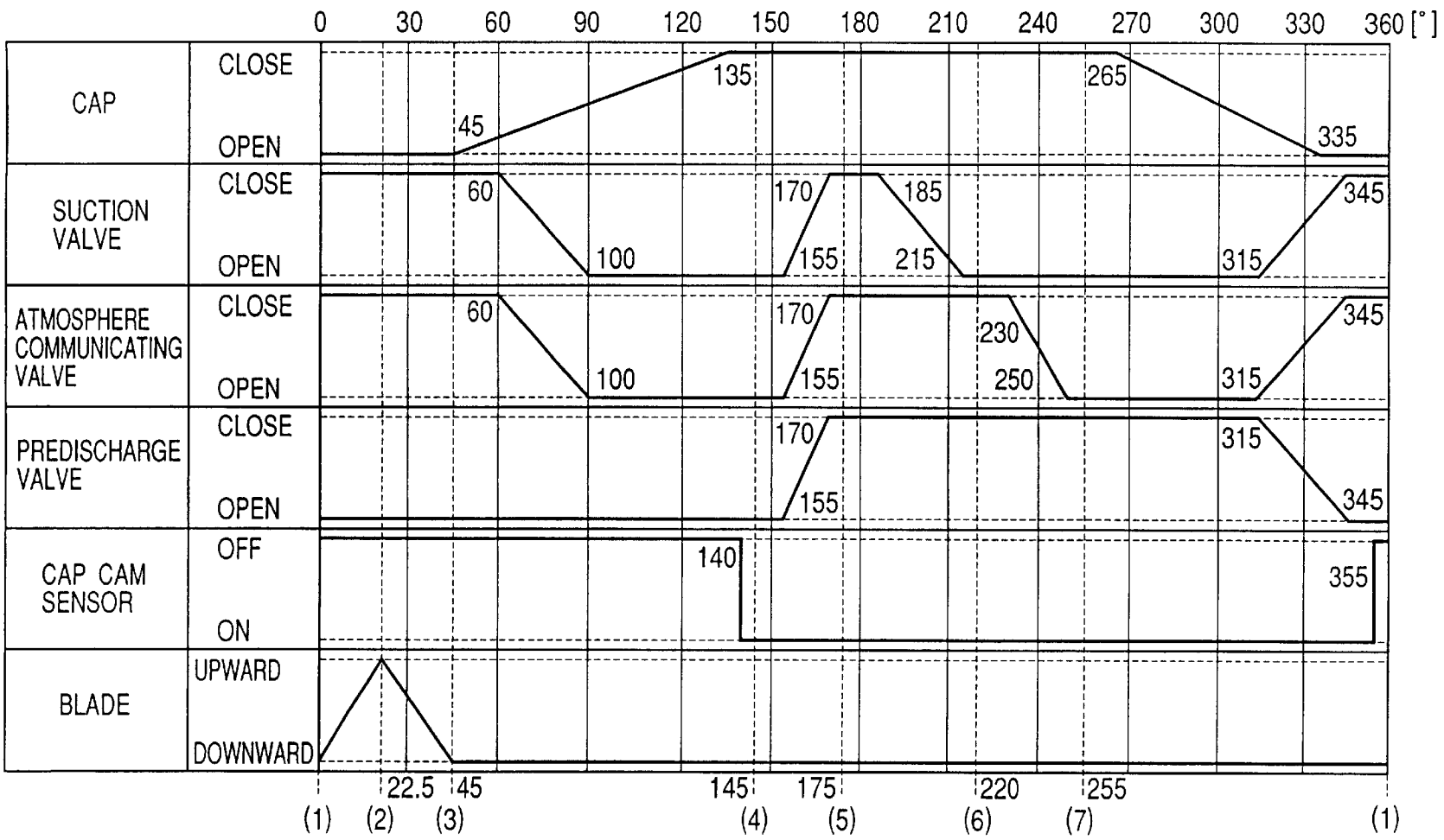
FIG. 42 is a timing chart showing an operation of each member in association with a cam.
Figure 43:
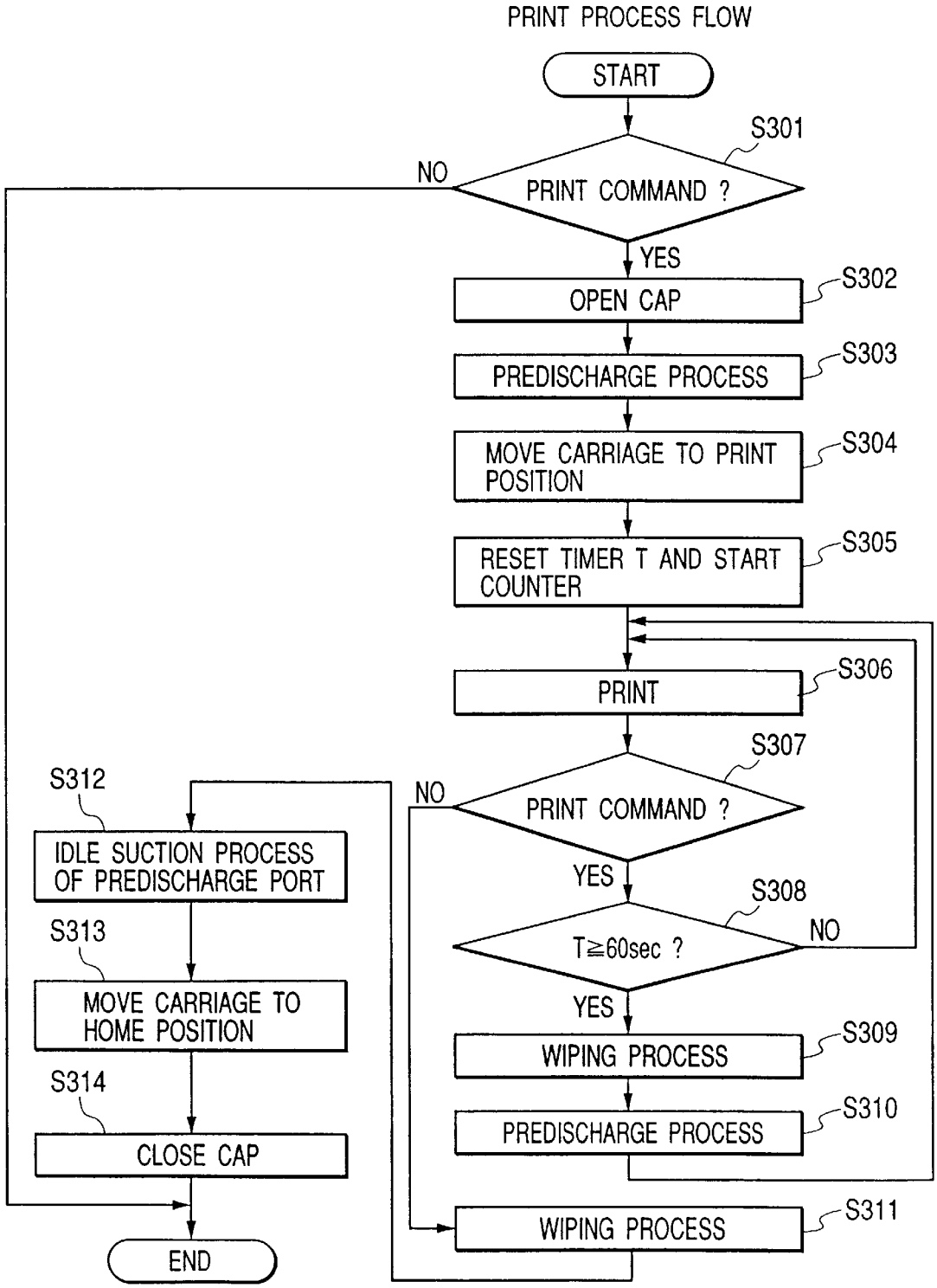
FIG. 43 is a flow chart showing a printing process.

Next, the series of process actions of the recovery system unit 300 will be described with reference to FIG. 42 showing the camshaft and FIG. 43 to FIG. 47 being flow charts. Figures put between parentheses in the following description represent the cam position shown in FIG. 42.

First, the action of the recovery system unit 300 in printing will be described below. When a printing command is issued in step S301, a motor starts rotation in a counterclockwise direction of the FIG. 28 in step S302 to rotate the camshaft and open the cap 308 to make the status of (1).

Figure 44:
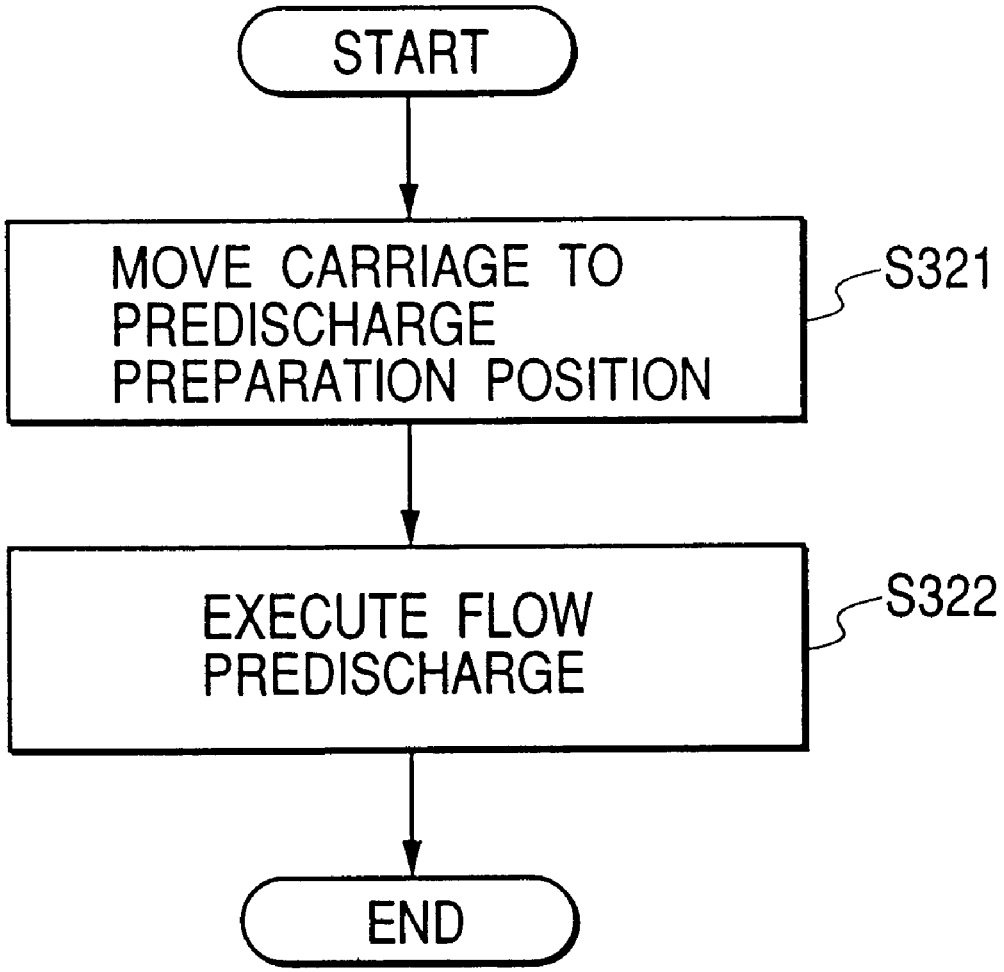
FIG. 44 is a flow chart showing a predischarge process.
Figure 45:
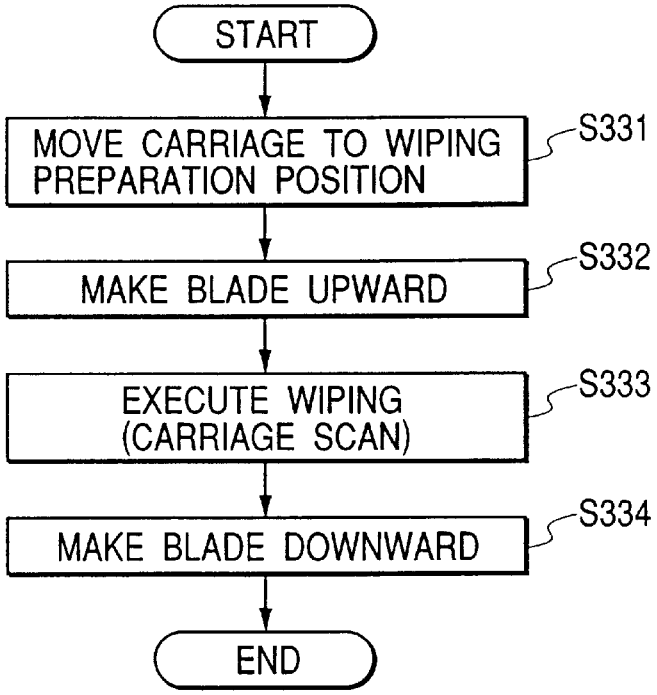
FIG. 45 is a flow chart showing a wiping process.
Figure 46:
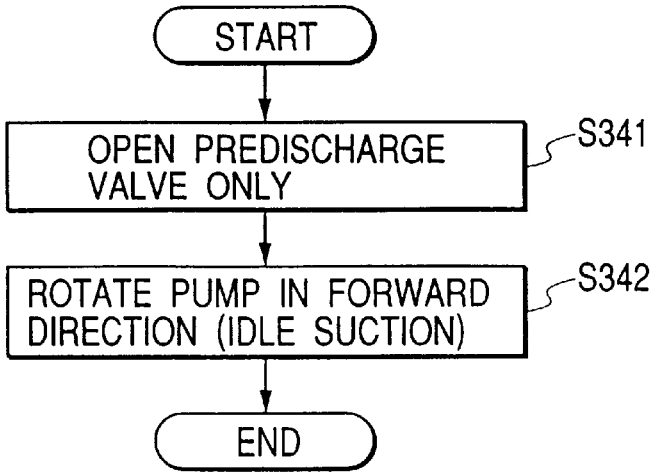
FIG. 46 is a flow chart showing a suction process of a predischarge port.
Figure 47:
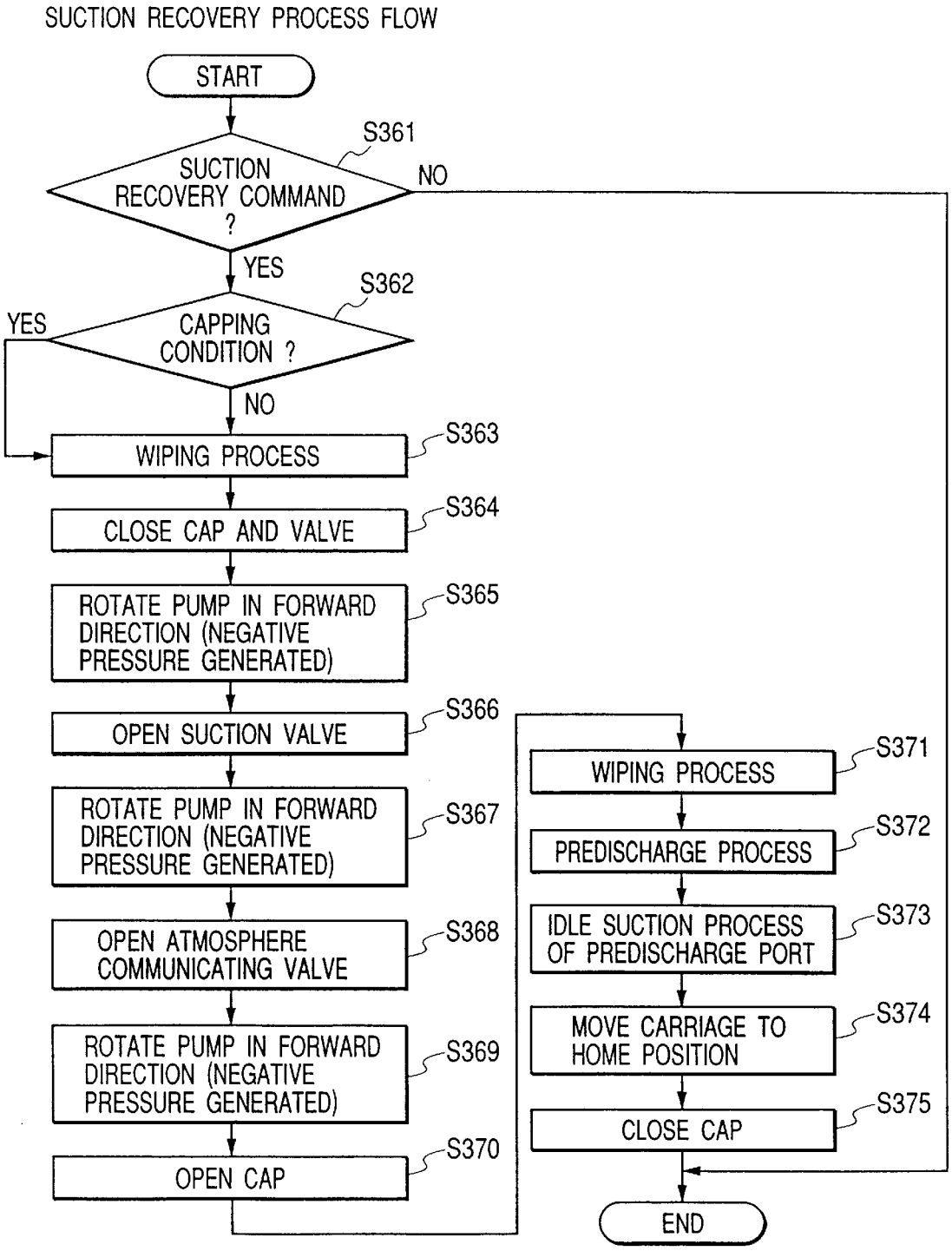
FIG. 47 is a flow chart showing a suction recovery process.

Next, in order to operate predischarge, the predischarge process shown in FIG. 44 is executed. In the predischarge process, the carriage 200 is moved to predischarge preparation position in step S321 and subsequently, the flow predischarge process is sequentially executed from the block of the nozzle near the blade 303 in step S322. When predischarge is finished for all nozzles, discharge and the movement of the carriage 200 stop to finish the predischarge process. For reference, in the flow predischarge, discharge of ink may be not always operated scanning by the carriage 200 as described above, but discharge may be operated in the status of stop caused by intermittent stopping.

Next, in step 304, by moving the carriage 200 to any of the envelope or the continuous paper (tape) and in step S305 a timer T is reset to start counting. In step 306, to the printing medium carried in, ink is discharged to print in accordance with printing information. If there is no printing command in step S307, go to step S311. In contrast, if there is the printing command in step S307, refer to the timer T in step S308. Here, if the timer T is 60 sec or less, return to step S306 to print again. However, if the timer T is 60 sec or more, step S309 executes the wiping process shown in FIG. 45 to wipe ink attached to the nozzle face 401*a*, For the wiping process, the carriage 200 is moved to the wiping preparation position in step S331. Subsequently, in step S332, the motor is turned to the counterclockwise direction to shift from the status (1) to the status (2), in other words, the status in which the front end of the blade 303 faces to downward direction (refer to FIG. 38) to the status in which it faces to upward direction which is the direction capable of wiping (refer to FIG. 39). Next, in step S333, the carriage 200 is scanned to execute wiping. Here, the speed of scanning by the carriage is not always constant, but for instance, modification is allowed in accordance with kinds of ink. After an entire area of the nozzle face 401*a* of the liquid jetting head unit 401 is wiped by the blade 303, the carriage 200 stops, the motor is rotated in the counterclockwise direction in step S334 to store the wiping means in the status of (3), in other words, put the blade 303 in downward direction, and finish the wiping process.

Next in step S310, in order to discharge dried ink or ink of a different kind, which may be pushed into the nozzle by the wiping process, the predischarge process is executed. By no printing command, step S311 executes the wiping process as the finishing operation in printing to remove ink on the nozzle face 401*a* followed by step S312 which discharges ink stayed in the predischarge port toward the waste ink process means, not illustrated, by execution of the predischarge idle suction process shown in FIG. 46.

In step S341, the motor is rotated in the counterclockwise direction to make the status of (3). Subsequently, in step S342 the motor is rotated in the clockwise direction in the predetermined rotation angle to actuate the pump and ink in the predischarge port is discharged to the waste ink absorbent through the pump tube 325 to finish the predischarge idle suction process. For reference, the predetermined rotation angle is the angle in which the quantity of ink stayed in the predischarge port or the tube can reliably reduce to the quantity which does not cause a malfunction in the liquid jetting head unit 401 or the recovery system unit 300.

Next, in step S313 the carriage 200 is moved to a home position S, namely, a capping position, in step S314 the motor is rotated in the counterclockwise direction to make the status of (4), in other words, capping status, to finish the printing process. The rotation angle in this stage is 100 degrees and thus, larger than the summed angle of a delayed angle 55 degrees of a pumping action and a rotation angle of 40 degrees, which is necessary for that the roller 326 makes the pump tube 325 from squeezed status to opened status. The pump in stand-by (capping status) becomes the status shown in the FIG. 31.

Next, the suction recovery process, which is executed automatically or manually in the case where ink in the nozzle has firmly attached due to a long time no use of the liquid jetting head unit 401 or no discharge caused by a bubble presented, will be described below.

First, in step S361 a suction recovery command is received and then, in step S362 detects the status of the printing apparatus is detected. Here, capping is being executed in stand-by status, i.e. the status of (4), and then, the printing apparatus goes to step S364. If not so, goes to step S363 to execute the wiping process followed by capping in step S364 to make the status of (4) and further the motor is rotated in the counterclockwise direction to make the status of (5) in which all valves are closed. Next, step S365 rotates the motor in the clockwise direction to actuate the pump and the pressure is reduced in the tube from valves of three kinds (5 in total) to the pump (2 in total) to the predetermined value. Next, in step S366 the motor is rotated in the counterclockwise direction to make the status of (6) in which only the suction valve is opened to give the negative pressure to the inside of cap. Here, up to reaching the statuses from (5) to (6), the pump actuating system tries to rotate the pump only for 45 degrees in the direction of $A_{310}$. However, as described above, the configuration is as that the roller guide does not rotate until 55 degrees which is the idling area and therefore, the pump is not actuated. Thus, the pump tube 325 is squeezed by the roller 326 to keep the status closed.

Here, if the ink of the predetermined quantity necessary for removal of dried ink, the bubble in the nozzle, and the like can be sucked, sucking action may be finished. However, in this embodiment, additional sucking is executed by assuming as the sucked quantity is lacking. In step S367, the motor is rotated again in the clockwise direction to actuate the pump and the negative pressure is generated to carry out sucking. When the sucked quantity reaches the predetermined quantity, in step S368 the motor is rotated in the counterclockwise direction to make the status of (7) to open the atmosphere communication valve and open the cap 308 for atmosphere to stop sucking. Subsequently, in step S369 the motor is rotated in the clockwise direction to actuate the pump to discharge ink inside the cap 308, the atmosphere communication tube 339, the cap tube 338, and the pump tube 325 toward the wasted ink process means. Next, in step S370 the motor is rotated in the counterclockwise direction to make the status to cap open, namely, (1), to execute the wiping process in step S371, the predischarge process in step S372, the predischarge idle suction process in step S373 and finally, after the carriage is moved to the home position S in step S374, in step S375 the motor is rotated in the counterclockwise direction to operate capping to complete the suction recovery process.

A cap cam sensor presented in FIG. 42 is configured by a photo-interrupter of which flag is the cap cam, not illustrated, firmly attached to the camshaft and is a sensor capable of detecting the phase of the cam and the like firmly attached to the camshaft on the basis of the result of detection thereof. Here, detection timing of the cap cam sensor is set to immediately before cap open and cap close. This setting was determined because in the time of cap open, a force, which rotates the cap lever cam 350 in the counterclockwise direction in FIG. 36, is given to the cam follower 311*a* integral with the cap lever 311 and then, the cap lever cam 350 overruns in the direction, in which the one-way clutch idles, to cause possibly a phase shift by action of the cap spring having a spring force of about 800 gf in total in the embodiment. In contrast, the setting was determined also because in the time of cap close, the most heavy load is given to the camshaft and then, there is a fear of pulling out of synchronism of the motor for actuating the recovery system unit configured by a stepping motor. The setting was determined to control the cam always in a correct phase by correcting the phase shift caused by the above described reasons.

[Liquid Jetting Head Hnit]

Figure 48:
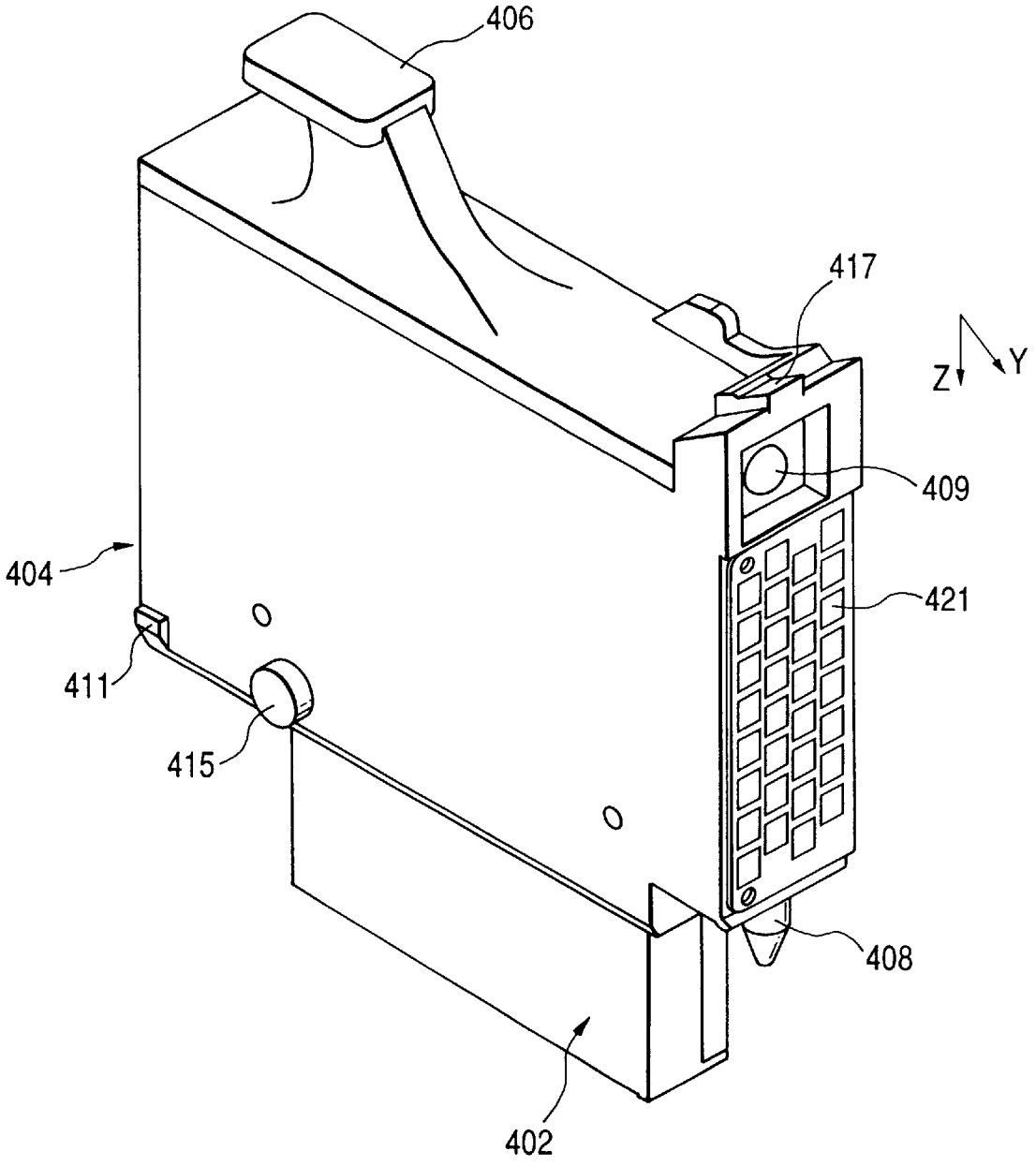
FIG. 48 is a perspective view of a liquid jet head unit.
Figure 49:
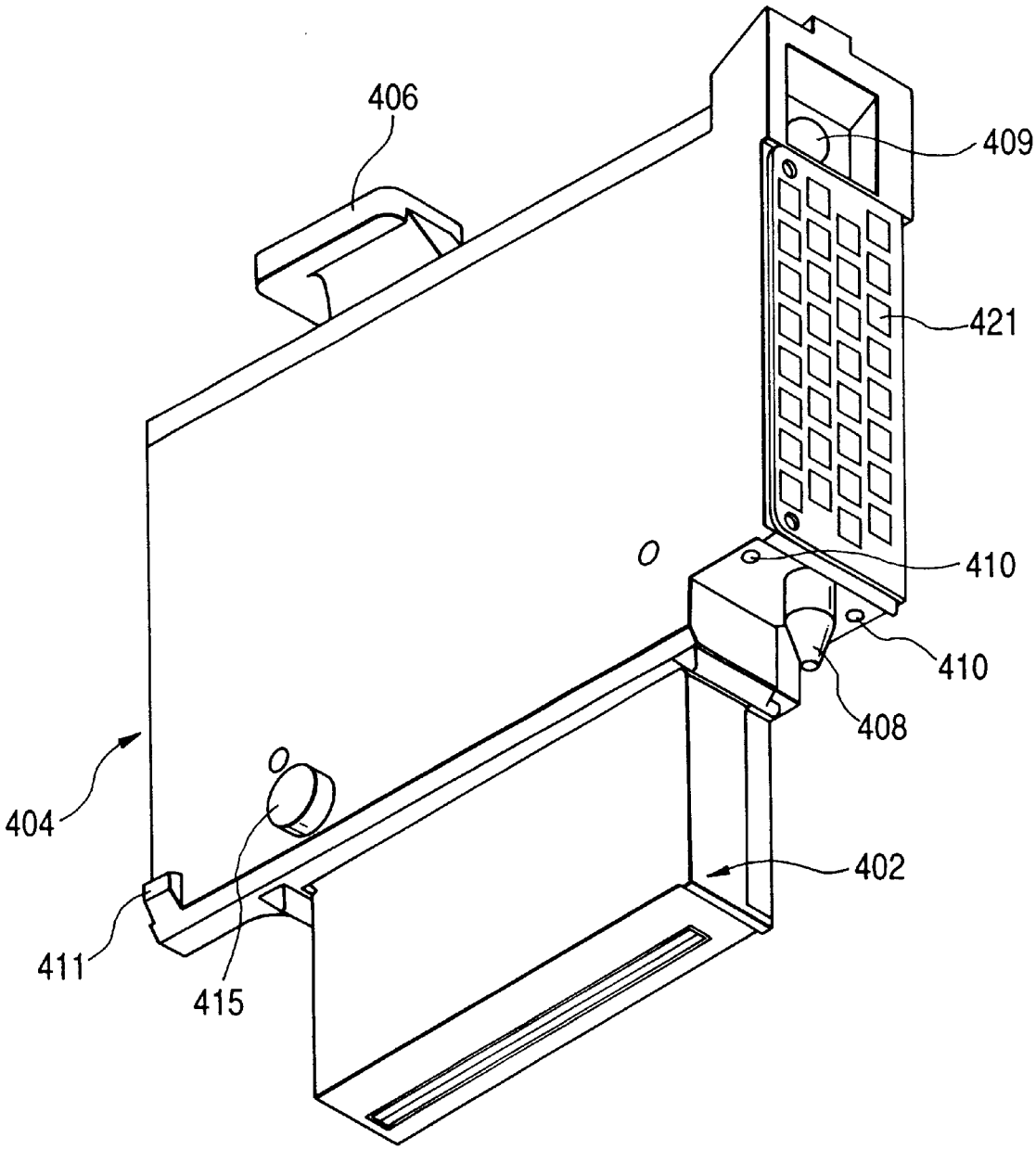
FIG. 49 is a perspective view of a liquid jet head unit.
Figure 50:
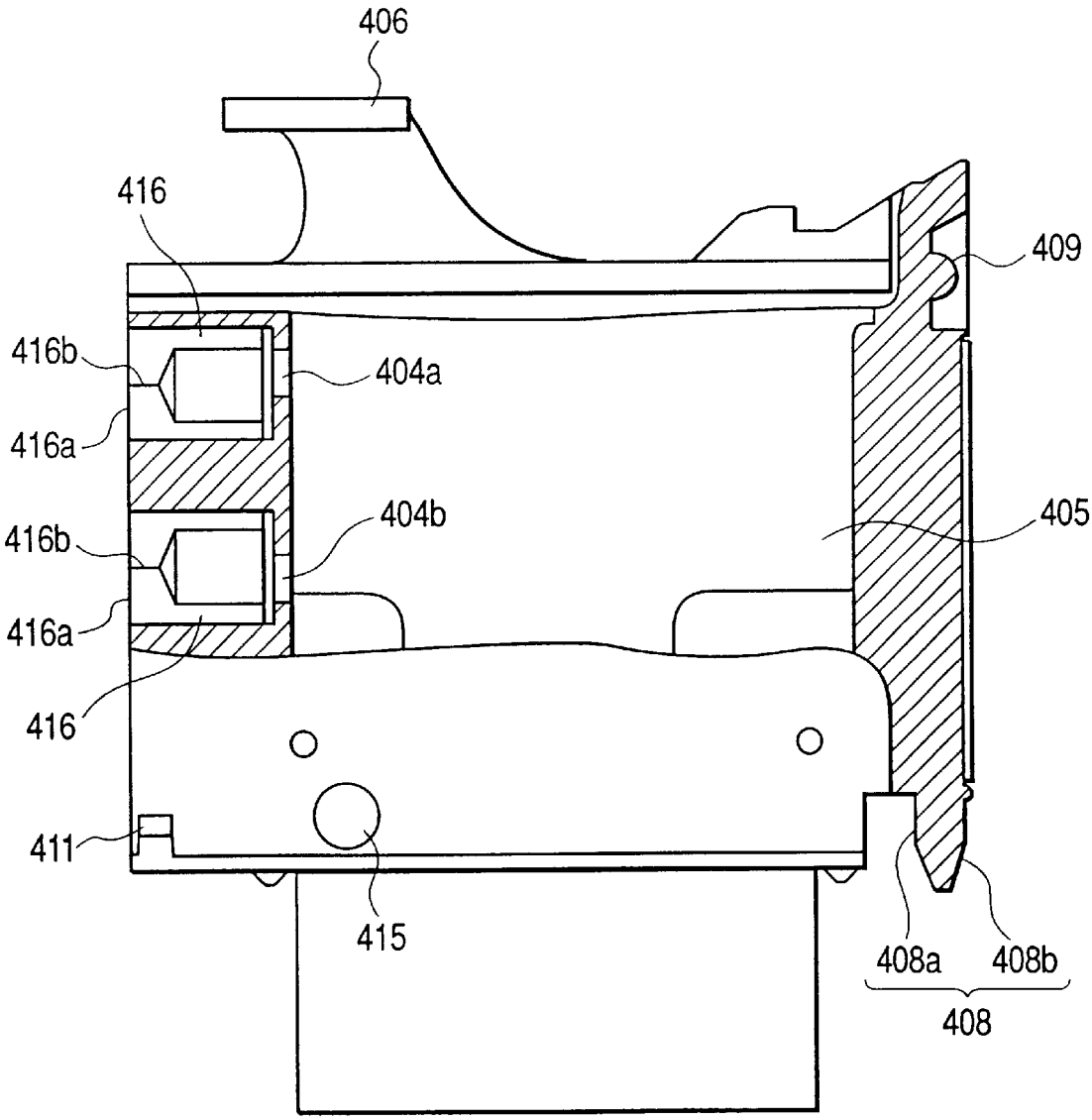
FIG. 50 is a sectional view of a liquid jet head unit.

FIGS. 20, 48 to 50 are figures showing a configuration of the liquid jetting head unit 401 and FIGS. 20, 48, and 49 are external perspective views and FIG. 50 is a partial sectional view.

The liquid jetting head unit 401 of this embodiment is configured by a liquid droplet discharge member (this is so-called liquid jetting head and hereafter, head chip) 402 to discharge a liquid droplet according to a print signal arrived from the nozzle row formed by making a row of the discharge port (nozzle) to discharge the liquid droplet, a sheet wiring member 403 such as a flexible cable and TBA by which an electric wiring is operated for receiving and sending of the print signal transmitted from and to a main body of a printing machine, and a unit frame body 404 having an ink reservoir to store an liquid such as ink and the like, which is supplied to the head chip 402, and holding the head chip 402.

The head chip 402 is fixed to the unit frame body 404 by welding of a positioning boss 404*a* or a thread 451 and adapted to be easily separated each other.

Inside the unit frame body 404, a second common liquid chamber 405 capable of storing ink of the predetermined quantity is installed. Ink stored in the second common liquid chamber 405 is supplied to the head chip 402, and supplied to the nozzle part through the ink path of a chip tank 603 described later and a first common liquid chamber 605*a* of a top board 605.

The handle 406 installed in the upward position of the liquid jetting head unit 401 becomes a standard for attaching and detaching the liquid jetting head unit 401 to and from the carriage 200.

Positioning site groups 408 to 411 are used for mounting the liquid jetting head unit 401 in the predetermined position in the carriage 200, and contain a cylindrical guide pin 408 installed on the bottom face of the liquid jetting head unit 401 and a spherical projection 409 installed on the back face of the liquid jetting head unit 401. The center of the spherical projection 409 is installed on an extension of the central line of the cylindrical part of the guide pin 408. When the internal cylindrical wall 408*a* of the guide pin 408 and the spherical projection 409 are installed in the predetermined position of the carriage 200, respectively, the liquid jetting head unit 401 in the vertical direction is positioned against the printing medium. A tapered face 408*b* of the front end of the guide pin 408 becomes a guide for inserting the guide pin 408 in the predetermined position.

When the spherical projections installed on two places of the bottom face of the liquid jetting head unit 401 are abutted against the predetermined position in the carriage 200, the liquid jetting head unit 401 is positioned in a height direction.

By the trapezoid projection 411 located in the side face of the liquid jetting head unit 401, positioning in the direction of side face of the carriage 200 and positioning in the direction of slope of the liquid jetting head unit 401 (and a row of discharge ports) are operated. In other words, slope of the liquid jetting head unit 401 on a line, which connects the center of the guide pin 408 and the center of the spherical projection 409, as a fulcrum is adapted to change according to variation of the height of the trapezoid projection 411.

The cylindrical projection 415 located on the side face of the liquid jetting head unit 401 is adapted to be that when the liquid jetting head unit 401 is inserted in the carriage 200, the front end of the guide pin 408 is guided to the predetermined position by tilting of the liquid jetting head unit 401 by an inserting guide for tilting forcedly the liquid jetting head unit 401.

When the front end of a CR needle 222 is inserted from the surface of a joint rubber 416 to penetrate through the second common liquid chamber 405, ink is supplied from a main tank 501, which is located in an upstream of the CR needle 222 and connected to the CR needle 222 by connection means such as the tube, to the inside of the second common liquid chamber 405.

The joint rubber 416 has a closed hole 416*b* formed by penetrating an acicular member from the surface side 416*a* to the opposite face side. This joint rubber 416 is press-fitted to the hole part, which is formed in a smaller inner diameter size than an outer diameter size of the joint rubber 416. By such press-fitting, the closed hole 416*b* receives a compression load from an outer circumferential part of the joint rubber 416 and thus, in no insertion of the CR needle 222, inside of the second common liquid chamber 405 can be keep in a closed status. When the CR needle 222 is inserted, a grip force (the compression force given from the outer circumferential part) works against the CR needle 222 and thus, excluding a hollow part of the CR needle 222, a joint part can be perfectly sealed.

The joint rubbers 416 are located in top and bottom. The bottom part is used as a supply path for supplying ink from the main tank 501. Ink is supplied to the inside of the second common liquid chamber 405 through downward CR needle 222 and the hole 404*b*, On the other hand, the top part is an aspiration path for releasing air stored in the inside of the second common liquid chamber 405 to outside the liquid chamber to regulate the negative pressure in the liquid chamber. Air is discharged outside the second common liquid chamber 405 through the hole 404*c* and upward CR needle 222 by such aspiration actuating mans as the pump.

By increasing the negative pressure of the inside of the second common liquid chamber 405 caused by the aspiration path, ink supply in the second common liquid chamber 405 can be regulated.

A slope receiving face 417 is the part to receive the load acting from the carriage to the liquid jetting head unit 401. When the slope receiving face 417 receives the load, partial forces of the direction of the arrow Z and the direction of the arrow Y occur according to the shape of the slope to press the liquid jetting head unit 401 toward the two directions.

A contact pad 421 carries out receiving and sending of the print signal transmitted between the head chip 402 and the main body of the printing machine.

[Configuration of the Chip]

Next, the configuration of the liquid jetting head unit 401 as described above will be explained in more detail.

Figure 63:
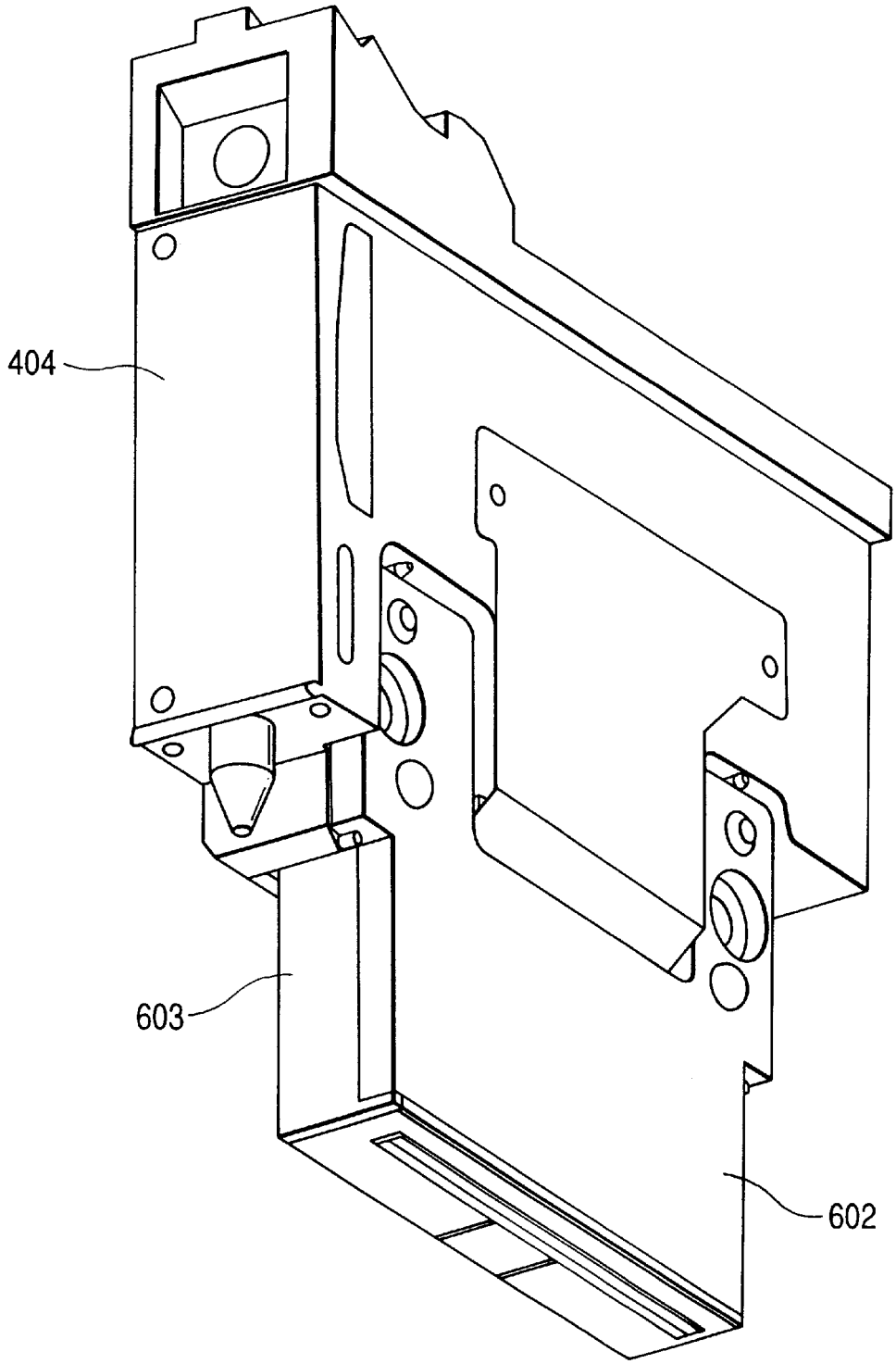
FIG. 63 is a perspective view of a liquid jet head unit in accordance with an embodiment of the present invention.
Figure 64:
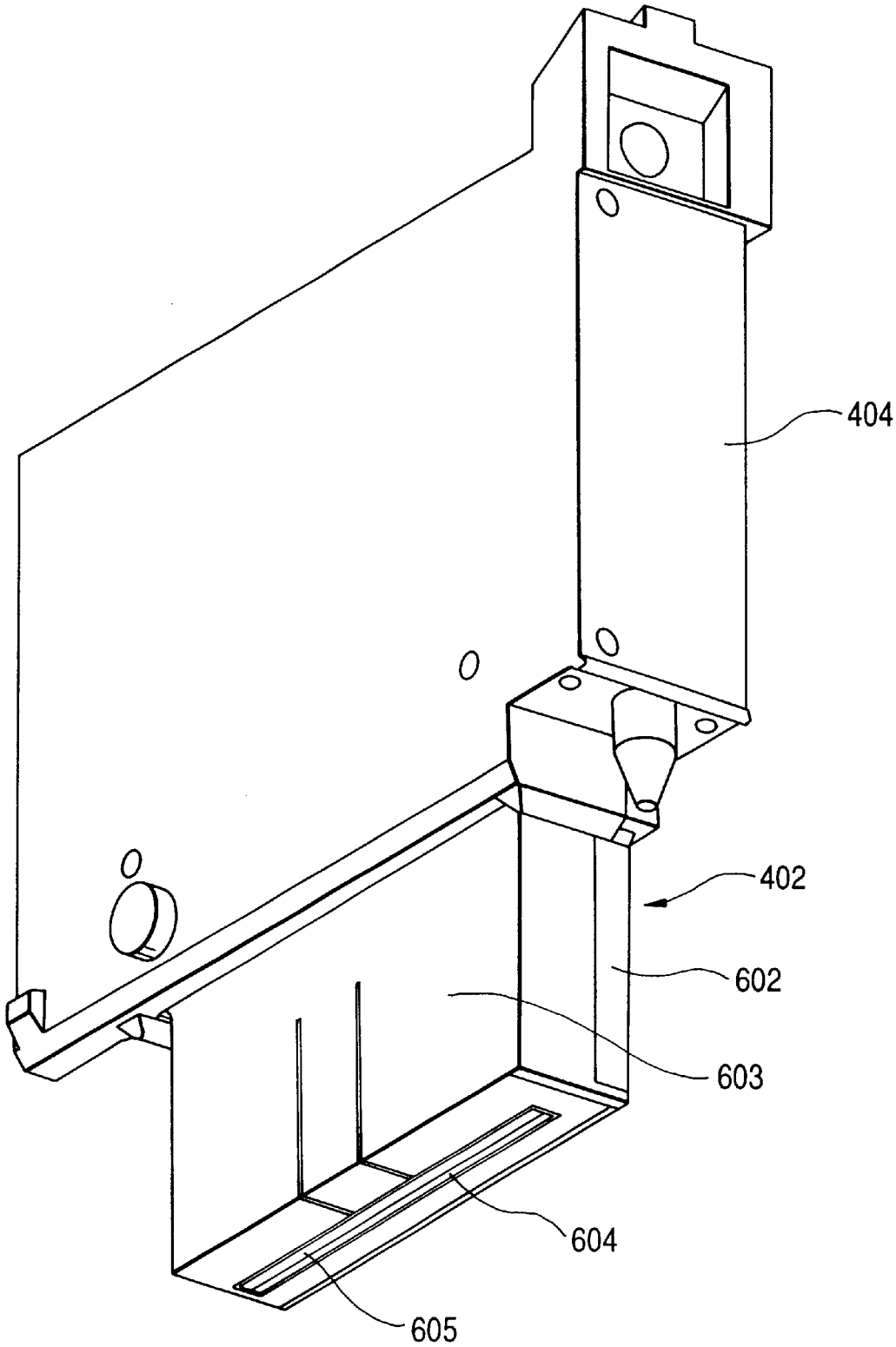
FIG. 64 is a perspective view of the liquid jet head unit of FIG. 63, as seen from the different direction.
Figure 65:
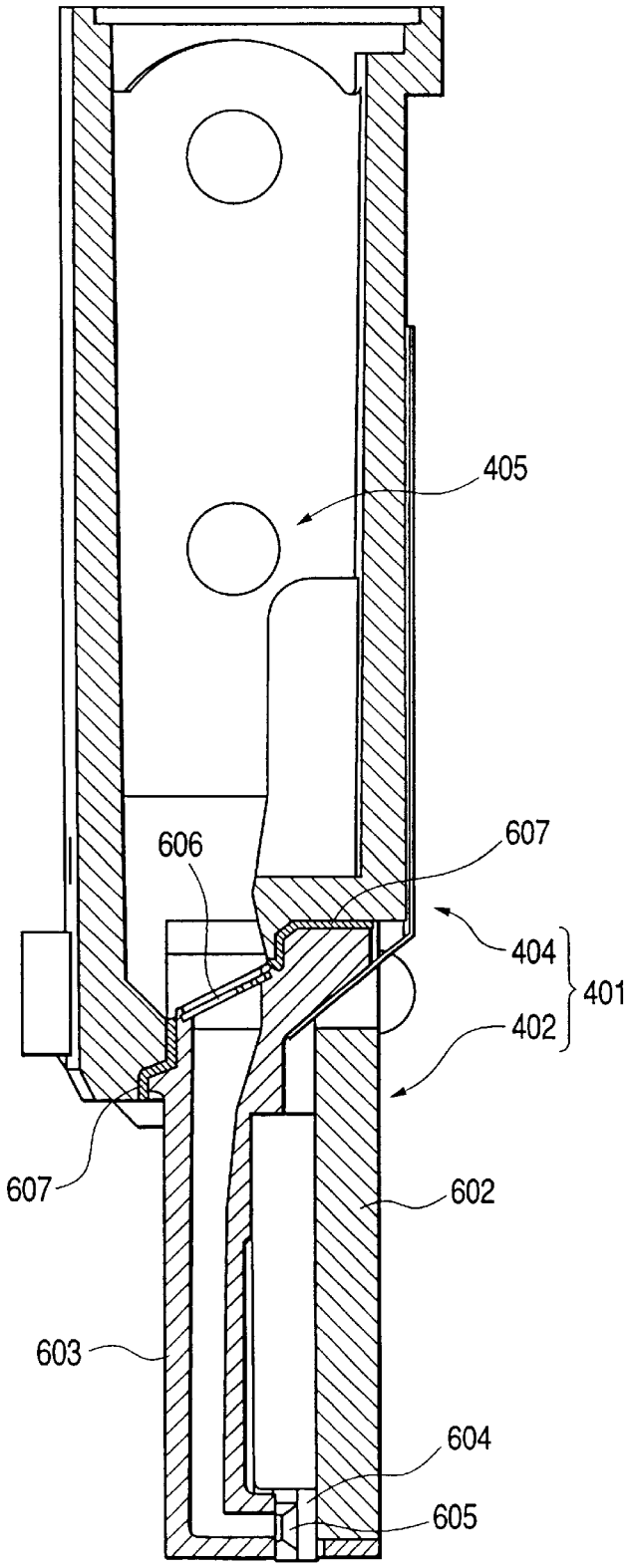
FIG. 65 is a vertical sectional view of the liquid jet head unit of FIG. 63.
Figure 66:
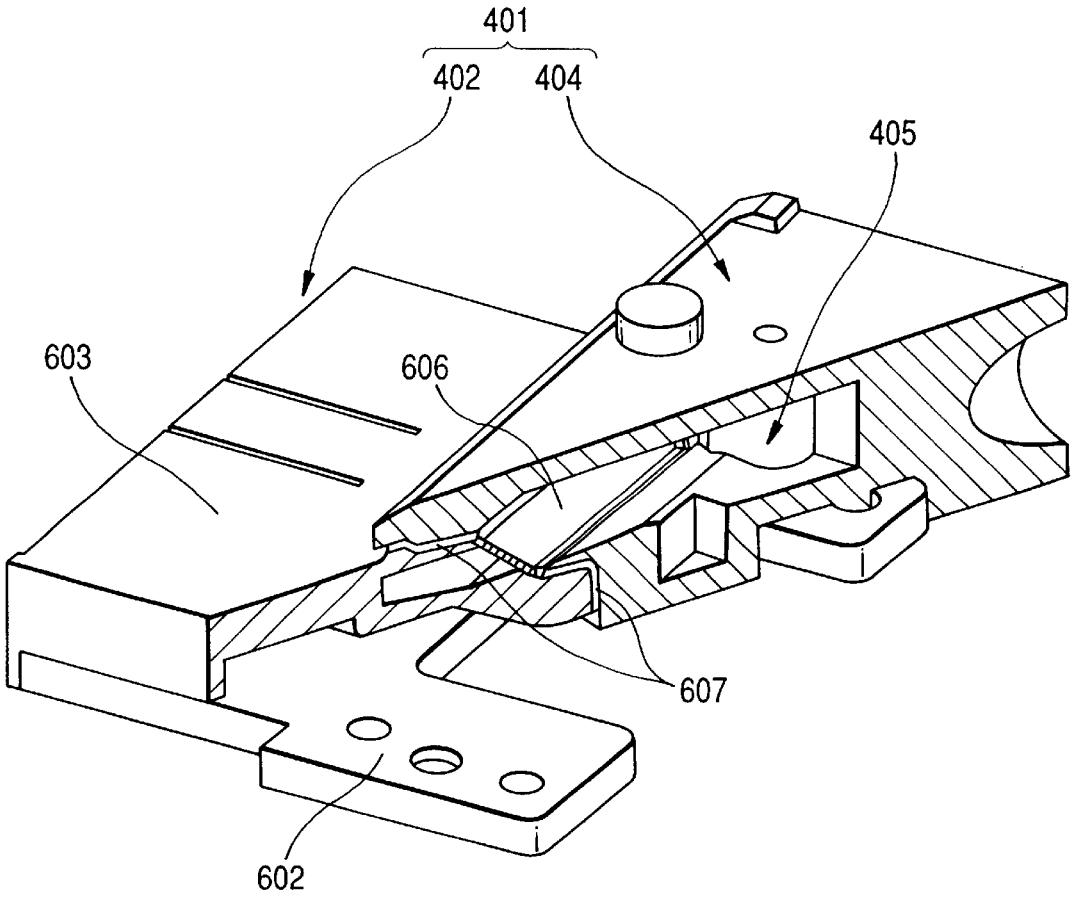
FIG. 66 is a perspective view of the liquid jet head unit of FIG. 63, showing a tip tank and a second common liquid chamber partially in section and partially broken away.
Figure 67:
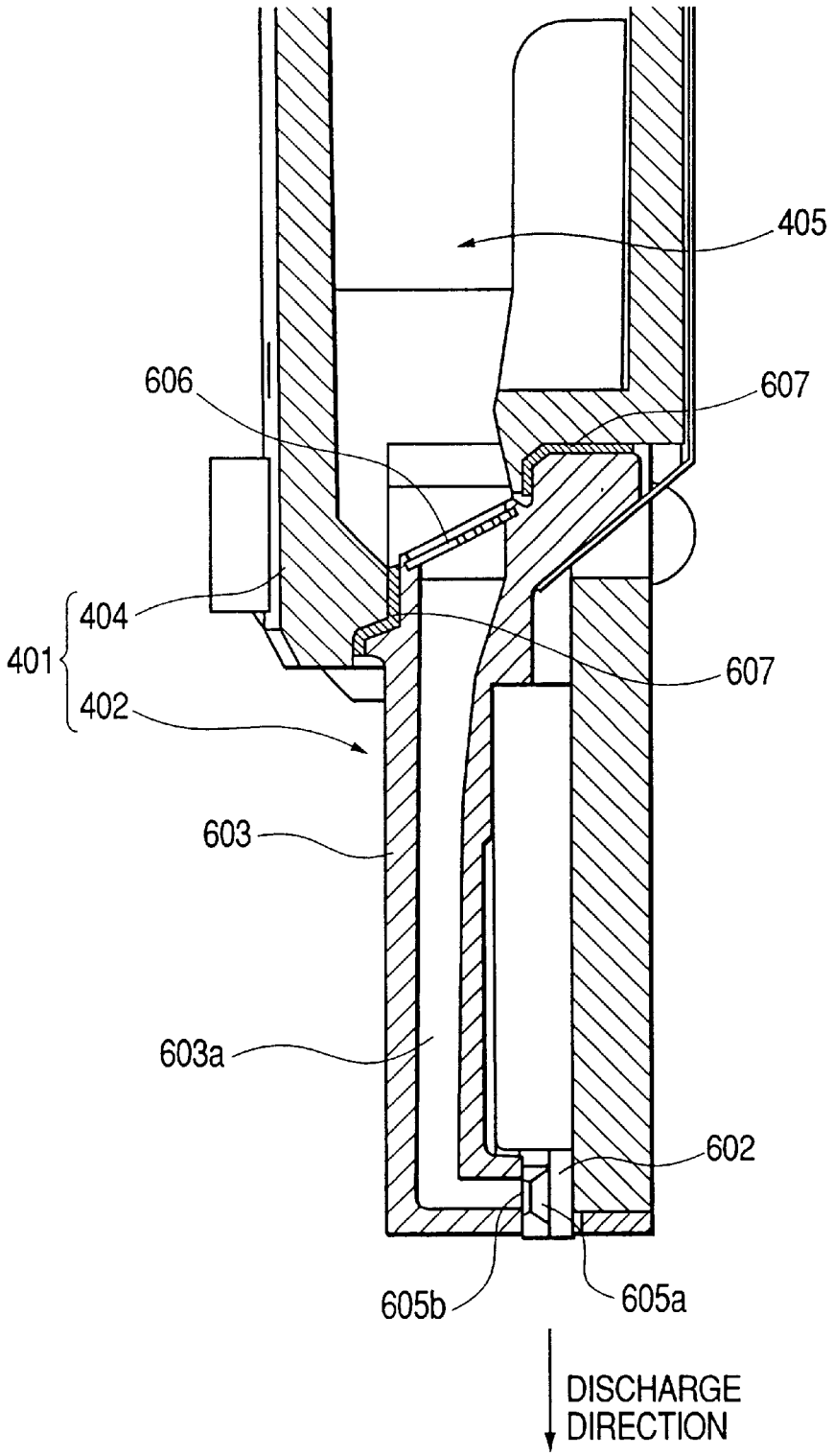
FIG. 67 is an enlarged sectional view of the connecting portion of the tip tank and the second common liquid chamber of the liquid jet head unit of FIG. 63.

FIG. 63 is the figure of the perspective view showing the liquid jetting head unit 401 of the embodiment, FIG. 64 is the figure of the perspective view from another direction, and FIG. 65 is the figure of a longitudinal view thereof. In addition, FIG. 66 is the perspective view showing the liquid jetting head unit 401, shown in the FIG. 63, in the status in which a part of the chip tank 603 and the second common liquid chamber 405 have been broken. FIG. 67 is a sectional view showing enlarged connection parts of the chip tank 603 and the second common liquid chamber 405.

The head chip 402 of the liquid jetting head unit 401 of the embodiment is configured by attaching a device substrate 604, in which a row of discharge energy-generating devices (not illustrated) for applying an energy for discharge to a print liquid (ink and the like) is installed in the flow path, the top board 605 forming the flow path opposite thereto, and the chip tank 603, which is a supply member to supply the printing liquid to the flow path, to the standard member 602 in the status of correctly positioned each other. Furthermore, the unit frame body 404 of the liquid jetting head unit 401 has the connection part to send a supply liquid to the chip tank 603 and the connection part to release air in the liquid chamber and the second common liquid chamber 405 to store the printing liquid temporarily or up to exhausted. The chip tank 603 of the head chip 402 has a porous member 606, which is located in a boundary part against the second common liquid chamber 405 and has microscopic pores to trap impurities contained in the printing liquid. In the connection part between the second common liquid chamber 405 and the chip tank 603, filler 607 consisting of silicon rubber has been filled.

Here, the above described respective configurations will be explained in further detail.

The second common liquid chamber 405 takes a role of a buffer to store the printing liquid. When the printing liquid is consumed by discharge, the printing liquid is properly supplied from the second common liquid chamber 405 to the first common liquid chamber 605*a* (refer to FIG. 67) comprising the top board 605 and the device substrate 604. The second common liquid chamber 405 has the connection part to receive the printing liquid from the tank installed separately for storing the printing liquid and the connection part to release air in the liquid chamber toward the outside.

The chip tank 603 has a function of the flow path to supply properly the printing liquid from the second common liquid chamber 405 to the first common liquid chamber 605*a* (refer to FIG. 67.)

The porous member 606 is located between the second common liquid chamber 405 and the chip tank 603 and takes a role to trap impurities contained in the printing liquid. According to the embodiment, the porous member 606 is jointed to the chip tank 603 by welding. Therefore, a gas never invades from the connection part between the chip tank 603 and the porous member 606 to the inside of the flow path.

The chip tank 603 and the top board 605, as shown in FIG. 67, are jointed in the status, in which the printing liquid supply path 603*a* of the chip tank 603 are communicated to the printing liquid supply port 605*b* of the top board 605.

The chip tank 603 is connected to the top board 605 primarily by crimping connecting faces each other and secondarily by hermetic sealing the surrounding of the connecting faces with the filler (not illustrated.)

On the other hand, as described above, an entire circumference of a region between the chip tank 603 and the second common liquid chamber 405 is completely filled with the filler 607. The region from the inside of the second common liquid chamber 405 and the chip tank 603 keeps watertightness. However, the filler 607 consists of silicon rubber and the like having gas permeability and therefore, an outside air can invade into the second common liquid chamber 405 penetrating through the filler 607. The gas invaded into the second common liquid chamber 405 is lifted by buoyancy in the second common liquid chamber 405 to stay in a gas layer of the top part of the liquid chamber. The gas is finally discharged to outside through the connecting part (not illustrated) to release the gas in the second common liquid chamber 405 to outside.

In the embodiment, the connecting part of the chip tank 603 and the second common liquid chamber 405 is located in the upstream side of the porous member 606 in the direction of flow of the printing liquid. Therefore, the gas penetrated through the filler 607 never invades into the chip tank 603 in the downstream side of the porous member 606. Besides, inside the second common liquid chamber 405, even if a solid matter is formed by coagulation of a part of the printing liquid caused by drying, the solid matter can be trapped by the porous member 606.

According to the above described configuration, the gas invaded in the flow path from the downstream side of the porous member 606, namely, the printing liquid supply path 603*a*, to the nozzle of the head chip 402 can be reduced and thus, any effect of the presence of the gas in the flow path from the downstream side of the porous member 606 on a liquid jetting performance can be reduced. In addition, reduction of the gas in the flow path from the downstream side of the porous member 606 allows simplification of recovery work to be operated in start of using the liquid jetting head, which has been left standing for a long time. Therefore, the quantity of the printing liquid sucked and wasted by the recovery operation reduces to improve using efficiency of the printing liquid.

Figure 69:
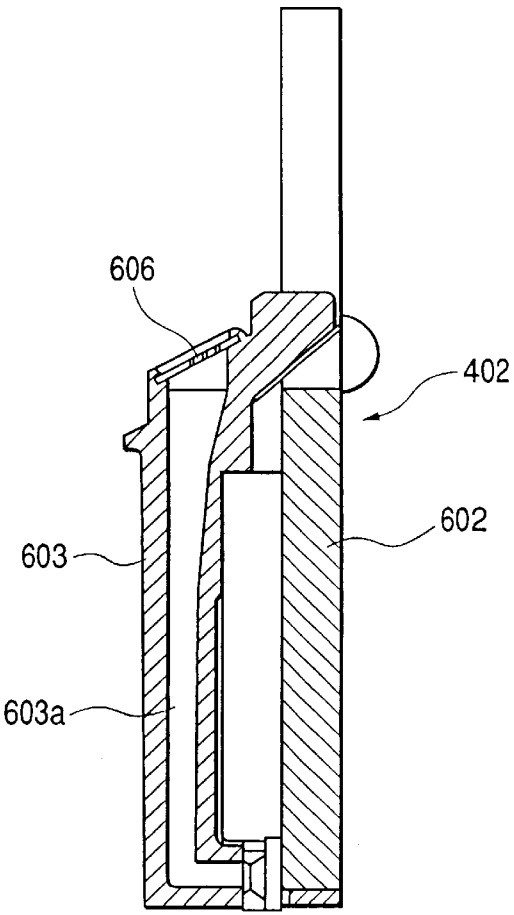
FIG. 69 is a sectional view of the head tip of the liquid jet head unit of FIG. 63.
Figure 68:
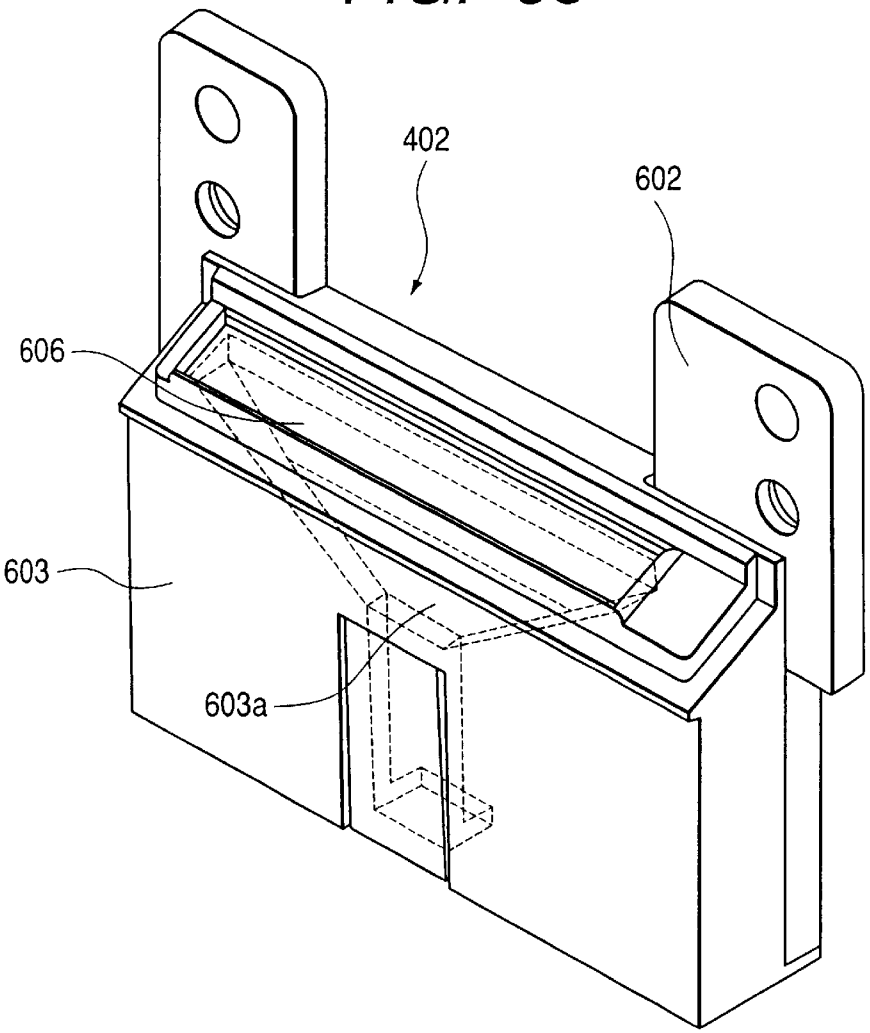
FIG. 68 is a perspective view of the head tip of the liquid jet head unit of FIG. 63.

FIG. 68 is a perspective view showing only the head chip 402 (the status of omission of the unit frame body 404) of the liquid jetting head unit 401 showing in the FIG. 63. FIG. 69 is the sectional view thereof.

As shown in the FIG. 68, an area of a section, which is vertical to the direction of the flow path of the connecting part of the chip tank 603 and the second common liquid chamber 405, of the upstream side of the flow path than the porous member 606, namely, the side of the second common liquid chamber 405 (refer to the FIG. 63 and the like,) is the maximum sectional area among areas of sections in a vertical direction to the direction of the flow path of the printing liquid supply path 603*a*.

The porous member 606 is obliquely arranged to the direction of liquid flow of the printing liquid supply path 603*a* of the chip tank 603. Therefore, the area of the porous member 606 is larger than the area of the section vertical to the direction of the flow path about the connecting part of the chip tank 603 and the second common liquid chamber 405. In the embodiment, the area of the porous member 606 is about 20 times the minimum sectional area of the printing liquid supply path 603*a*.

According to the porous member 606 arranged as described above, the bubble generated in discharge of the liquid and risen through the printing liquid supply path 603*a* is trapped in the top side (the upstream side of the flow path) of the porous member 606 arranged obliquely. On the other hand, the bottom side (the downstream side of the flow path) of the porous member 606 arranged obliquely always contacts with the printing liquid and therefore, flow of the printing liquid, which flows from the second common liquid chamber 405 to the printing liquid supply path 603*a* of the chip tank 603 through the porous member 606, continues without discontinuity. Therefore, the printing liquid of a constant quantity necessary for liquid discharge is supplied to the head chip 402.

The flow of the bubble in the printing liquid supply path 603*a* of the chip tank 603 will be described below with reference to FIGS. 70A to 70C.

Figure 70C:
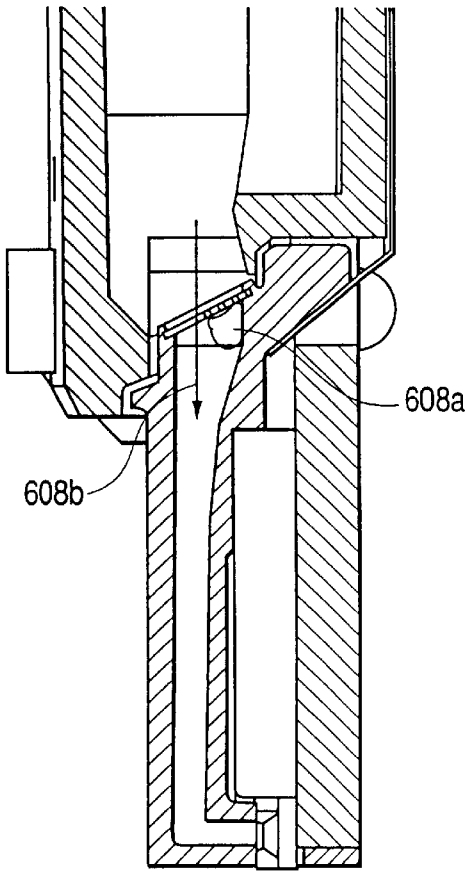
FIGS. 70A, 70B and 70C are sectional views showing a flow of bubbles in a print liquid supplying path of a tip tank step by step.
Figure 70B:
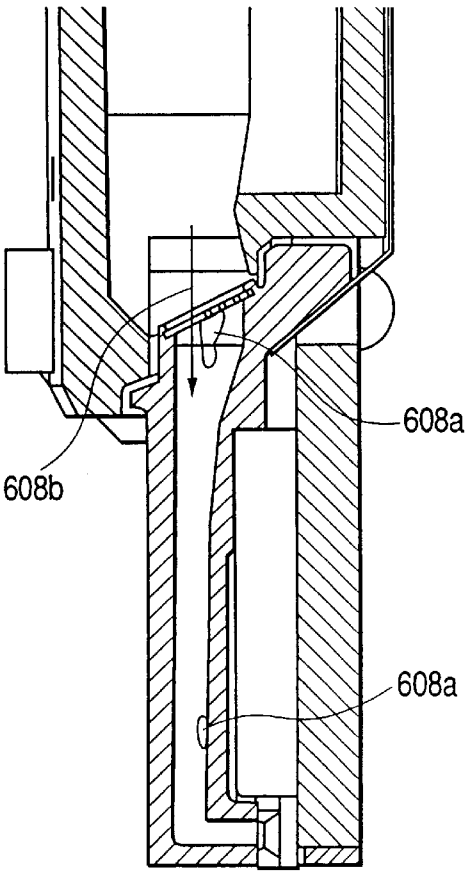
Figure 70A:
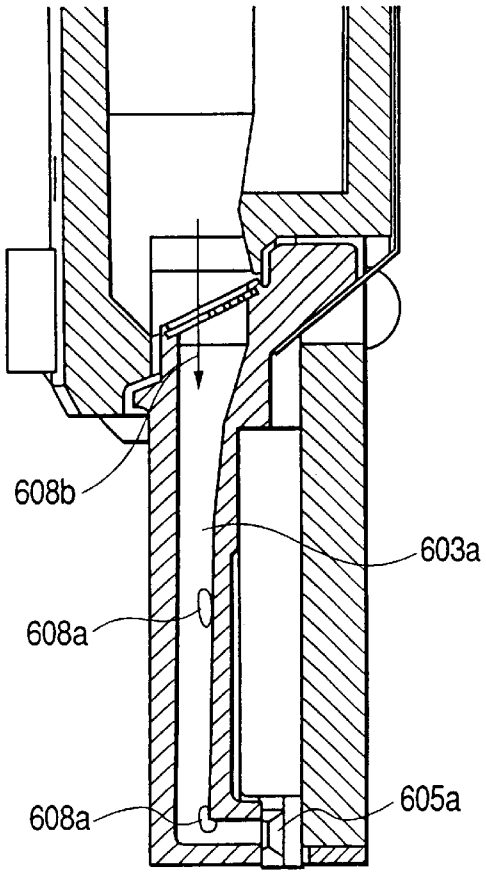

As shown in the FIG. 70A, the bubble 608*a* generated by discharge in the flow path rises in the printing liquid supply path 603*a*, In this time, the bubble 608*a* has not yet reached the porous member 606. Therefore, in the bottom face side of the porous member 606, all regions thereof have contacted with the printing liquid and thus, a full area of the flow path has been kept to allow smooth flow 608*b* of the printing liquid which flows from the second common liquid chamber 405 to the printing liquid supply path 603*a* of the chip tank 603 through the porous member 606.

The bubble 608*a* risen, as shown in FIGS. 70A to 70C, reach the porous member 606. The bubble 608*a* cannot pass through the porous member 606 in relation to a surface tension and therefore, stays in the bottom face side of the porous member 606. Even in this time, the bubble 608*a* has not covered the entire bottom face of the porous member 606. The bubble 608*a* does not grow larger to clog the entire sectional area of the flow path of the printing liquid supply path 603*a* and thus, an enough area of the flow path is kept to ensure the flow 608*b* of the printing liquid.

The bubble 608*a* stayed in the bottom face side of the porous member 606, as shown in FIG. 70C, moves upward to stay along with the porous member 606 located obliquely to the direction of liquid flow of the printing liquid supply path 603*a*, The flow path of the printing liquid of the downstream side of the porous member 606 is kept until the bubble 608*a* covers the entire bottom face of the porous member 606. Up to entire covering, the flow 608*b* of the printing liquid is ensured. In the embodiment, the porous member 606 has about 20 times area of the printing liquid supply path and therefore, flow of the printing liquid is ensured for a proper time. In addition, the bubble 608*a* stayed in the bottom face of the porous member 606 can be removed by proper operation of the suction recovery action.

The ratio of the sectional area of the flow path of the part, to which the porous member 606 of the printing liquid supply path 603*a* is attached, to the area of the porous member 606 can be selectively determined by changing the angle of attaching the porous member 606.

In the case where a horizontal direction is assumed 0 degrees, when 30 degrees is the angle of attaching the porous member 606, the area of the porous member 606 is about 1.1 times and more the sectional area of the flow path of the part, to which the porous member 606 is attached, 1.4 times for 45 degrees and more, and 1.7 times and more for 60 degrees. This area ratio is determined in consideration of a size of the external shape of the liquid jetting head unit 401 and assembling performance according to configuration thereof.

In the case where the porous member 606 has been arranged vertically to a rising direction (the direction of liquid flow of the printing liquid supply path 603*a*) of the bubble, the bubble 608*a* is easy to stay in the center of the printing liquid supply path 603*a* in the bottom face side of the porous member 606. When the bubble 608*a* that stays in this place further grows, it extends in a horizontal direction to easily clog the flow path of the bottom face side of the porous member 606. However, as described above, by the oblique arrangement of the porous member 606, the bubble which reached the porous member 606 stays the upward side of the printing liquid supply path and does not extend in the horizontal direction even if it grows. Therefore, in the bottom side of the porous member 606, the flow 608*b* of the printing liquid becomes easy to be kept. Therefore, the recovery action for keeping the flow path of the printing liquid can be reduced and further, reduction of use efficiency of the printing liquid caused by operation of recovery action and reduction of a recording speed can be prevented.

Further, in the case where the configuration is adapted to locate obliquely the porous member 606, the connecting part of the chip tank 603 and the second common liquid chamber 405 becomes oblique. Therefore, by injecting the filler 607 to fill this connecting part from the upward side of the connection, the filler 607 can be flown in smoothly and thus, a productivity of the liquid jetting head increases.

[Ink Tank Part]

Figure 5:
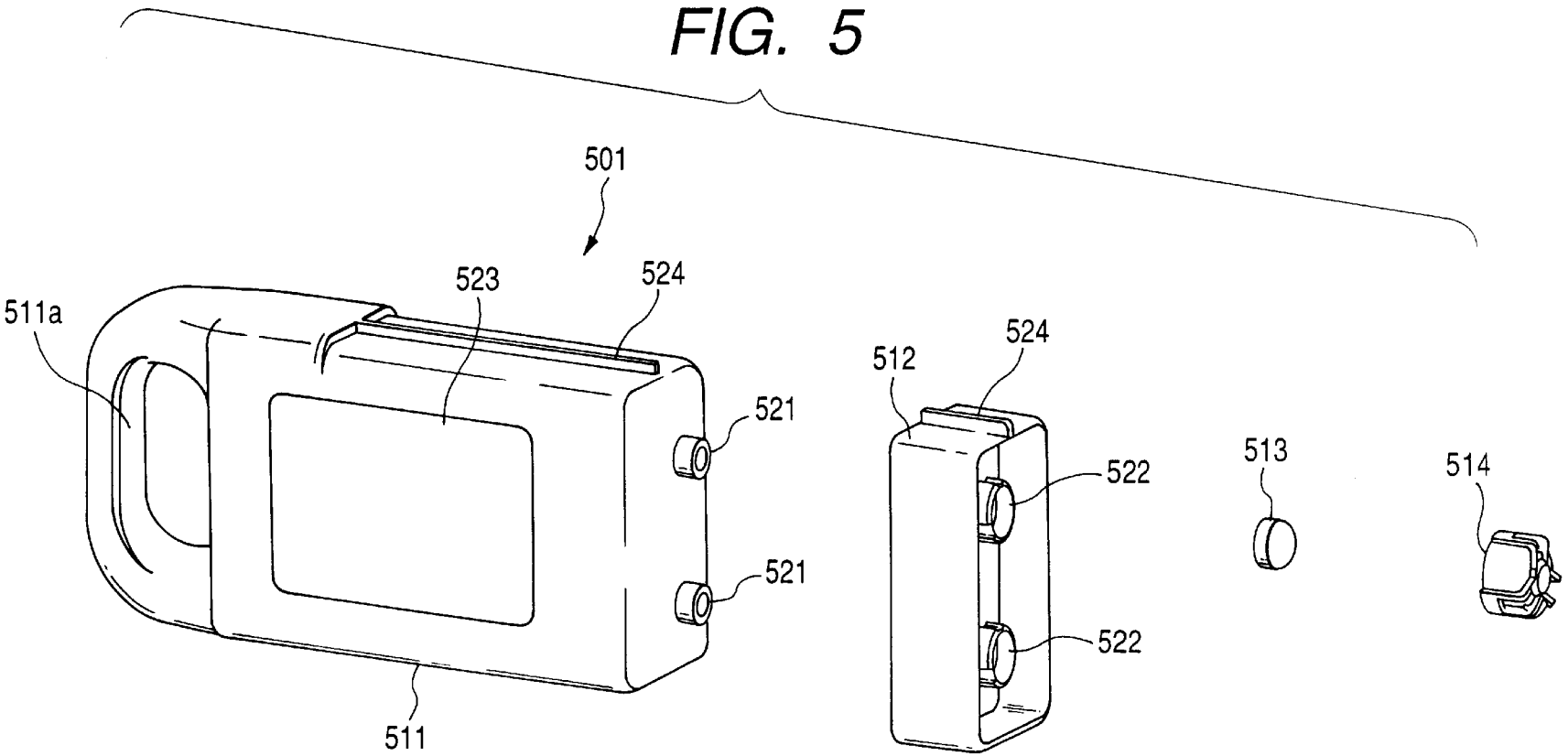
FIG. 5 is an exploded view of the main tank.

The FIG. 5 is a broken perspective view of showing an ink cartridge according to an embodiment of the present invention. The ink reservoir has been formed with an ink container 511 and a lid 512 of the ink container 511. The ink container 511 is formed by blow molding and has a handle 511*a* to help installing in, detaching from, and attaching to the main body of the printing machine. In addition, a side face of the ink container 511 is recessed to make a space 523 for adhesion of a label to distinguish a product.

To a housing 521 installed in the ink container 511, the lid 512 is fitted by ultrasonic welding. In the lid 512, the housing 522 is installed to form a communication port, dome-shaped elastics bodies (rubber plugs) 513 are assembled with respective ones, besides, by assembling a cap body 514 as a fixing member, the connecting part is formed to flowing of ink from and to the main body of the printing machine, and an integrated ink tank, namely, the ink cartridge, has been formed.

Concerning the head described in the embodiment, description was made for the printing apparatus for the envelope and the continuous paper which can be cut arbitrary, however, restriction is applied not only to the present configuration, but also can be applied to a normal printer using a normal paper.

In the present specification, "print" (in some cases, "record") must be understood to mean not only the case where a meaningful information such as a character, a figure, and the like, but also the case where an image, design, and pattern are formed on the printing medium in a broad sense or the medium is processed, regardless of meaningful and meaningless, and those manifested or not to be capable of perception by visual sense of a human.

Here, the "printing medium" means not only a paper used for a general printing apparatus, but also those, such as a cloth, plastic film, metal plate, glass, ceramic, wood, and leather in the broader sense, acceptable of ink.

Furthermore, "ink" (in some cases, liquid) must be understood in the broader sense as like as the definition of the above described "print," and means a liquid which can be provided by putting on the printing medium in order to form the image, design, and pattern or process of the printing medium or process of ink (for example, coagulation or insolubilization of a colorant contained in ink given to the printing medium.)

One embodiment effectively used for the present invention is the embodiment to form the bubble by taking place of film boiling in the liquid by applying a thermal energy generated by an electrothermal converting element.

In the printing apparatus of the embodiment, as described above, in the normal condition the liquid jetting head unit 401 mounted on the carriage 200, a member on which the head is mounted, is held by the CR lever 237 being a head holding mechanism. To the liquid chamber 405 being an ink holding part of the liquid jetting head unit 401 which has been held as described above, the CR needle 222, which is an ink supplying member and an air releasing member, has been connected by the CR joint lever 234 being a piping attaching and detaching mechanism.

In such status, the CR joint lever 234 is movable, but the CR lever 237 is immovable. Therefore, in the case where the liquid jetting head unit 401 is removed from the carriage 200, first, the CR needle 222 is released from the liquid jetting head unit 401, which is held in the carriage 200 by the CR lever 237, by the CR joint lever 234.

As described above, the CR lever 237 is movable, when the CR needle 222 is released from the liquid jetting head unit 401 by moving the CR joint lever 234 and then, the CR lever 237 is moved to make holding of the liquid jetting head unit 401 inactive. According to this operation, the liquid jetting head unit 401 becomes movable and therefore, can be removed from the carriage 200.

In the printing apparatus according to the embodiment, the CR needle 222 comprising a hollow needle is not structurally tough, press-fitted in the closed hole 416*b* of the joint rubber 416, and held in the direction of the entire circumference. However, when the CR needle 222 is removed from the liquid jetting head unit 401, the liquid jetting head unit 401 has been firmly held by the CR lever 237 in a proper position of the carriage 200 and the CR needle 222 is removed from the closed hole 416*b* of the joint rubber 416 in a proper direction by the CR joint lever 234 to cause no break.

Particularly, in the printing apparatus according to the embodiment, when the CR needle 222 is connected to the liquid jetting head unit 401 by the CR joint lever 234, the CR lever 237 is arranged in the position, in which the liquid jetting head unit 401 mounted on the carriage 200 is held. Hence, holding of the liquid jetting head unit 401, to which the CR needle 222 has been connected, by the CR lever 237 is never released and therefore, break of the CR needle 222 can be reliably prevented.

Further, in the printing apparatus according to the embodiment, when the liquid jetting head unit 401 mounted on the carriage 200 is held by the CR lever 237, the CR needle 222 is arranged movably between the position of removal from and the position of connection to the liquid jetting head unit 401 by the CR joint lever 234. Therefore, the CR needle 222 is attachable to and detachable from the liquid jetting head unit 401 held by the CR lever 237 and thus, the CR needle 222 can be attached to and detached from the liquid jetting head unit 401 of which position is kept.

Furthermore, in the printing apparatus according to the embodiment, as described above, a plurality of the CR needles 222 to be connected to the common liquid chamber 405 of the liquid jetting head unit 401 are used for both ink supply and air discharge and therefore, ink can be easily supplied from the CR needles 222 to the common liquid chamber 405.

Besides, when the liquid jetting head unit 401 is mounted on the carriage 200 and is held by the CR lever 237, the CR connector 216, which is an output terminal of the carriage 200, is connected to the contact pad 421, which is an input terminal of the liquid jetting head unit 401.

Therefore, in the time of removal of the CR needles 222 from the liquid jetting head unit 401, the CR connector 216 has been connected to the liquid jetting head unit 401 and hence, for example, leak of ink from the liquid jetting head unit 401 caused by removal of the CR needles 222 can be prevented by a signal input.

In the printing apparatus according to the embodiment, two sets of the liquid jetting head unit 401 are mounted on one set of the carriage 200 and therefore, image printing can be executed in a high speed. For instance, the image cam be printed with two colors. The present invention is not restricted to the above described embodiment and various modifications can be allowed in a range within the scope thereof. For example, though it is illustrated that two sets of the liquid jetting head unit 401 are mounted on one set of the carriage 200, such numbers of components can be determined freely.

As described above, the printing apparatus according to the embodiment comprises the liquid jetting head unit to discharge ink supplied from the outside corresponding to the print signal inputted from the outside, the head mounting member on which the liquid jetting head unit is mounted detachably, the head holding mechanism, supported movably, to hold the liquid jetting head unit detachably on the main body of the above described head mounting member, the ink supplying member connected detachably to the ink holding part of the above described liquid jetting head unit to supply ink, and the piping attaching and detaching mechanism to support movably the ink supplying member to connect detachably to the ink holding part of the above described liquid jetting head unit mounted on the main body of the above described mounting member, and the position of the above described piping attaching and detaching mechanism is controlled according to the position of the above described head holding mechanism when the above described liquid jetting head unit is attached to and detached from the above described head mounting member.

Therefore, in the printing apparatus according to the embodiment, in the case where the liquid jetting head unit is installed in the head mounting member, first, the liquid jetting head unit is mounted on the main body of the head mounting member and is held by the movable head holding mechanism, the liquid jetting head unit is arranged by positioning in the proper position of the head mounting member. Next, the ink supplying member is connected to the ink holding part of the liquid jetting head unit, which is held in the main body of the head mounting member by the head holding mechanism, by the piping attaching and detaching mechanism to make the status in which ink is supplied to the liquid jetting head unit. On the basis of that after the liquid jetting head unit, which is mounted on the head mounting member, is held by the head holding mechanism, the ink supply member is connected by the piping attaching and detaching mechanism, the ink supply member is never connected to the liquid jetting head unit improperly held.

Further, in the case where the liquid jetting head unit mounted on the head mounting member is removed, first, the ink supply member is removed from the liquid jetting head unit by the piping attaching and detaching mechanism, holding the liquid jetting head unit, from which this ink supply member has been removed, by the head holding mechanism is released, and the liquid jetting head unit is removed from the head mounting member of which holding has been released. Because after the ink supply member connected to the liquid jetting head unit is removed by the piping attaching and detaching mechanism, holding by the head holding mechanism is released, the ink supply member is removed from the liquid jetting head unit in the status, in which it has been held in the head mounting member by the head holding mechanism, by the piping attaching and detaching mechanism. Thus, the ink supply member is never removed from the liquid jetting head unit to the improper direction.

Furthermore, in the printing apparatus according to the embodiment, in the status in which the above described piping attaching and detaching mechanism has connected the above described ink supply member to the above described liquid jetting head unit mounted on the above described main body of the mounting member, the above described head holding mechanism can be located in the position in which the above described liquid jetting head unit, which is mounted on the above described main body of the mounting member, is held.

In this case, when the ink supply member has been connected to the liquid jetting head unit, which is mounted on the main body of the mounting member by the piping attaching and detaching mechanism, the head holding mechanism has held the liquid jetting head unit, which is mounted on the main body of the mounting member and therefore, holding by the head holding mechanism of the liquid jetting head unit, to which the ink supply member has been connected, is never released.

Furthermore, in the printing apparatus according to the embodiment, in the status in which the above described head holding mechanism has held the above described liquid jetting head unit in the above described main body of the mounting member, the above described piping attaching and detaching mechanism can locate movably the above described ink supply member in the position of removal from and the position of connection to the above described liquid jetting head unit.

In this case, when the liquid jetting head unit is held by the head holding mechanism in the main body of the mounting member, the ink supply member is attached to and detached from the liquid jetting head unit by the piping attaching and detaching mechanism and therefore, the ink supply member is attachable to and detachable from the liquid jetting head unit which is held by the head holding mechanism.

Furthermore, in the printing apparatus according to the embodiment, in the above described liquid jetting head unit, at least a part of the above described ink holding member has been sealed with an elastic member. The above described ink supply member comprises the hollow needle of which near-front end is opened. For the above described piping attaching and detaching mechanism, the hollow needle of the above described ink supply member can be penetrated through the elastic member of the above described liquid jetting head unit.

In this case, the hollow needle, of which near-front end is opened, of the ink supply member is penetrated by the piping attaching and detaching mechanism through the elastic member sealing at least a part of the ink holding member of the liquid jetting head unit. In such structure in which the hollow needle is penetrated through the elastic member, the ink supply member not tough is held from the entire directions of circumference. However, the hollow needle of the ink supply member is attached to and detached from the elastic member of the liquid jetting head unit, which is held by the head holding mechanism, by the piping attaching and detaching mechanism in the proper direction.

Furthermore, in the printing apparatus according to the embodiment, with the above described ink supply member, an air discharging member, by which air is discharged from the ink holding part of the above described liquid jetting head unit, is installed together. The above described piping attaching and detaching mechanism can detachably connect the above described air discharging member to the above described liquid jetting head unit together with the above described ink supply member.

In this case, the ink supply member and the air discharging member are detachably connected to the ink holding part of the liquid jetting head unit by the piping attaching and detaching mechanism and the air discharging member connected by such manner discharge air from the ink holding part and thus, ink can be easily supplied from the ink supply member to the ink holding part.

Furthermore, in the printing apparatus according to the embodiment, in the above described liquid jetting head unit, at least a part of the above described the ink holding part is sealed by the elastic member. The above described air discharging member comprises the hollow needle of which near-front end is opened. For the above described piping attaching and detaching mechanism, the hollow needle of the above described air discharging member can be passed through the elastic member of the above described liquid jetting head unit.

In this case, the hollow needle, of which near-front end is opened, of the air discharging member is penetrated by the piping attaching and detaching mechanism through the elastic member sealing at least a part of the ink holding member of the liquid jetting head unit. In such structure in which the hollow needle is penetrated through the elastic member, the air discharging member not tough is held from the entire directions of circumference. However, the hollow needle of the air discharging member is attached to and detached from the elastic member of the liquid jetting head unit, which is held by the head holding mechanism, by the piping attaching and detaching mechanism in the proper direction.

Furthermore, in the printing apparatus according to the embodiment, when the above described liquid jetting head unit is mounted on the above described head mounting member and is held by the above described head holding mechanism, the above described output terminal can be connected to the above described input terminal.

In this case, in the time of removal of the ink supply member from the liquid jetting head unit mounted on the head mounting member and held by the head holding mechanism, the input terminal of the liquid jetting head unit can be reliably connected to the output terminal of the head mounting member and hence, for instance, a control signal to prevent leak of ink in removal of the ink supply member can be inputted from outside to the liquid jetting head unit.

The embodiments have been configured according to the above descriptions and provide the following effects.

In the printing apparatus according to the embodiment, in case of installing the liquid jetting head unit on the head mounting member, because connecting the ink supplying member by the piping attaching and detaching mechanism after holding the liquid jetting head unit mounted on the head mounting member by the dead holding member, the ink supplying member is never connected to the liquid jetting head unit improperly held and therefore, break of the ink supplying member can be prevented in connecting the liquid jetting head unit.

In the printing apparatus according to the embodiment, in case of removing the liquid jetting head unit mounted on the head mounting member, because the ink supplying member connected to the liquid jetting head unit is removed by the piping attaching and detaching mechanism and then holding by the head holding mechanism is released, the ink supplying member is removed from the liquid jetting head unit, which is in the status of mounting on the head mounting member by the head holding mechanism, by the piping attaching and detaching mechanism, and the ink supplying member is never removed in a improper direction from the liquid jetting head unit and therefore, break of the ink supplying member can be prevented in removing the liquid jetting head unit.

In addition, in the printing apparatus according to the embodiment, when the ink supplying member has been connected to the liquid jetting head unit mounted on the main body of the head mounting member by the piping attaching and detaching mechanism, because the head holding mechanism holds the liquid jetting head unit mounted on the main body of the head mounting member, it can be reliably prevented that holding by the head holding mechanism of the liquid jetting head unit, to which the ink supplying member has been connected, is released.

Besides, when the liquid jetting head unit is held in the main body of the head mounting member by the head holding mechanism, because the ink supplying member is attached to or detached from the liquid jetting head unit by the piping attaching and detaching mechanism, the ink supplying member can be attached to or detached from the liquid jetting head unit held by the head holding mechanism.

Because the hollow needle, of which near-front end is opened, of the ink supply member is penetrated through the elastic member, which seals at least a part of the ink holding part of the liquid jetting head unit, by the piping attaching and detaching mechanism, in such structure in which the hollow needle is penetrated through the elastic member, the ink supply member not tough is held from the entire directions of circumference. However, the hollow needle of the ink supply member is attached to and detached from the elastic member of the liquid jetting head unit, which is held by the head holding mechanism, in the proper direction by the piping attaching and detaching mechanism. Therefore, when the liquid jetting head unit is removed, the hollow needle of the ink supply member not tough is never broken.

Because the ink supplying member and the air releasing member are attachably and detachably connected to the ink holding part of the liquid jetting head unit by the piping attaching and detaching mechanism, and the air releasing member connected in such manner releases air from the ink holding part, ink is easily supplied from the ink supply member to the ink holding part and the air releasing member is removed from the liquid jetting head unit in the proper direction, and thus, break never occurs.

Because the hollow needle, of which near-front end is opened, of the air releasing member is penetrated through the elastic member, which seals at least a part of the ink holding part of the liquid jetting head unit, by the piping attaching and detaching mechanism, in such structure in which the hollow needle is penetrated through the elastic member, the air releasing member not tough is held from the entire directions of circumference. However, the hollow needle of the air releasing member is attached to and detached from the elastic member of the liquid jetting head unit, which is held by the head holding mechanism, in the proper direction by the piping attaching and detaching mechanism. Therefore, when the liquid jetting head unit is removed, the hollow needle of the air releasing member not tough is never broken.

Because in the time of removal of the ink supply member from the liquid jetting head unit mounted on the head mounting member and held by the head holding mechanism, the input terminal of the liquid jetting head unit can be reliably connected to the output terminal of the head mounting member, for instance, a control signal to prevent leak of ink in removal of the ink supply member can be inputted from outside to the liquid jetting head unit and therefore, leak of ink from the liquid jetting head unit can be prevented in removing the ink supplying member.

What is claimed is:

1. A printing apparatus, comprising:

a head mounting member for removably mounting a liquid jet head unit containing an ink holding portion for holding ink:

a first lever for removably mounting the liquid jet head to the head mounting member, said first lever moving to a first position where the liquid jet head is not fixed to the head mounting member and a second position where the liquid jet head is fixed to the head mounting member;

an ink supplying member for supplying ink to the ink holding portion;

a second lever for removably mounting the ink supplying member to the ink holding portion, said second lever moving to a first position where the ink supplying member is not connected to the ink holding portion and a second position where the ink supplying member is connected to the ink holding portion; and a stopper member for restraining the second lever to move from the first position to the second position thereof when the first lever is at the first position thereof.

2. The printing apparatus according to claim 1, wherein:

at least part of the ink holding portion of the liquid jet head unit is sealed with an elastic member;

the ink supplying member comprises hollow needles each having an opening in the vicinity of its point; and the second lever allows the hollow needles of the ink supplying member to pass through the elastic member of the liquid jet head unit.

3. The printing apparatus according to claim 1, wherein the ink supplying member has an air releasing member for releasing air from the ink holding portion of the liquid jet head unit attached thereto and wherein the pipe-installing and removing mechanism also allows the air releasing member to be removably connected to the liquid jet head unit.

4. The printing apparatus according to claim 1, wherein an input terminal and an output terminal are connected to each other once the liquid jet head unit is mounted on the head mounting member and held by the head holding mechanism.

5. The printing apparatus according to claim 1, wherein the liquid jet head contains an electrothermal converting element for generating thermal energy to allow the liquid jet head to jet out liquid.

6. A printing apparatus comprising:

a head mounting member for removably mounting a liquid jet head unit containing an ink holding portion for holding ink;

a first lever for removably mounting the liquid jet head to the head mounting member, said first lever moving to a first position where the liquid jet head is not fixed to the head mounting member and a second position where the liquid jet head is fixed to the head mounting member, an ink supplying member for supplying ink to the ink holding portion;

a second lever for removably mounting the ink supplying member to the ink holding portion, said second lever moving to a first position where the ink supplying member is not connected to the ink holding portion and a second position where the ink supplying member is connected to the ink holding portion: and a stopper member for restraining the first lever to move from the second position to the first position thereof when the second lever is at the second position thereof.

7. The printing apparatus according to claim 6, wherein:

at least part of the ink holding portion of the liquid jet head unit is sealed with an elastic member;

the ink supplying member comprises hollow needles each having an opening in the vicinity of its point; and the second lever allows the hollow needles of the ink supplying member to pass through the elastic member of the liquid jet head unit.

8. The printing apparatus according to claim 6, wherein the ink supplying member has an air releasing member for releasing air from the ink holding portion of the liquid jet head unit attached thereto and the pipe-installing and removing mechanism also allows the air releasing member to be removably connected to the liquid jet head unit.

9. The printing apparatus according to claim 6, wherein an input terminal and an output terminal are connected to each other once the liquid jet head unit is mounted on the head mounting member and held by the head holding mechanism.

10. The printing apparatus according to claim 6, wherein the liquid jet head contains an electrothermal converting element for generating thermal energy to allow the liquid jet head to jet out liquid.

* * * * *

UNITED STATES PATENT AND TRADEMARK OFFICE

CERTIFICATE OF CORRECTION

PATENT NO. : 6,648,456 B1
DATED : November 18, 2003
INVENTOR(S) : Shinya Asano

It is certified that error appears in the above-identified patent and that said Letters Patent is hereby corrected as shown below:

Column 1,
Line 23, “type” should read -- types of --; and
Line 31, “move” should read -- moving --.

Column 4,
Line 27, “an” should read -- a --; and
Line 58, “the” should read -- a --.

Column 6,
Line 37, “This” should read -- These --.

Column 7,
Line 32, “side” should read -- sides --.

Column 8,
Line 52, “begins” should read -- begin --.

Column 9,
Line 35, “stored” should read -- stored in --;
Line 38, “a” should read -- an --;
Line 52, “let” should read -- letting --; and
Line 62, “a” should read—an --.

Column 10,
Line 1, “subtak” should read -- subtank --.

Column 11,
Line 14, “inside” should read -- inside of --.

Column 12,
Line 5, “with” should read -- with a --;
Line 18, “rotating” should read -- rotates --; and
Line 24, “kept” should read -- kept in --.

Column 13,
Line 8, “to be” should read -- is --.

Column 15,
Line 31, “envelop” should read -- envelope --.

UNITED STATES PATENT AND TRADEMARK OFFICE

CERTIFICATE OF CORRECTION

PATENT NO. : 6,648,456 B1
DATED : November 18, 2003
INVENTOR(S) : Shinya Asano

It is certified that error appears in the above-identified patent and that said Letters Patent is hereby corrected as shown below:

Column 16,
Line 12, “envelop” should read -- envelope --; and
Line 36, “shown:” should read -- shown in --.

Column 17,
Line 1, “of” should read -- of a --; and
Line 60, “he” should read -- the --.

Column 18,
Line 33, “though” should read -- through --.

Column 19,
Line 34, “spring is” should read -- spring --; and
Line 51, “against an” should read -- against a --.

Column 20,
Line 39, “Number” should read -- A number --; and
Line 64, “bosses 2001” should read -- bosses 200ℓ --.

Column 21,
Line 12, “part” should read -- parts --
Line 41, “adapted” should read -- adapt --; and
Line 54, “bosses 2001” should read -- bosses 200ℓ --.

Column 23,
Line 3, “adjusted” should read -- adjusted for --;
Lines 14 and 18, “a” should read -- an --.

Column 25,
Line 23, “a” should be deleted.

Column 26,
Line 16, “an” should read -- a --; and
Line 61, “when” should read -- when it --.

Column 28,
Line 22, “vale” should read -- valve --;
Line 39, “the e” should read -- the --; and
Line 47, “with only difference in” should read -- with the only difference in the --.

UNITED STATES PATENT AND TRADEMARK OFFICE

CERTIFICATE OF CORRECTION

PATENT NO. : 6,648,456 B1
DATED : November 18, 2003
INVENTOR(S) : Shinya Asano

It is certified that error appears in the above-identified patent and that said Letters Patent is hereby corrected as shown below:

Column 29,
Line 48, “edescribed” should read -- described --.

Column 30,
Line 18, “of” should read -- off --;
Line 19, “dissolve” should read -- dissolving --;
Line 21, “doing” should read -- during --; and
Line 43, “that” should read -- that of --.

Column 31,
Line 8, “sopping” should read -- stopping --;
Line 11, “t he” should read -- the --; and
Line 21, “e one-way” should read -- one-way --.

Colulmn 33,
Line 60, “store an” should read -- store a --; and
Line 65, “separated” should read -- separated from --.

Column 34,
Line 61, “keep” should read -- kept --.

Column 35,
Line 8, “mans” should read -- means --; and
Line 43, “positioned” should read -- positioned to --.

Column 36,
Line 18, “faces” should read -- faces to --.

Column 37,
Line 50, “an” should be deleted.

Column 38,
Line 9, “for 45 degrees and more,” should read -- and more for 45 degrees, --; and
Line 24, “stay” should read -- stays on --.

Column 40,
Line 30, “cam” should read -- can --.

Column 43,
Line 26, “in a” should read -- in an --.

UNITED STATES PATENT AND TRADEMARK OFFICE

CERTIFICATE OF CORRECTION

PATENT NO. : 6,648,456 B1
DATED : November 18, 2003
INVENTOR(S) : Shinya Asano

It is certified that error appears in the above-identified patent and that said Letters Patent is hereby corrected as shown below:

Column 45,
Line 4, “pipe-installing” should read -- second lever” and
Line 5, “and removing mechanism” should be deleted.

Column 46,
Lines 18-19, “the pipe-installing and removing mechanism” should read -- wherein the second lever --.

Signed and Sealed this

Thirty-first Day of August, 2004

JON W. DUDAS
*Director of the United States Patent and Trademark Office*